US010557400B2

(12) United States Patent
Hasegawa et al.

(10) Patent No.: US 10,557,400 B2
(45) Date of Patent: Feb. 11, 2020

(54) COOLING APPARATUS OF INTERNAL COMBUSTION ENGINE

(71) Applicant: TOYOTA JIDOSHA KABUSHIKI KAISHA, Toyota-shi, Aichi-ken (JP)

(72) Inventors: Yoshio Hasegawa, Toyota (JP); Tomohiro Shinagawa, Sunto-gun (JP); Yuji Miyoshi, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 129 days.

(21) Appl. No.: 15/936,114

(22) Filed: Mar. 26, 2018

(65) Prior Publication Data

US 2018/0283260 A1 Oct. 4, 2018

(51) Int. Cl.

| | |
|---|---|
| ***F01P 3/02*** | (2006.01) |
| ***F01P 7/16*** | (2006.01) |
| ***F01P 5/10*** | (2006.01) |
| *F02F 1/36* | (2006.01) |
| *F02F 1/10* | (2006.01) |
| *F01P 7/14* | (2006.01) |

(52) U.S. Cl.

CPC ..... *F01P 7/165* (2013.01); *F01P 3/02* (2013.01); *F01P 5/10* (2013.01); *F01P 2003/027* (2013.01); *F01P 2003/028* (2013.01); *F01P 2007/146* (2013.01); *F02F 1/10* (2013.01); *F02F 1/36* (2013.01)

(58) Field of Classification Search

CPC ..... F01P 7/06; F01P 3/02; F01P 5/10; F01P 2003/027; F01P 2003/025; F02F 1/10

See application file for complete search history.

(56) References Cited

U.S. PATENT DOCUMENTS

| | | | | |
|---|---|---|---|---|
| 4,759,316 A * | 7/1988 | Itakura | F01P 7/165 | 123/41.08 |
| 10,385,759 B2 * | 8/2019 | Hasegawa | F01P 3/18 | |
| 2003/0000487 A1 * | 1/2003 | Schmitt | F01P 3/02 | 123/41.72 |

FOREIGN PATENT DOCUMENTS

| | | |
|---|---|---|
| EP | 2 796 686 A1 | 10/2014 |
| GB | 2540401 A | 1/2017 |
| JP | 2012-184693 | 9/2012 |
| JP | 2013-160183 | 8/2013 |

OTHER PUBLICATIONS

U.S. Appl. No. 15/895,239, filed Feb. 13, 2018.

* cited by examiner

*Primary Examiner* — Kevin A Lathers
(74) *Attorney, Agent, or Firm* — Finnegan, Henderson, Farabow, Garrett & Dunner, LLP

(57) ABSTRACT

The cooling apparatus of the engine sets the first shut-off valve to the closed position, sets the second shut-off valve to the open position, and performs the opposite flow connection operation to supplies the cooling water directly to the cylinder block water passage from the cylinder head water passage without flowing the cooling water through the radiator and to the heat exchanger from the cylinder head water block when the engine temperature is lower than the completely-warmed temperature, and the cooling water is requested to be supplied to the heat exchanger.

11 Claims, 31 Drawing Sheets

| | EGR COOLER WATER SUPPLY IS NOT REQUESTED AND HEATER CORE WATER SUPPLY IS NOT REQUESTED. | EGR COOLER WATER SUPPLY IS REQUESTED AND HEATER CORE WATER SUPPLY IS NOT REQUESTED. | EGR COOLER WATER SUPPLY IS NOT REQUESTED AND HEATER CORE WATER SUPPLY IS REQUESTED. | EGR COOLER WATER SUPPLY IS REQUESTED AND HEATER CORE WATER SUPPLY IS REQUESTED. |
|---|---|---|---|---|
| COOL STATE | ACTIVATION CONTROL A | ACTIVATION CONTROL B | ACTIVATION CONTROL C | ACTIVATION CONTROL D |
| FIRST SEMI-WARMED STATE | ACTIVATION CONTROL F | ACTIVATION CONTROL F | ACTIVATION CONTROL G | ACTIVATION CONTROL H |
| SECOND SEMI-WARMED STATE | ACTIVATION CONTROL F | ACTIVATION CONTROL I | ACTIVATION CONTROL J | ACTIVATION CONTROL K |
| COMPLETELY-WARMED STATE | ACTIVATION CONTROL L | ACTIVATION CONTROL M | ACTIVATION CONTROL N | ACTIVATION CONTROL O |

Fig.4

SECOND MODIFIED EXAMPLE

| | EGR COOLER WATER SUPPLY IS NOT REQUESTED AND HEATER CORE WATER SUPPLY IS NOT REQUESTED. | EGR COOLER WATER SUPPLY IS REQUESTED AND HEATER CORE WATER SUPPLY IS NOT REQUESTED. | EGR COOLER WATER SUPPLY IS NOT REQUESTED AND HEATER CORE WATER SUPPLY IS REQUESTED. | EGR COOLER WATER SUPPLY IS REQUESTED AND HEATER CORE WATER SUPPLY IS REQUESTED. |
|---|---|---|---|---|
| COOL STATE | ACTIVATION CONTROL A | ACTIVATION CONTROL B | ACTIVATION CONTROL C | ACTIVATION CONTROL D |
| INITIAL WARMED STATE | ACTIVATION CONTROL E | ACTIVATION CONTROL F | ACTIVATION CONTROL G | ACTIVATION CONTROL H |
| MIDDLE SEMI-WARMED STATE | ACTIVATION CONTROL F | ACTIVATION CONTROL F | ACTIVATION CONTROL G | ACTIVATION CONTROL H |
| FINAL SEMI-WARMED STATE | ACTIVATION CONTROL F | ACTIVATION CONTROL I | ACTIVATION CONTROL J | ACTIVATION CONTROL K |
| COMPLETELY-WARMED STATE | ACTIVATION CONTROL L | ACTIVATION CONTROL M | ACTIVATION CONTROL N | ACTIVATION CONTROL O |

Fig.31

COOLING APPARATUS OF INTERNAL COMBUSTION ENGINE

BACKGROUND

Field

The invention relates to a cooling apparatus of an internal combustion engine for cooling the internal combustion engine by cooling water.

Description of the Related Art

An amount of heat transmitted to a cylinder block of an internal combustion engine due to combustion in cylinders, is smaller than the amount of the heat transmitted to a cylinder head of the engine due to the combustion in the cylinders. Thereby, a block temperature (i.e., a temperature of the cylinder block) is unlikely to increase easily compared with a head temperature (i.e., a temperature of the cylinder head).

Accordingly, there is known a cooling apparatus of the engine configured to supply cooling water to the cylinder head without supplying the cooling water to the cylinder block when an engine temperature (i.e., a temperature of the engine) is lower than an engine completely-warmed temperature (for example, see JP 2012-184693 A). The engine completely-warmed temperature is a temperature at which a warming of the engine is completed.

The known cooling apparatus can increase the block temperature at a large rate. As a result, the known cooling apparatus can cause the engine temperature to reach the engine completely-warmed temperature promptly.

As one of methods for increasing the block temperature at the large rate, there is a method which supplies the cooling water from a head water passage directly to a block water passage without flowing the cooling water through a radiator. The cylinder head water passage is a cooling water passage formed in the cylinder head. The cylinder block water passage is a cooling water passage formed in the cylinder block. With this method, the cooling water having a temperature increased by flowing through the head water passage, is supplied to the block water passage. Thus, the block temperature increases at the large rate.

In this case, a head cooling water flow rate is equal to a block cooling water flow rate. The head cooling water flow rate is a flow rate of the cooling water supplied to the head water passage. The block cooling water flow rate is a flow rate of the cooling water supplied to the block water passage.

When the cooling water is supplied to the head and block water passages, the cylinder head and the cylinder block are cooled by the cooling water. In this regard, an amount of heat received by the cylinder head, is larger than an amount of heat received by the cylinder block. Thus, the increasing rate of the head temperature is large compared with the increasing rate of the block temperature.

Therefore, when the head cooling water flow rate is equal to the block cooling water flow rate, and the block cooling water flow rate is controlled to a small flow rate for the purpose of increasing the block temperature at the large rate, the head cooling water flow rate is small. Thereby, the head temperature may increase at the large rate to an excessively high temperature. As a result, the cooling water may boil in the head water passage. On the other hand, when the head cooling water flow rate is increased for the purpose of preventing the cooling water from boiling in the head water passage, the block cooling water flow rate increases. Thereby, the increasing rate of the block temperature decreases.

SUMMARY

The invention has been made for the purpose of solving the above-described problem. An object of the invention is to provide a cooling apparatus of the engine capable of increasing the block temperature at the large rate and preventing the cooling water from boiling in the head water passage when the engine temperature is low.

A cooling apparatus of an internal combustion engine (10) according to the invention cools a cylinder head (14) and a cylinder block (15) of the internal combustion engine (10) by cooling water. The cooling apparatus according to the invention comprises a pump (70), a first water passage (51), and a second water passage (52). The pump (70) circulates the cooling water. The first water passage (51) is formed in the cylinder head (14). The second water passage (52) is formed in the cylinder block (15).

The cooling apparatus according to one of aspects of the invention, further comprises a third water passage (53 and 54), a normal flow connection water passage (53 and 55), an opposite flow connection water passage (552, 62, and 584), a switching part (78), a fourth water passage (56 and 57), and fifth and sixth water passages (58; 581, 582, 59, 60, 61, 583, and 584). The third water passage (53 and 54) connects a first end (51A) of the first water passage (51) to a pump discharging opening (70*out*) of the pump (70). The cooling water is discharged from the pump (70) via the pump discharging opening (70*out*). The normal flow connection water passage (53 and 55) connects a first end (52A) of the second water passage (52) to the pump discharging opening (70*out*). The opposite flow connection water passage (552, 62, and 584) connects the first end (52A) of the second water passage (52) to a pump suctioning opening (70*in*) of the pump (70). The cooling water is suctioned into the pump (70) via the pump suctioning opening (70*in*). The switching part (78) switches a cooling water flow between a flow of the cooling water through the normal flow connection water passage (53 and 55) and a flow of the cooling water through the opposite flow connection water passage (552, 62, and 584). The fourth water passage (56 and 57) connects a second end (51B) of the first water passage (51) to a second end (52B) of the second water passage (52). The fifth and sixth water passages (58; 581, 582, 59, 60, 61, 583, and 584) connects the fourth water passage (56 and 57) to the pump suctioning opening (70*in*), respectively.

The cooling apparatus according to another aspect of the invention, further comprises a third water passage (53 and 55), a normal flow connection water passage (53 and 54), an opposite flow connection water passage (542, 62, and 584), a switching part (78), a fourth water passage (56 and 57), and fifth and sixth water passages (58; 581, 582, 59, 60, 61, 583, and 584). The third water passage (53 and 55) connects a first end (52A) of the second water passage (52) to a pump suctioning opening (70*in*) of the pump (70). The cooling water is suctioned into the pump (70) via the pump suctioning opening (70*in*). The normal flow connection water passage (53 and 54) connects a first end (51A) of the first water passage (51) to the pump suctioning opening (70*in*). The opposite flow connection water passage (542, 62, and 584) connects the first end (51A) of the first water passage (51) to a pump discharging opening (70*out*) of the pump (70). The cooling water is discharged from the pump (70) via the pump discharging opening (70*out*). The switching part (78) switches a cooling water flow between a flow of the cooling water through the normal flow connection water passage (53 and 54) and a flow of the cooling water through the opposite flow connection water passage (542, 62, and 584). The fourth water passage (56 and 57) connects a second end (51B) of the first water passage (51) to a second end (52B) of the second water passage (52). The fifth and sixth water passages (58; 581, 582, 59, 60, 61, 583, and 584) connects the fourth water passage (56 and 57) to the pump discharging opening (70*out*), respectively.

The cooling apparatus according to the invention, further comprises a radiator (71), a heat exchanger (43 or 72), a first shut-off valve (75), a second shut-off valve (76 or 77), and an electronic control unit (90). The radiator (71) is provided at the fifth water passage (58) for cooling the cooling water. The heat exchanger (43 or 72) is provided in the sixth water passage (581, 582, 59, 60, 61, 583, and 584) for exchanging heat with the cooling water. The first shut-off valve (75) shuts off and opens the fifth water passage (58). The first shut-off valve (75) shuts off the fifth water passage (58) when the first shut-off valve (75) is set to a closed position. The first shut-off valve (75) opens the fifth water passage (58) when the first shut-off valve (75) is set to an open position. The second shut-off valve (76 or 77) shuts off and opens the sixth water passage (581, 582, 59, 60, 61, 583, and 584). The second shut-off valve (76 or 77) shuts off the sixth water passage (581, 582, 59, 60, 61, 583, and 584) when the second shut-off valve (76 or 77) is set to a closed position. The second shut-off valve (76 or 77) opens the sixth water passage (581, 582, 59, 60, 61, 583, and 584) when the second shut-off valve (76 or 77) is set to an open position. The electronic control unit (90) controls activations of the pump (70), the switching part (78), the first shut-off valve (75), and the second shut-off valve (76 or 77).

The cooling water flows through the normal flow connection water passage (53 and 55) when the switching part (78) performs a normal flow connection operation while the pump (70) is activated (see FIGS. 12 to 18, and 30). The cooling water flows through the opposite flow connection water passage (552, 62, and 584) when the switching part (78) performs an opposite flow connection operation while the pump (70) is activated (see FIGS. 8 to 11, and 29).

The electronic control unit (90) is configured to activate the pump (70), set the first shut-off valve (75) to the open position, and perform the normal flow connection operation when an engine temperature is equal to or higher than a completely-warmed temperature at which a warming of the internal combustion engine (10) is estimated to be completed.

The electronic control unit (90) is configured to activate the pump (70) and set the second shut-off valve (76 or 77) to the open position when a supply of the cooling water to the heat exchanger (43 or 72) is requested.

The electronic control unit (90) is configured to activate the pump (70), set the first shut-off valve (75) to the closed position, set the second shut-off valve (76 or 77) to the open position, and perform the opposite flow connection operation when the engine temperature is in a predetermined temperature range defined by upper and lower limit temperatures lower than the completely-warmed temperature, and the supply of the cooling water to the heat exchanger (43 or 72) is requested.

When the cooling apparatus according to the invention performs the opposite flow connection operation while the pump is activated, the cooling water flows out from the head water passage and flows directly into the block water passage without flowing through the radiator and the heat exchanger even though the first and second shut-off valves are set to the closed positions, respectively. Therefore, when the engine temperature is in the predetermined temperature range, and the supply of the cooling water to the heat exchanger is not requested, the cooling apparatus may set the first and second shut-off valves to the closed positions, respectively and perform the opposite flow connection operation. Thereby, the cooling water having a temperature increased by flowing through the head water passage, is supplied directly to the block water passage. Thus, the temperature of the cylinder block increases at the large rate.

In this case, a head cooling water flow rate (i.e., a flow of the cooling water flowing through the head water passage) and a block cooling water flow rate (i.e., a flow of the cooling water flowing through the block water passage) are equal to each other. As described above, in this case, if a pump discharging flow rate (i.e., a flow rate of the cooling water discharged from the pump) is set such that the head cooling water flow rate is relatively large so as to prevent a boil of the cooling water in the head water passage, the block cooling water flow rate is relatively large. In this case, an increasing rate of the block temperature is small. As a result, the block temperature does not increase at a desired large rate.

On the other hand, when the pump discharging flow rate is set such that the block cooling water flow rate is relatively small so as to increase the block temperature at the desired large rate, the head cooling water flow rate is small. In this case, the increasing rate of the head temperature is large. As a result, the cooling water may not be prevented from boiling in the head water passage.

The cooling apparatus according to the invention activates the pump, sets the first shut-off valve to the closed position, sets the second shut-off valve to the open position, and performs the opposite flow connection operation when the engine temperature is in the predetermined temperature range, and the supply of the cooling water to the heat exchanger is not requested. Thereby, a part of the cooling water flowing out from the head water passage, flows through the heat exchanger. Thus, the block cooling water flow rate is smaller than the head cooling water flow rate. In this case, even when the pump cooling water discharge flow rate is set such that the head cooling water flow rate is a flow rate capable of preventing the cooling water from boiling in the head water passage, the block temperature increases at the desired sufficiently large rate. Thus, the cooling water is prevented from boiling in the head water passage, and the block temperature increases at the large rate.

The electronic control unit (90) may be configured to activate the pump (70), set the first shut-off valve (75) to the closed position, set the second shut-off valve (76 or 77) to the open position, and perform the normal flow connection operation when the engine temperature is higher than the upper limit temperature of the predetermined temperature range and lower than the completely-warmed temperature, and the supply of the cooling water to the heat exchanger (43 or 72) is requested.

When the engine temperature is higher than the upper limit temperature of the predetermined temperature range and lower than the completely-warmed temperature, the engine temperature is high compared with when the engine temperature is in the predetermined temperature range. When the engine temperature is high, and the increasing rate of the block temperature is excessively large, the temperature of the cooling water in the block water passage, increases excessively. As a result, the cooling water may boil in the block water passage. Thus, the increasing rate of the block temperature is preferably small compared with when the engine temperature is in the predetermined temperature range.

The cooling apparatus according to the invention activate the pump (70), sets the first shut-off valve to the closed position, sets the second shut-off valve to the open position, and performs the normal flow connection operation when the engine temperature is higher than the upper limit temperature of the predetermined temperature range and lower than the completely-warmed temperature, and the supply of the cooling water to the heat exchanger is requested. In this case, the cooling water flows out from the head and block water passages and then, flows through the heat exchanger without flowing through the radiator. Then, the cooling water is supplied to the head and block water passages. Therefore, the temperature of the cooling water supplied to the block water passage is lower than the temperature of the cooling water which does not flow through the radiator and the heat exchanger. In addition, the temperature of the cooling water supplied to the block water passage is higher than the temperature of the cooling water which flows through the radiator. Thus, the cooling water is prevented from boiling in the block water passage, and the block temperature increases at the relatively large rate.

The electronic control unit (90) may be configured to activate the pump (70), set the first shut-off valve (75) to the closed position, set the second shut-off valve (76 or 77) to the open position, and perform the opposite flow connection operation when the engine temperature is higher than the upper limit temperature of the predetermined temperature range and lower than the completely-warmed temperature, and the supply of the cooling water to the heat exchanger (43 or 72) is not requested.

If the first shut-off valve is set to the closed position, the second shut-off valve is set to the open position, and the normal flow connection operation is performed in while the engine temperature is higher than the upper limit temperature of the predetermined temperature range and lower than the completely-warmed temperature, and the supply of the cooling water to the heat exchanger is not requested, the cooling water is prevented from boiling in the head water passage, and the block temperature increases at the relatively large rate. In this case, the cooling water flowing out from the head and block passages, is supplied to the heat exchanger. Thus, a large amount of the cooling water is supplied to the heat exchanger. When the supply of the cooling water to the heat exchanger is not requested, it is preferred that no cooling water is supplied to the heat exchanger. Therefore, it is not preferred that the large amount of the cooling water is supplied to the heat exchanger.

According to the invention, when the engine temperature is higher than the upper limit temperature of the predetermined temperature range and lower than the completely-warmed temperature, and the supply of the cooling water to the heat exchanger is not requested, the pump is activated, the first shut-off valve is set to the closed position, the second shut-off valve is set to the open position, and the opposite flow connection operation is performed. Thereby, a part of the cooling water flowing out from the head water passage, is supplied directly to the block water passage. Therefore, the flow rate of the cooling water supplied to the heat exchanger, is small. Thus, the block temperature increases at the relatively large rate, and the large amount of the cooling water is prevented from being supplied to the heat exchanger.

The electronic control unit (90) may be configured to activate the pump (70), set the first shut-off valve (75) and the second shut-off valve (76 or 77) to the closed positions, respectively, and perform the opposite flow connection operation when the engine temperature is lower than the lower limit temperature of the predetermined temperature range, and the supply of the cooling water to the heat exchanger (43 or 72) is not requested.

When the engine temperature is lower than the lower limit temperature of the predetermined temperature range, the engine temperature is low compared with when the engine temperature is in the predetermined temperature range. Thus, the increasing rate of the block temperature should be large compared with when the engine temperature is in the predetermined temperature range.

According to the invention, when the engine temperature is lower than the lower limit temperature of the predetermined temperature range, and the supply of the cooling water to the heat exchanger is not requested, the pump is activated, the first and second shut-off valves are set to the closed positions, respectively, and the opposite flow connection operation is performed. Thereby, the cooling water having a temperature increased by flowing through the head water temperature, is supplied directly to the block water passage through the fourth water passage without flowing through the radiator and the heat exchanger. Thus, the increasing rate of the block temperature is large compared with when the cooling water is supplied to the block water passage through the radiator or the heat exchanger or compared with when only a part of the cooling water flowing out from the head water passage, is supplied to the block water passage through the fourth water passage without flowing through the radiator and the heat exchanger.

The switching part (78) may be configured to shut off the normal and opposite flow connection passages (53 and 55, and 552, 62, and 584). In this case, the electronic control unit (90) may be configured to activate the pump (70), set the first shut-off valve (75) to the closed position, set the second shut-off valve (76 or 77) to the open position, and shut-off the normal and opposite flow connection passages (53 and 55, and 552, 62, and 584) by the switching part (78) when the engine temperature is lower than the lower limit temperature of the predetermined temperature range, and the supply of the cooling water to the heat exchanger (43 or 72) is requested.

The electronic control unit (90) may be configured to stop the activation of the pump (70) when the engine temperature is lower than the lower limit temperature of the predetermined temperature range, and the supply of the cooling water to the heat exchanger (43 or 72) is not requested.

In the above description, for facilitating understanding of the present invention, elements of the present invention corresponding to elements of an embodiment described later are denoted by reference symbols used in the description of the embodiment accompanied with parentheses. However, the elements of the present invention are not limited to the elements of the embodiment defined by the reference symbols. The other objects, features, and accompanied advantages of the present invention can be easily understood from the description of the embodiment of the present invention along with the drawings.

BRIEF DESCRIPTION OF THE DRAWINGS

FIG. 4 is a view for showing activation controls executed by the cooling apparatus according to the embodiment.

FIG. 31 is a view for showing the activation controls executed by a cooling apparatus of the engine according to a second modified example of the embodiment of the invention.

DESCRIPTION OF THE PREFERRED EMBODIMENTS

Below, a cooling apparatus of an internal combustion engine according to an embodiment of the invention will be described with reference to the drawings. The cooling apparatus according to the embodiment is applied to an internal combustion engine 10 shown in FIGS. 1 and 2. Hereinafter, the cooling apparatus according to the embodiment will be referred to as "the embodiment apparatus". The engine 10 is a multi-cylinder (in this embodiment, linear-four-cylinder) four-cycle piston-reciprocation type diesel engine. The engine 10 may be a gasoline engine.

Figure 1:
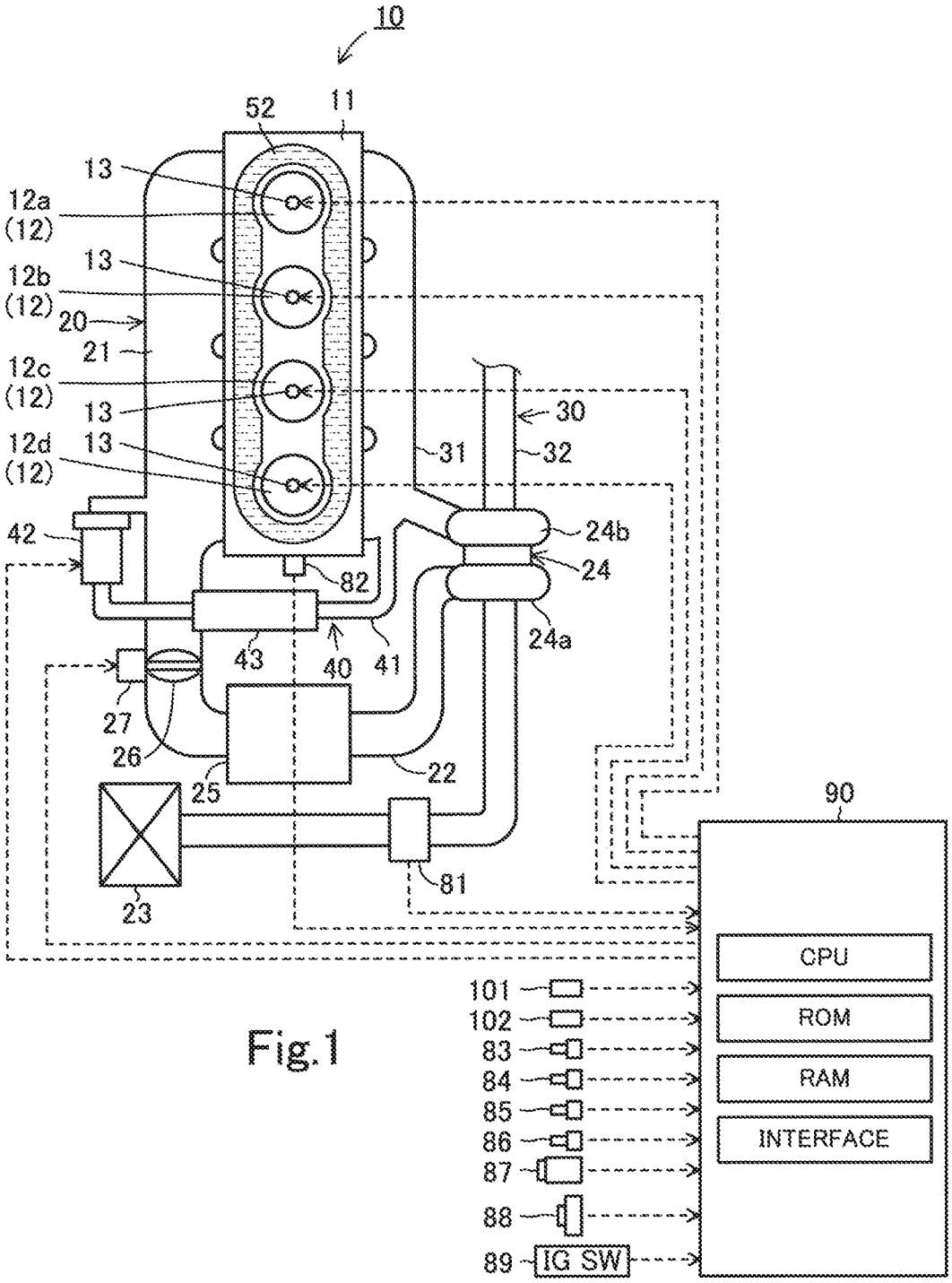
FIG. 1 is a view for showing an internal combustion engine to which a cooling apparatus according to an embodiment of the invention is applied.

As shown in FIG. 1, the engine 10 includes an engine body 11, an intake system 20, an exhaust system 30, and an EGR system 40.

The engine body 11 includes a cylinder head 14, a cylinder block 15 (see FIG. 2), a crank case (not shown) and the like. Four cylinders or combustion chambers 12*a* to 12*d* are formed in the engine body 11. Fuel injectors 13 are provided such that the fuel injectors 13 expose to upper areas of the cylinders 12*a* to 12*d*, respectively. Hereinafter, the cylinders 12*a* to 12*d* will be collectively referred to as "the cylinders 12". The fuel injectors 13 open in response to commands output from an electronic control unit 90 described later, thereby injecting fuel directly into the cylinders 12, respectively. Hereinafter, the electronic control unit 90 will be referred to as "the ECU 90".

The intake system 20 includes an intake manifold 21, an intake pipe 22, an air cleaner 23, a compressor 24*a* of a turbocharger 24, an intercooler 25, a throttle valve 26, and a throttle valve actuator 27.

The intake manifold 21 includes branch portions and a collecting portion. The branch portions are connected to the cylinders 12, respectively and to a collecting portion. The intake pipe 22 is connected to the collecting portion of the intake manifold 21. The intake manifold 21 and the intake pipe 22 define an intake passage. The air cleaner 23, the compressor 24*a*, the intercooler 25, and the throttle valve 26 are provided at the intake pipe 22 in order from upstream to downstream in a flow direction of the intake air. The throttle valve actuator 27 changes an opening degree of the throttle valve 26 in response to the commands output from the ECU 90.

The exhaust system 30 includes an exhaust manifold 31, an exhaust pipe 32, and a turbine 24*b* of the turbocharger 24.

The exhaust manifold 31 includes branch portions and a collecting portion. The branch portions are connected to the cylinders 12, respectively and to a collecting portion. The exhaust pipe 32 is connected to the collecting portion of the exhaust manifold 31. The exhaust manifold 31 and the exhaust pipe 32 define an exhaust passage. The turbine 24*b* is provided in the exhaust pipe 32.

The EGR system 40 includes an exhaust gas recirculation pipe 41, an EGR control valve 42, and an EGR cooler 43.

The exhaust gas recirculation pipe 41 communicates with the exhaust passage upstream of the turbine 24*b*, in particular, the exhaust manifold 31 and the intake passage downstream of the throttle valve 26, in particular, the intake manifold 21. The exhaust gas recirculation pipe 41 defines an EGR gas passage.

The EGR control valve 42 is provided in the exhaust gas recirculation pipe 41. The EGR control valve 42 changes a passage cross-section area of the EGR gas passage in response to the commands output from the ECU 90, thereby, changing an amount of an exhaust gas (i.e., EGR gas) recirculated from the exhaust passage to the intake passage. The exhaust gas is a gas discharged from the engine 10 to the exhaust passage.

The EGR cooler 43 is provided in the exhaust gas recirculation pipe 41 and lowers a temperature of the EGR gas passing through the exhaust gas recirculation pipe 41 by cooling water as described later. Therefore, the EGR cooler 43 is a heat exchanger for exchanging heat between the cooling water and the EGR gas, in particular, the heat exchanger for applying the heat from the EGR gas to the cooling water.

Figure 2:
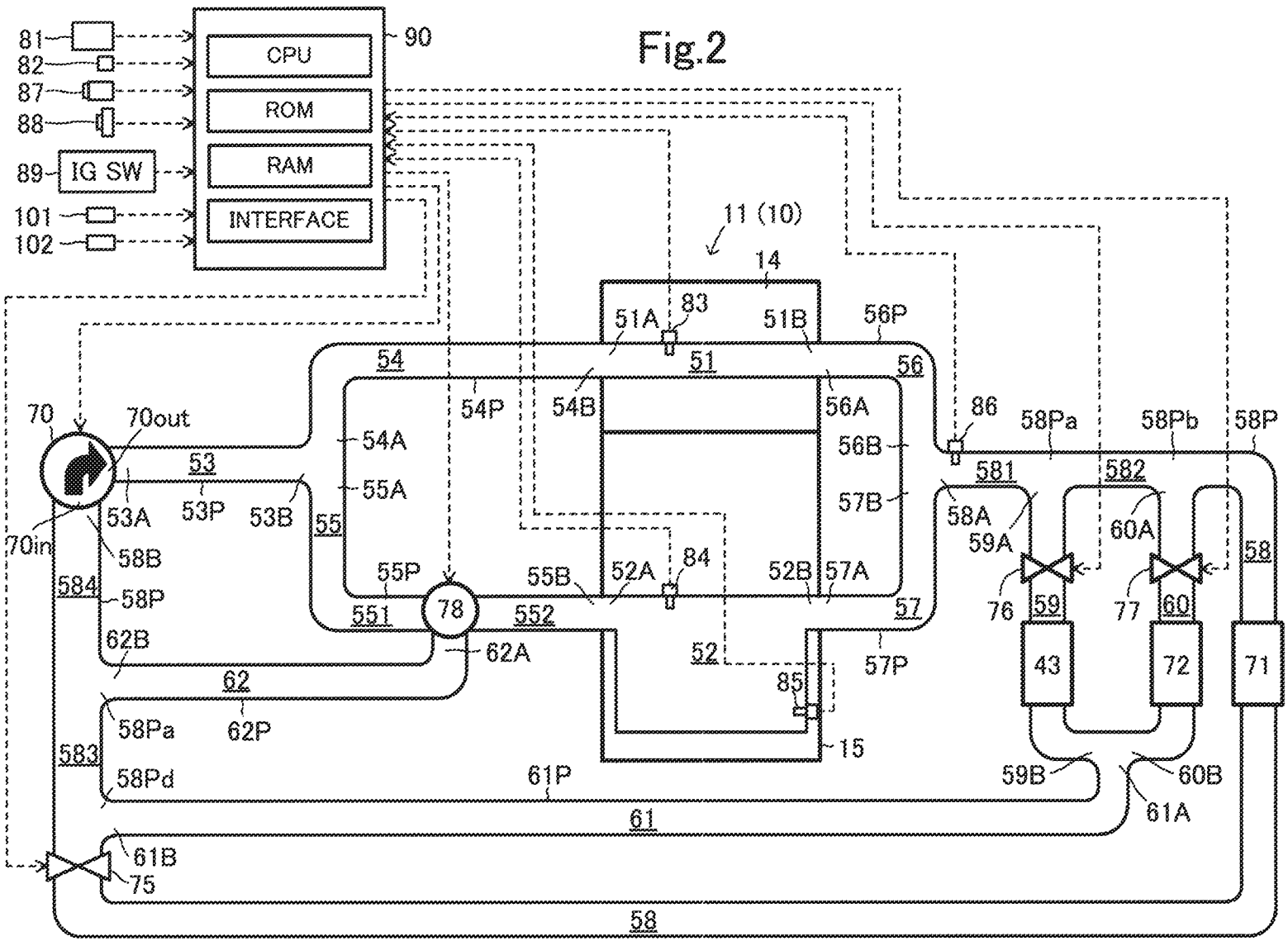
FIG. 2 is a view for showing the cooling apparatus according to the embodiment.

As shown in FIG. 2, a water passage 51 is formed in the cylinder head 14 in a known matter. The cooling water for cooling the cylinder head 14 flows through the water passage 51. Hereinafter, the water passage 51 will be referred to as "the head water passage 51". The head water passage 51 is one of elements of the embodiment apparatus. Hereinafter, the water passage is a passage through which the cooling water flows.

A water passage 52 is formed in the cylinder block 15 in a known matter. The cooling water for cooling the cylinder block 15 flows through the water passage 52. Hereinafter, the water passage 52 will be referred to as "the block water passage 52". In particular, the block water passage 52 is formed from an area near the cylinder head 14 to an area remote from the cylinder head 14 along cylinder bores defining the cylinders 12, thereby cooling the cylinder bores. The block water passage 52 is one of the elements of the embodiment apparatus.

The embodiment apparatus includes a pump 70. The pump 70 has a suctioning opening 70*in* and a discharging opening 70*out*. The cooling water is suctioned into the pump 70 through the suctioning opening 70*in*. The suctioned cooling water is discharged from the pump through the discharging opening 70*out*. Hereinafter, the suctioning opening 70*in* will be referred to as "the pump suctioning opening 70*in*", and the discharging opening 70*out* will be referred to as "the pump discharging opening 70*out*".

A cooling water pipe 53P defines a water passage 53. The cooling water pipe 53P is connected to the pump discharging opening 70*out* at a first end 53A thereof. Therefore, the cooling water discharged via the pump discharging opening 70*out* flows into the water passage 53.

A cooling water pipe 54P defines a water passage 54. A cooling water pipe 55P defines a water passage 55. A first end 54A of the cooling water pipe 54P and a first end 55A of the cooling water pipe 55P are connected to a second end 53B of the cooling water pipe 53P.

A second end 54B of the cooling water pipe 54P is connected to the cylinder head 14 such that the water passage 54 communicates with a first end 51A of the head water passage 51. A second end 55B of the cooling water pipe 55P is connected to the cylinder block 15 such that the water passage 55 communicates with a first end 52A of the block water passage 52.

A cooling water pipe 56P defines a water passage 56. A first end 56A of the cooling water pipe 56P is connected to the cylinder head 14 such that the water passage 56 communicates with a second end 51B of the head water passage 51.

A cooling water pipe 57P defines a water passage 57. A first end 57A of the cooling water pipe 57P is connected to the cylinder block 15 such that the water passage 57 communicates with a second end 52B of the block water passage 52.

A cooling water pipe 58P defines a water passage 58. A first end 58A of the cooling water pipe 58P is connected to a second end 56B of the cooling water pipe 56P and a second end 57B of the cooling water pipe 57P. A second end 58B of the cooling water pipe 58P is connected to the pump suctioning opening 70*in*. The cooling water pipe 58P is provided such that the cooling water pipe 58P passes through a radiator 71. Hereinafter, the water passage 58 will be referred to as "the radiator water passage 58".

The radiator 71 exchanges the heat between the cooling water passing through the radiator 71 and an outside air, thereby lowering the temperature of the cooling water.

A shut-off valve 75 is provided in the cooling water pipe 58P between the radiator 71 and the pump 70. When the shut-off valve 75 is set to an opening position, the shut-off valve 75 permits the cooling water to flow through the radiator water passage 58. On the other hand, when the shut-off valve 75 is set to a closed position, the shut-off valve 75 shuts off a flow of the cooling water through the radiator water passage 58.

A cooling water pipe 59P defines a water passage 59. A first end 59A of the cooling water pipe 59P is connected to a first portion 58Pa of the cooling water pipe 58P between the first end 58A of the cooling water pipe 58P and the radiator 71. The cooling water pipe 59P is provided such that the cooling water pipe 59P passes through the EGR cooler 43. Hereinafter, the water passage 59 will be referred to as "the EGR cooler water passage 59".

A shut-off valve 76 is provided in the cooling water pipe 59P between the EGR cooler 43 and the first end 59A of the cooling water pipe 59P. When the shut-off valve 76 is set to an opening position, the shut-off valve 76 permits the cooling water to flow through the EGR cooler water passage 59. On the other hand, when the shut-off valve 76 is set to a closed position, the shut-off valve 76 shuts off a flow of the cooling water through the EGR cooler water passage 59.

A cooling water pipe 60P defines a water passage 60. A first end 60A of the cooling water pipe 60P is connected to a second portion 58Pb of the cooling water pipe 58P between the first portion 58Pa of the cooling water pipe 58P and the radiator 71. The cooling water pipe 60P is provided such that the cooling water pipe 60P passes through the heater core 72. Hereinafter, the water passage 60 will be referred to as "the heater core water passage 60".

Hereinafter, a portion 581 of the radiator water passage 58 between the first end 58A of the cooling water pipe 58P and the first portion 58Pa of the cooling water pipe 58P will be referred to as "the first portion 581 of the radiator water passage 58". Further, a portion 582 of the radiator water passage 58 between the first portion 58Pa of the cooling water pipe 58P and the second portion 58Pb of the cooling water pipe 58P will be referred to as "the second portion 582 of the radiator water passage 58".

When the temperature of the cooling water passing through the heater core 72 is higher than a temperature of the heater core 72, the heater core 72 is warmed by the cooling water, thereby storing the heat. Therefore, the heater core 72 is a heat exchanger for exchanging the heat with the cooling water, in particular, a heat exchanger for removing the heat from the cooling water. The heat stored in the heater core 72 is used for warming an interior of a vehicle having the engine 10.

A shut-off valve 77 is provided in the cooling water pipe 60P between the heater core 72 and the first end 60A of the cooling water pipe 60P. When the shut-off valve 77 is set to an opening position, the shut-off valve 77 permits the cooling water to flow through the heater core water passage 60. On the other hand, when the shut-off valve 77 is set to a closed position, the shut-off valve 77 shuts off a flow of the cooling water through the heater core water passage 60.

A cooling water pipe 61P defines a water passage 61. A first end 61A of the cooling water pipe 61P is connected to a second end 59B of the cooling water pipe 59P and a second end 60B of the cooling water pipe 60P. A second end 61B of the cooling water pipe 61P is connected to a third portion 58Pc of the cooling water pipe 58P between the shut-off valve 75 and the pump suctioning opening 70*in*.

A cooling water pipe 62P defines a water passage 62. A first end 62A of the cooling water pipe 62P is connected to a switching valve 78 provided in the cooling water pipe 55P. A second end 62B of the cooling water pipe 62P is connected to a fourth portion 58Pd of the cooling water pipe 58P between the third portion 58Pc of the cooling water pipe 58P and the pump suctioning opening 70*in*.

Hereinafter, a portion 551 of the water passage 55 between the switching valve 78 and the first end 55A of the cooling water pipe 55P will be referred to as "the first portion 551 of the water passage 55". Further, a portion 552 of the water passage 55 between the switching valve 78 and the second end 55B of the cooling water pipe 55P will be referred to as "the second portion 552 of the water passage 55". Further, a portion 583 of the radiator water passage 58 between the third portion 58Pc of the cooling water pipe 58P and the fourth portion 58Pd of the cooling water pipe 58P will be referred to as "the third portion 583 of the water passage 58". Further, a portion 584 of the radiator water passage 58 between the fourth portion 58Pd of the cooling water pipe 58P and the pump suctioning opening 70*in* will be referred to as "the fourth portion 584 of the water passage 58".

When the switching valve 78 is set to a first position, the switching valve 78 permits the cooling water to flow between the first portion 551 of the water passage 55 and the second portion 552 of the water passage 55 and shuts off a flow of the cooling water between the first portion 551 of the water passage 55 and the water passage 62 and a flow of the cooling water between the second portion 552 of the water passage 55 and the water passage 62. Hereinafter, the first position of the switching valve 78 will be referred to as "the normal flow position".

When the switching valve 78 is set to a second position, the switching valve 78 permits the cooling water to flow between the second portion 552 of the water passage 55 and the water passage 62 and shuts off the flow of the cooling water between the first portion 551 of the water passage 55 and the water passage 62 and a flow of the cooling water between the first and second portions 551 and 552 of the water passage 55. Hereinafter, the second position of the switching valve 78 will be referred to as "the opposite flow position".

When the switching valve 78 is set to a third position, the switching valve 78 shuts off the flow of the cooling water between the first and second portions 551 and 552 of the water passage 55, the flow of the cooling water between the first portion 551 of the water passage 55 and the water passage 62, and the flow of the cooling water between the second portion 552 of the water passage 55 and the water passage 62. Hereinafter, the third position of the switching valve 78 will be referred to as "the shut-off position".

The head water passage 51 is a first water passage formed in the cylinder head 14. The block water passage 52 is a second water passage formed in the cylinder block 15. The water passages 53 and 54 define a third water passage for connecting the first end 51A corresponding to one end of the head water passage 51 (i.e., the first water passage) to the pump discharging opening 70*out*.

The water passages 53, 55, and 62, the fourth portion 584 of the radiator water passage 58, and the switching valve 78 configure a connection switching mechanism for switching a pump connection between a normal connection of the first end 52A of the block water passage 52 to the pump discharging opening 70*out* and an opposite connection of the first end 52A of the block water passage 52 to the pump suctioning opening 70*in*. The pump connection is a connection of the first end 52A corresponding to one end of the block water passage 52, i.e., the second water passage to the pump 70.

The water passages 56 and 57 define a fourth water passage for connecting the second end 51B corresponding to the other end of the head water passage 51, i.e., the first water passage to the second end 52B corresponding to the other end of the block water passage 52, i.e., the second water passage.

The radiator water passage 58 is a fifth water passage for connecting the water passages 56 and 57 (i.e., the fourth water passage) to the pump suctioning opening 70*in*. The shut-off valve 75 is a shut-off valve for shutting off and opening the radiator water passage 58 (i.e., the fifth water passage).

The EGR cooler water passage 59 or the heater core water passage 60 is a sixth water passage for connecting the water passages 56 and 57 (i.e., the fourth water passage) to the pump suctioning opening 70*in*. The shut-off valves 76 and 77 are valves for shutting off and opening the EGR cooler water passage 59 and the heater core water passage 60 (i.e., the sixth water passage), respectively.

The water passages 53 and 55 define a normal connection water passage for connecting the first end 52A of the block water passage 52 (i.e., the second water passage) to the pump discharging opening 70*out*. The second portion 552 of the water passage 55, the water passage 62, and the fourth portion 584 of the radiator water passage 58 define an opposite connection water passage for connecting the first end 52A of the block water passage 52 (i.e., the second water passage) to the pump suctioning opening 70*in*.

The switching valve 78 is a switching part selectively set to any of the normal flow position for connecting the first end 52A of the block water passage 52 (i.e., the second water passage) to the pump discharging opening 70*out* via the water passages 53 and 55 (i.e., the normal connection water passage) and the opposite flow position for connecting the first end 52A of the block water passage 52 (i.e., the second water passage) to the pump suctioning opening 70*in* via the second portion 552 of the water passage 55, the water passage 62, and the fourth portion 584 of the radiator water passage 58 (i.e., the opposite connection water passage).

In other words, the switching valve 78 is a switching part for switching the water passage between the normal and opposite connection water passages. As described above, the normal connection water passage is defined by the water passages 53 and 55 for connecting the first end 52A of the block water passage 52 (i.e., the second water passage) to the pump discharging opening 70*out*. The opposite connection water passage is defined by the second portion 552 of the water passage 55, the water passage 62, and the fourth portion 584 of the radiator water passage 58 for connecting the first end 52A of the block water passage 52 (i.e., the second water passage) to the pump suctioning opening 70*in*.

The embodiment apparatus has the ECU 90. The ECU 90 is an electronic control circuit. The ECU 90 includes a micro-computer as a main component part. The micro-computer includes a CPU, a ROM, a RAM, an interface and the like. The CPU executes instructions or routines stored in a memory such as the ROM, thereby realizing various functions described later.

As shown in FIGS. 1 and 2, the ECU 90 is connected to an air-flow meter 81, a crank angle sensor 82, water temperature sensors 83 to 86, an outside air temperature sensor 87, a heater switch 88, and an ignition switch 89.

The air-flow meter 81 is provided in the intake pipe 22 upstream of the compressor 24*a*. The air-flow meter 81 measures a mass flow rate Ga of an air passing therethrough and sends a signal for expressing the mass flow rate Ga to the ECU 90. Hereinafter, the mass flow rate Ga will be referred to as "the intake air amount Ga". The ECU 90 acquires the intake air amount Ga on the basis of the signal sent from the air-flow meter 81. In addition, the ECU 90 acquires a total amount ΣGa on the basis of the intake air amount Ga. The total amount ΣGa corresponds to an amount of the air suctioned into the cylinders 12*a* to 12*d* after the ignition switch 89 is set to an ON position. Hereinafter, the total amount ΣGa will be referred to as "the after-engine-start integrated air amount ΣGa".

The crank angle sensor 82 is provided on the engine body 11 adjacent to a crank shaft (not shown) of the engine 10. The crank angle sensor 82 outputs a pulse signal each time the crank shaft rotates by a constant angle (in this embodiment, 10°). The ECU 90 acquires a crank angle (i.e., an absolute crank angle) of the engine 10 on the basis of the pulse signals and signals sent from a cam position sensor (not shown). The absolute crank angle at a compression top dead center of predetermined one of the cylinders 12, is set to zero. In addition, the ECU 90 acquires an engine speed NE on the basis of the pulse signals sent from the crank angle sensor 82.

The water temperature sensor 83 is provided in the cylinder head 14 such that the water temperature sensor 83 detects a temperature TWhd of the cooling water in the head water passage 51. The water temperature sensor 83 detects the temperature TWhd and sends a signal expressing the temperature TWhd to the ECU 90. Hereinafter, the temperature TWhd will be referred to as "the head water temperature TWhd". The ECU 90 acquires the head water temperature TWhd on the basis of the signal sent from the water temperature sensor 83.

The water temperature sensor 84 is provided in the cylinder block 15 such that the water temperature sensor 84 detects a temperature TWbr_up of the cooling water in the block water passage 52 near the cylinder head 14. The water temperature sensor 84 detects the temperature TWbr_up and sends a signal expressing the temperature TWbr_up to the ECU 90. Hereinafter, the temperature TWbr_up will be referred to as "the upper block water temperature TWbr_up". The ECU 90 acquires the upper block water temperature TWbr_up on the basis of the signal sent from the water temperature sensor 84.

The water temperature sensor 85 is provided in the cylinder block 15 such that the water temperature sensor 85 detects a temperature TWbr_low of the cooling water in the block water passage 52 remote from the cylinder head 14. The water temperature sensor 85 detects the temperature TWbr_low and sends a signal expressing the temperature TWbr_low to the ECU 90. Hereinafter, the temperature TWbr_low will be referred to as "the lower block water temperature TWbr_low". The ECU 90 acquires the lower block water temperature TWbr_low on the basis of the signal sent from the water temperature sensor 85. The ECU 90 acquires a difference ΔTWbr of the lower block water temperature TWbr_low with respect to the upper block water temperature TWbr_up (ΔTWbr=TWbr_up−TWbr_low). Hereinafter, the difference ΔTWbr will be referred to as "the block water temperature difference ΔTWbr".

The water temperature sensor 86 is provided in a portion of the cooling water pipe 58P defining the first portion 581 of the radiator water passage 58. The water temperature sensor 86 detects a temperature TWeng of the cooling water in the first portion 581 of the radiator water passage 58 and sends a signal expressing the temperature TWeng to the ECU 90. Hereinafter, the temperature TWeng will be referred to as "the engine water temperature TWeng". The ECU 90 acquires the engine water temperature TWeng on the basis of the signal sent from the water temperature sensor 86.

The outside air temperature sensor 87 detects a temperature Ta of the outside air and sends a signal expressing the temperature Ta. Hereinafter, the temperature Ta will be referred to as "the outside air temperature Ta". The ECU 90 acquires the outside air temperature Ta on the basis of the signal sent from the outside air temperature sensor 87.

The heater switch 88 is operated by a driver of the vehicle having the engine 10. When the heater switch 88 is set to an ON position by the driver, the ECU 90 causes the heater core 72 to discharge the heat stored to the interior of the vehicle. On the other hand, when the heater switch 88 is set to an OFF position by the driver, the ECU 90 causes the heater core 72 to stop discharging the heat to the interior of the vehicle.

The ignition switch 89 is operated by the driver of the vehicle. When the driver sets the ignition switch 89 to an ON position, the operation of the engine 10 is permitted to start. On the other hand, when the driver sets the ignition switch 89 to an OFF position, the operation of the engine 10 is stopped. Hereinafter, an operation of setting the ignition switch 89 to the ON position by the driver will be referred to as "the ignition ON operation". Further, an operation of setting the ignition switch 89 to the OFF position by the driver will be referred to as "the ignition OFF operation". Further, the operation of the engine 10 will be referred to as "the engine operation".

Further, the ECU 90 is connected to the throttle valve actuator 27, the EGR control valve 42, the pump 70, the shut-off valves 75 to 77, and the switching valve 78.

The ECU 90 sets a target value of the opening degree of the throttle valve 26, depending on an engine operation state and controls the activation of the throttle valve actuator 27 such that the opening degree of the throttle valve 26 corresponds to the target value. The engine operation state is defined by an engine load KL and the engine speed NE.

The ECU 90 sets a target value EGRtgt of the opening degree of the EGR control valve 42, depending on the engine operation state and controls the activation of the EGR control valve 42 such that the opening degree of the EGR control valve 42 corresponds to the target value EGRtgt. Hereinafter, the target value EGRtgt will be referred to as "the target EGR control valve opening degree EGRtgt".

Figure 3:
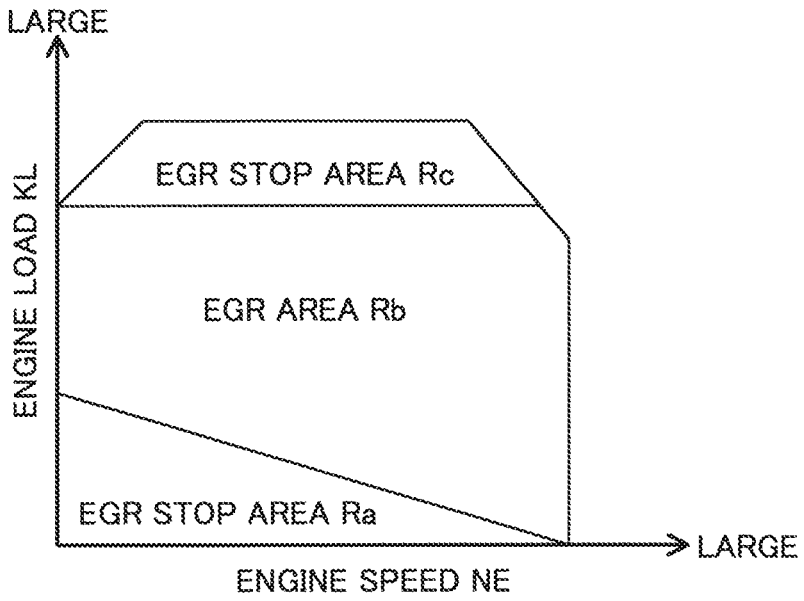
FIG. 3 is a view for showing a map used for controlling an EGR control valve shown in FIG. 1.

The ECU 90 stores a map shown in FIG. 3. When the engine operation state is in an EGR stop area Ra or Rc shown in FIG. 3, the ECU 90 sets the target EGR control valve opening degree EGRtgt to zero. In this case, no EGR gas is supplied to the cylinders 12.

On the other hand, when the engine operation state is in an EGR area Rb shown in FIG. 3, the ECU 90 sets the target EGR control valve opening degree EGRtgt to a value larger than zero, depending on the engine operation state. In this case, the EGR gas is supplied to the cylinders 12.

As described later, the ECU 90 controls activations of the pump 70, the shut-off valves 75 to 77, and the switching valve 78, depending on a temperature Teng of the engine 10. Hereinafter, the temperature Teng will be referred to as "the engine temperature Teng".

The ECU 90 is connected to an acceleration pedal operation amount sensor 101 and a vehicle speed sensor 102.

The acceleration pedal operation amount sensor 101 detects an operation amount AP of an acceleration pedal (not shown) and sends a signal expressing the operation amount AP to the ECU 90. Hereinafter, the operation amount AP will be referred to as "the acceleration pedal operation amount AP". The ECU 90 acquires the acceleration pedal operation amount AP on the basis of the signal sent from the acceleration pedal operation amount sensor 101.

The vehicle speed sensor 102 detects a moving speed V of the vehicle having the engine 10 and sends a signal expressing the moving speed V. Hereinafter, the moving speed V will be referred to as "the vehicle speed V". The ECU 90 acquires the vehicle speed V on the basis of the signal sent from the vehicle speed sensor 102.

<Summary of Activation of Embodiment Apparatus>

Next, a summary of an activation of the embodiment apparatus will be described. The embodiment apparatus executes any of activation controls A to D, and F to O described later, depending on a warmed state of the engine 10, presence or absence of an EGR cooler water supply request described later, and presence or absence of a heater core water supply request described later. Hereinafter, the warmed state of the engine 10 will be simply referred to as the warmed state".

A method for determining the warmed state will be described. When an after-engine-start cycle number Cig is equal to or smaller than a predetermined after-engine-start cycle number Cig_th, the embodiment apparatus determines which one of a cool state, a first semi-warmed state, a second semi-warmed state, and a completely-warmed state, the warmed state is, on the basis of the engine water temperature TWeng correlating with the engine temperature Teng as described later. Hereinafter, the cool state, the first semi-warmed state, the second semi-warmed state, and the completely-warmed state will be collectively referred to as "the cool state and the like". The after-engine-start cycle Cig is the number of cycles counted after the engine operation starts. In this embodiment, the predetermined after-engine-start cycle number Cig_th is two to three cycles which corresponds to eight to twelve combustion strokes of the engine 10.

The cool state is a state that the engine temperature Teng is estimated to be lower than a predetermined threshold temperature Teng1. Hereinafter, the predetermined threshold temperature Teng1 will be referred to as "the first engine temperature Teng1".

The first semi-warmed state is a state that the engine temperature Teng is estimated to be equal to or higher than the first engine temperature Teng1 and to be lower than a predetermined threshold temperature Teng2. Hereinafter, the predetermined threshold temperature Teng2 will be referred to as "the second engine temperature Teng2". The second engine temperature Teng2 is set to a temperature higher than the first engine temperature Teng1.

The second semi-warmed state is a state that the engine temperature Teng is estimated to be equal to or larger than the second engine temperature Teng2 and lower than a predetermined threshold temperature Teng3. Hereinafter, the predetermined threshold temperature Teng3 will be referred to as "the third engine temperature Teng3". The third engine temperature Teng3 is set to a temperature higher than the second engine temperature Teng2.

The completely-warmed state is a state that the engine temperature Teng is estimated to be equal to or larger than the third engine temperature Teng3.

The embodiment apparatus determines that the warmed state is the cool state when the engine water temperature TWeng is lower than a predetermined threshold water temperature TWeng1. Hereinafter, the predetermined threshold water temperature TWeng1 will be referred to as "the first engine water temperature TWeng1".

The embodiment apparatus determines that the warmed state is the first semi-warmed state when the engine water temperature TWeng is equal to or higher than the first engine water temperature TWeng1 and lower than a predetermined threshold water temperature TWeng2. Hereinafter, the predetermined threshold water temperature TWeng2 will be referred to as "the second engine water temperature TWeng2". The second engine water temperature TWeng2 is set to a temperature higher than the first engine water temperature TWeng1.

The embodiment apparatus determines that the warmed state is the second semi-warmed state when the engine water temperature TWeng is equal to or higher than the second engine water temperature TWeng2 and lower than a predetermined threshold water temperature TWeng3. Hereinafter, the predetermined threshold water temperature TWeng3 will be referred to as "the third engine water temperature TWeng3". The third engine water temperature TWeng3 is set to a temperature higher than the second engine water temperature TWeng2.

The embodiment apparatus determines that the warmed state is the completely-warmed state when the engine water temperature TWeng is equal to or higher than the third engine water temperature TWeng3.

On the other hand, when the after-engine-start cycle number Cig is larger than the predetermined after-engine-start cycle number Cig_th, the embodiment apparatus determines which one of the cool state and the like, the warmed state is on the basis of at least four of the upper block water temperature TWbr_up, the head water temperature TWhd, the block water temperature difference ΔTWbr, the after-engine-start integrated air amount ΣGa, and the engine water temperature TWeng which correlate with the engine temperature Teng.

<Cool Condition>

In particular, the embodiment apparatus determines that the warmed state is the cool state when at least one of conditions C1 to C4 described below is satisfied.

The condition C1 is a condition that the upper block water temperature TWbr_up is equal to or lower than a predetermined threshold water temperature TWbr_up1. Hereinafter, the predetermined threshold water temperature TWbr_up1 will be referred to as "the first upper block water temperature TWbr_up1". The upper block water temperature TWbr_up is a parameter correlating with the engine temperature Teng. Therefore, the embodiment apparatus can determine which one of the cool state and the like, the warmed state is on the basis of the upper block water temperature TWbr_up with the appropriately-set first upper block water temperature TWbr_up1 and appropriately-set water temperature thresholds described later.

The condition C2 is a condition that the head water temperature TWhd is equal to or lower than a predetermined threshold water temperature TWhd1. Hereinafter, the predetermined threshold water temperature TWhd1 will be referred to as "the first head water temperature TWhd1". The head water temperature TWhd is the parameter correlating with the engine temperature Teng. Therefore, the embodiment apparatus can determine which one of the cool state and the like, the warmed state is on the basis of the head water temperature TWhd with the appropriately-set first head water temperature TWhd1 and appropriately-set water temperature thresholds described later.

The condition C3 is a condition that the after-engine-start integrated air amount ΣGa is equal to or smaller than a predetermined threshold air amount ΣGa1. Hereinafter, the predetermined threshold air amount ΣGa1 will be referred to as "the first air amount ΣGa1". As described above, the after-engine-start integrated air amount Ga is the amount of the air suctioned into the cylinders 12*a* to 12*d* after the ignition switch 89 is set to the ON position. When a total amount of the air suctioned into the cylinders 12*a* to 12*d* increases, a total amount of the fuel supplied to the cylinders 12*a* to 12*d* from the fuel injectors 13 increases. As a result, a total amount of heat generated in the cylinders 12*a* to 12*d* increases. Thus, before the after-engine-start integrated air amount ΣGa reaches a certain amount, the engine temperature Teng increases as the after-engine-start integrated air amount ΣGa increases. Therefore, the after-engine-start integrated air amount ΣGa is a parameter correlating with the engine temperature Teng. Therefore, the embodiment apparatus can determine which one of the cool state and the like, the warmed state is on the basis of the after-engine-start integrated air amount ΣGa with the appropriately-set first air amount ΣGa1 and appropriately-set air amount thresholds described later.

The condition C4 is a condition that the engine water temperature TWeng is equal to or lower than a predetermined threshold water temperature TWeng4. Hereinafter, the predetermined threshold water temperature TWeng4 will be referred to as "the fourth engine water temperature TWeng4". The engine water temperature TWeng is the parameter correlating with the engine temperature Teng. Therefore, the embodiment apparatus can determine which one of the cool state and the like, the warmed state is on the basis of the engine water temperature TWeng with the appropriately-set fourth engine water temperature TWeng4 and appropriately-set water temperature thresholds described later.

The embodiment apparatus may be configured to determine that the warmed state is the cool state when at least two or three or all of the conditions C1 to C4 are satisfied.

<First Semi-Warmed Condition>

The embodiment apparatus determines that the warmed state is the first semi-warmed state when at least one of conditions C5 to C9 described below is satisfied.

The condition C5 is a condition that the upper block water temperature TWbr_up is higher than the first upper block water temperature TWbr_up1 and equal to or lower than a predetermined threshold water temperature TWbr_up2. Hereinafter, the predetermined threshold water temperature TWbr_up2 will be referred to as "the second upper block water temperature TWbr_up2". The second upper block water temperature TWbr_up2 is set to a temperature higher than the first upper block water temperature TWbr_up1.

The condition C6 is a condition that the head water temperature TWhd is higher than the first head water temperature TWhd1 and equal to or lower than a predetermined threshold water temperature TWhd2. Hereinafter, the predetermined threshold water temperature TWhd2 will be referred to as "the second head water temperature TWhd2". The second head water temperature TWhd2 is set to a temperature higher than the first head water temperature TWhd1.

The condition C7 is a condition that the block water temperature difference ΔTWbr is larger than a predetermined threshold ΔTWbrth. As described above, the block water temperature difference ΔTWbr is the difference between the upper and lower block water temperatures TWbr_up and TWbr_low (ΔTWbr=TWbr_up−TWbr_low). In the cool state immediately after the engine 10 starts by the ignition switch ON operation, the block water temperature difference ΔTWbr is not much large. In the first semi-warmed state, the block water temperature difference ΔTWbr increases temporarily while the engine temperature Teng increases. Then, in the second semi-warned state, the block water temperature difference ΔTWbr decreases. Thus, the block water temperature difference ΔTWbr is a parameter correlating with the engine temperature Teng, in particular, when the warmed state is the first semi-warmed state. Therefore, the embodiment apparatus can determine whether the warmed state is the first semi-warmed state on the basis of the block water temperature difference ΔTWbr with the appropriately-set predetermined threshold ΔTWbrth.

The condition C8 is a condition that the after-engine-start integrated air amount ΣGa is larger than the first air amount ΣGa1 and equal to or smaller than a predetermined threshold air amount ΣGa2. Hereinafter, the predetermined threshold air amount ΣGa2 will be referred to as "the second air amount ΣGa2". The second air amount ΣGa2 is set to a value larger than the first air amount ΣGa1.

The condition C9 is a condition that the engine water temperature TWeng is higher than the engine water temperature TWeng4 and equal to or lower than a predetermined threshold water temperature TWeng5. Hereinafter, the predetermined threshold water temperature TWeng5 will be referred to as "the fifth engine water temperature TWeng5". The fifth engine water temperature TWeng5 is set to a temperature higher than the fourth engine water temperature TWeng4.

The embodiment apparatus may be configured to determine that the warmed state is the first semi-warmed state when at least two or three or four or all of the conditions C5 to C9 are satisfied.

<Second Semi-Warmed Condition>

The embodiment apparatus determines that the warmed state is the second semi-warmed state when at least one of conditions C10 to C13 described below is satisfied.

The condition C10 is a condition that the upper block water temperature TWbr_up is higher than the second upper block water temperature TWbr_up2 and equal to or lower than a predetermined threshold water temperature TWbr_up3. Hereinafter, the predetermined threshold water temperature TWbr_up3 will be referred to as "the third upper block water temperature TWbr_up3". The third upper block water temperature TWbr_up3 is set to a temperature higher than the second upper block water temperature TWbr_up2.

The condition C11 is a condition that the head water temperature TWhd is higher than the second head water temperature TWhd2 and equal to or lower than a predetermined threshold water temperature TWhd3. Hereinafter, the predetermined threshold water temperature TWhd3 will be referred to as "the third head water temperature TWhd3". The third head water temperature TWhd3 is set to a temperature higher than the second head water temperature TWhd2.

The condition C12 is a condition that the after-engine-start integrated air amount ΣGa is larger than the second air amount ΣGa2 and equal to or smaller than a predetermined threshold air amount ΣGa3. Hereinafter, the predetermined threshold air amount ΣGa3 will be referred to as "the third air amount ΣGa3". The third air amount ΣGa3 is set to a value larger than the second air amount ΣGa2.

The condition C13 is a condition that the engine water temperature TWeng is higher than the engine water temperature TWeng 5 and equal to or lower than a predetermined threshold water temperature TWeng6. Hereinafter, the predetermined threshold water temperature TWeng6 will be referred to as "the sixth engine water temperature TWeng6". The sixth engine water temperature TWeng6 is set to a temperature higher than the fifth engine water temperature TWeng5.

The embodiment apparatus may be configured to determine that the warmed state is the second semi-warmed state when at least two or three or all of the conditions C10 to C13 are satisfied.

<Complete Warmed Condition>

The embodiment apparatus determines that the warmed state is the completely-warmed state when at least one of conditions C14 to C17 described below is satisfied.

The condition C14 is a condition that the upper block water temperature TWbr_up is higher than the third upper block water temperature TWbr_up3.

The condition C15 is a condition that the head water temperature TWhd is higher than the third upper block water temperature TWhd3.

The condition C16 is a condition that the after-engine-start integrated air amount ΣGa is larger than the third air amount ΣGa3.

The condition C17 is a condition that the engine water temperature TWeng is higher than the engine water temperature TWeng 6.

The embodiment apparatus may be configured to determine that the warmed state is the completely-warmed state when at least two or three or all of the conditions C14 to C17 is satisfied.

<EGR Cooler Water Supply Request>

As described above, when the engine operation state is in the EGR area Rb shown in FIG. 3, the EGR gas is supplied to the cylinders 12. When the EGR gas is supplied to the cylinders 12, it is preferred to supply the cooling water to the EGR cooler water passage 59, thereby cooling the EGR gas by the cooling water at the EGR cooler 43.

In this regard, when the EGR gas is cooled by the cooling water having a too low temperature at the EGR cooler 43, water in the EGR gas may be condensed in the exhaust gas recirculation pipe 41. The condensed water may corrode the exhaust gas recirculation pipe 41. Therefore, when the temperature of the cooling water is too low, it is preferred not to supply the cooling water to the EGR cooler water passage 59.

The embodiment apparatus determines that a supply of the cooling water to the EGR cooler water passage 59 is requested when the engine operation state is in the EGR area Rb, and the engine water temperature TWeng is higher than a predetermined threshold water temperature TWeng7 (in this embodiment, 60° C.). Hereinafter, a request of the supply of the cooling water to the EGR cooler water passage 59 will be referred to as "the EGR cooler water supply request". Further, the predetermined threshold water temperature TWeng7 will be referred to as "the seventh engine water temperature TWeng7".

Further, even though the engine water temperature TWeng is equal to or lower than the seventh engine water temperature TWeng7, the engine temperature Teng is expected to increase immediately when the engine load KL is relatively large. As a result, the engine water temperature TWeng is expected to become higher than the seventh engine water temperature TWeng7 immediately. Therefore, when the cooling water is supplied to the EGR cooler water passage 59, an amount of the condensed water generated, is small, and the exhaust gas recirculation pipe 41 is unlikely to be corroded.

Accordingly, even though the engine operation state is in the EGR area Rb, and the engine water temperature TWeng is equal to or lower than the seventh engine water temperature TWeng7, the embodiment apparatus determines that the EGR cooler water supply is requested when the engine load KL is equal to or larger than a predetermined threshold engine load KLth. Therefore, the embodiment apparatus determines that the EGR cooler water supply is not requested when the engine load KL is smaller than the threshold engine load KLth while the engine operation state is in the EGR area Rb, and the engine water temperature TWeng is equal to or lower than the seventh engine water temperature TWeng7.

On the other hand, when the engine operation state is in the EGR stop area Ra or Rc shown in FIG. 3, no EGR gas is supplied to the cylinders 12. Thus, the cooling water does not need to be supplied to the EGR cooler water passage 59. Accordingly, the embodiment apparatus determines that the EGR cooler water supply is not requested when the engine operation state is in the EGR stop area Ra or Rc shown in FIG. 3.

<Heater Core Water Supply Request>

The heater core 72 removes the heat of the cooling water flowing through the heater core water passage 60 to decrease the temperature of the cooling water. As a result, the complete warming of the engine 10 is delayed. In this regard, when the outside air temperature Ta is relatively low, the temperature of the interior of the vehicle is also relatively low. Therefore, the persons including the driver in the vehicle (hereinafter, will be referred to as the driver and the like) is likely to request a warming of the interior of the vehicle. Thus, even though the warming of the engine 10 is delayed due to the outside air temperature Ta being relatively low, it is preferred to flow the cooling water through the heater core water passage 60 to increase the amount of the heat stored in the heater core 72 in preparation for a request of the warming of the interior of the vehicle.

Accordingly, when the outside air temperature Ta is relatively low, the embodiment apparatus determines that a supply of the cooling water to the heater core water passage 60 is requested, independently of a set state of the heater switch 88 even though the engine temperature Teng is relatively low. A request of the supply of the cooling water to the heater core water passage 60 is the heater core water supply request described above. In this regard, when the engine temperature Teng is greatly low, the embodiment apparatus determines that the supply of the cooling water to the heater core water passage 60 is not requested. Hereinafter, the supply of the cooling water to the heater core water passage 60 will be referred to as "the heater core water supply".

In particular, the embodiment apparatus determines that the heater core water supply is requested when the engine water temperature TWeng is higher than a predetermined threshold water temperature TWeng8 while the outside air temperature Ta is equal to or lower than a predetermined threshold temperature Tath. Hereinafter, the predetermined threshold water temperature TWeng8 will be referred to as "the eighth engine water temperature TWeng8", and the predetermined threshold temperature Tath will be referred to as "the threshold temperature Tath". In this embodiment, the eighth engine water temperature TWeng8 is, for example, 10° C.

On the other hand, when the engine water temperature TWeng is equal to or lower than the eighth engine water temperature TWeng8 while the outside air temperature Ta is equal to or lower than the threshold temperature Tath, the embodiment apparatus determines that the heater core water supply is not requested.

When the outside air temperature Ta is relatively high, the temperature of the interior of the vehicle is also relatively high. Thus, the driver and the like may not request the warming of the interior of the vehicle. Therefore, it is sufficient to flow the cooling water through the heater core water passage 60 to warm the heater core 72 only when the engine temperature Teng is relatively high, and the heater switch 88 is set to the ON position while the outside air temperature Ta is relatively high.

Accordingly, the embodiment apparatus determines that the heater core water supply is requested when the engine temperature Teng is relatively high, and the heater switch 88 is set to the ON position while the outside air temperature Ta is relatively high. On the other hand, when the engine temperature Teng is relatively low or the heater switch 88 is set to the OFF position while the outside air temperature Ta is relatively high, the embodiment apparatus determines that the heater core water supply is not requested.

In particular, the embodiment apparatus determines that the heater core water supply is requested when the heater switch 88 is set to the ON position, and the engine water temperature TWeng is higher than a predetermined threshold water temperature TWeng9 while the outside air temperature Ta is higher than the threshold temperature Tath. Hereinafter, the predetermined threshold water temperature TWeng9 will be referred to as "the ninth engine water temperature TWeng9". The ninth engine water temperature TWeng9 is set to a value higher than the eighth engine water temperature TWeng8. In this embodiment, the ninth engine water temperature TWeng9 is, for example, 30° C.

On the other hand, when the heater switch 88 is set to the OFF position or the engine water temperature TWeng is equal to or lower than the ninth engine water temperature TWeng9 while the outside air temperature Ta is higher than the threshold temperature Tath, the embodiment apparatus determines that the heater core water supply is not requested.

Next, activation controls of the pump 70, the shut-off valves 75 to 77, and the switching valve 78 executed by the embodiment apparatus will be described. Hereinafter, the pump 70, the shut-off valves 75 to 77, and the switching valve 78 will be collectively referred to as "the pump 70 and the like". As shown in FIG. 4, the embodiment apparatus executes any of the activation controls A to D, and F to O, depending on the warmed state, the presence or absence of the EGR cooler water supply request, and the presence or absence of the heater core water supply request.

<Cool State Control>

First, a cool state control corresponding to the activation control of the pump 70 and the like will be described. The cool state control is executed when the embodiment apparatus determines that the warmed state is the cool state.

<Activation Control A>

When the cooling water is supplied to the head and block water passages 51 and 52, the cylinder head 14 and the cylinder block 15 are at least cooled. Therefore, it is preferred not to supply the cooling water to the head and block water passages 51 and 52 when the warmed state is the cool state. In this case, it is requested to increase the temperature of the cylinder head 14 and the temperature of the cylinder block 15. In addition, when the EGR cooler water supply and the heater core water supply are not requested, it is not necessary to supply the cooling water to the EGR cooler water passage 59 and the heater core water passage 60. Hereinafter, the temperature of the cylinder head 14 will be referred to as "the head temperature Thd", and the temperature of the cylinder block 15 will be referred to as "the block temperature Tbr".

Accordingly, when the EGR cooler water supply and the heater core water supply are not requested while the warmed state is the cool state, the embodiment apparatus executes the activation control A. According to the activation control A, when the activation of the pump 70 is stopped, the embodiment apparatus continues to stop the activation of the pump 70. When the pump 70 has been activated, the embodiment apparatus stops the activation of the pump 70. In this case, the shut-off valves 75 to 77 may be set to any of the open and closed positions, and the switching valve 78 may be set to any of the normal, opposite, and shut-off positions.

Thereby, no cooling water is supplied to the head and block water passages 51 and 52. Therefore, the increasing rate of the head and block temperatures Thd and Tbr is large compared with when the cooling water cooled by the radiator 71 is supplied to the head and block water passages 51 and 52.

<Activation Control B>

When the EGR cooler water supply is requested, and the heater core water supply is not requested while the warmed state is the cool state, the cooling water should be supplied to the EGR cooler 43. Accordingly, the embodiment apparatus executes the activation control B. According to the activation control B, the embodiment apparatus activates the pump 70, sets the shut-off valves 75 and 77 to the closed positions, respectively, sets the shut-off valve 76 to the open position, and sets the switching valve 78 to the shut-off position. When the embodiment apparatus executes the activation control B, the cooling water circulates as shown by arrows in FIG. 5.

According to the activation control B, the cooling water is discharged to the water passage 53 via the pump discharging opening 70*out* and then, flows into the head water passage 51 via the water passage 54. The cooling water flows through the head water passage 51 and then, flows into the EGR cooler water passage 59 through the water passage 56 and the radiator water passage 58. The cooling water flows through the EGR cooler 43 and then, flows through the water passage 61, the third portion 583 of the radiator water passage 58, and the fourth portion 584 of the radiator water passage 58. Then, the cooling water is suctioned into the pump 70 via the pump suctioning opening 70*in*.

Thereby, no cooling water is supplied to the block water passage 52. On the other hand, the cooling water which is not cooled by the radiator 71 is supplied to the head water passage 51. Therefore, the increasing rates of the head and block temperatures Thd and Tbr are large compared with when the cooling water which is cooled by the radiator 71, is supplied to the head and block water passages 51 and 52.

In addition, the cooling water is supplied to the EGR cooler water passage 59. Thus, the EGR cooler water supply is accomplished in response to the EGR cooler water supply request.

<Activation Control C>

When the heater core water supply is requested, and the EGR cooler water supply is not requested while the warmed state is the cool state, the cooling water should be supplied to the heater core 72. Accordingly, when the heater core water supply is requested, and the EGR cooler water supply is not requested while the warmed state is the cool state, the embodiment apparatus executes the activation control C. According to the activation control C, the embodiment apparatus activates the pump 70, sets the shut-off valves 75 and 76 to the closed positions, respectively, sets the shut-off valve 77 to the open position, and sets the switching valve 78 to the shut-off position. When the embodiment apparatus executes the activation control C, the cooling water circulates as shown by arrows in FIG. 6.

According to the activation control C, the cooling water is discharged to the water passage 53 via the pump discharging opening 70*out* and then, flows into the head water passage 51 via the water passage 54. The cooling water flows through the head water passage 51 and then, flows into the heater core water passage 60 via the water passage 56 and the radiator water passage 58. The cooling water flows through the heater core 72 and then, sequentially flows through the water passage 61, the third portion 583 of the radiator water passage 58, and the fourth portion 584 of the radiator water passage 58. Then, the cooling water is suctioned into the pump 70 via the pump suctioning opening 70*in*.

Thereby, similar to the activation control B, no cooling water is supplied to the block water passage 52, and the cooling water which is not cooled by the radiator 71, is supplied to the head water passage 51. Therefore, similar to the activation control B, the head and block temperatures Thd and Tbr increase at the large rate.

In addition, the cooling water is supplied to the heater core water passage 60. Thus, the heater core water supply is accomplished in response to the heater core supply request.

<Activation Control D>

When the EGR cooler water supply and the heater core water supply are requested while the warmed state is the cool state, the embodiment apparatus executes the activation control D. According to the activation control D, the embodiment apparatus activates the pump 70, sets the shut-off valve 75 to the closed position, sets the shut-off valves 76 and 77 to the open positions, respectively, and sets the switching valve 78 to the shut-off position. When the embodiment apparatus executes the activation control D, the cooling water circulates as shown by arrows in FIG. 7.

According to the activation control D, the cooling water is discharged to the water passage 53 via the pump discharging opening 70*out* and then, flows into the head water passage 51 via the water passage 54. The cooling water flows through the head water passage 51 and then, flows into the EGR cooler water passage 59 and the heater core water passage 60 via the water passage 56 and the radiator water passage 58.

The cooling water flowing into the EGR cooler water passage 59 flows through the EGR cooler 43 and then, sequentially flows through the water passage 61, the third portion 583 of the radiator water passage 58, and the fourth portion 584 of the radiator water passage 58. Then, the cooling water is suctioned into the pump 70 via the pump suctioning opening 70*in*. On the other hand, the cooling water flowing into the heater core water passage 60 flows through the heater core 72 and then, sequentially flows through the water passage 61, the third portion 583 of the radiator water passage 58, and the fourth portion 584 of the radiator water passage 58. Then, the cooling water is suctioned into the pump 70 via the pump suctioning opening 70*in*.

Thereby, effects similar to effects achieved by the activation controls B and C, are achieved.

<First Semi-Warmed State Control>

Next, a first semi-warmed state control corresponding to the activation control of the pump 70 and the like will be described. The first semi-warmed state control is executed when the embodiment apparatus determines that the warmed state is the first semi-warmed state.

<Activation Control F>

When the warmed state is the first semi-warmed state, it is requested to increase the block temperature Tbr at the large rate. When the EGR cooler water supply and the heater core water supply are not requested while the warmed state is the first semi-warmed state, the embodiment apparatus should execute the activation control A only for the purpose of accomplishing a request of increasing the block temperature Tbr at the large rate, similar to when the warmed state is the cool state.

In this regard, when the warmed state is the first semi-warmed state, the head and block temperatures Thd and Tbr are high compared with when the warmed state is the cool state. Therefore, if the embodiment apparatus executes the activation control A, the cooling water stays in the head and block water passages 51 and 52. As a result, the temperature of parts of the cooling water staying in the head and block water passages 51 and 52 may increase to a greatly high temperature. Thus, the cooling water staying in the head and block water passages 51 and 52 may boil.

Figure 8:
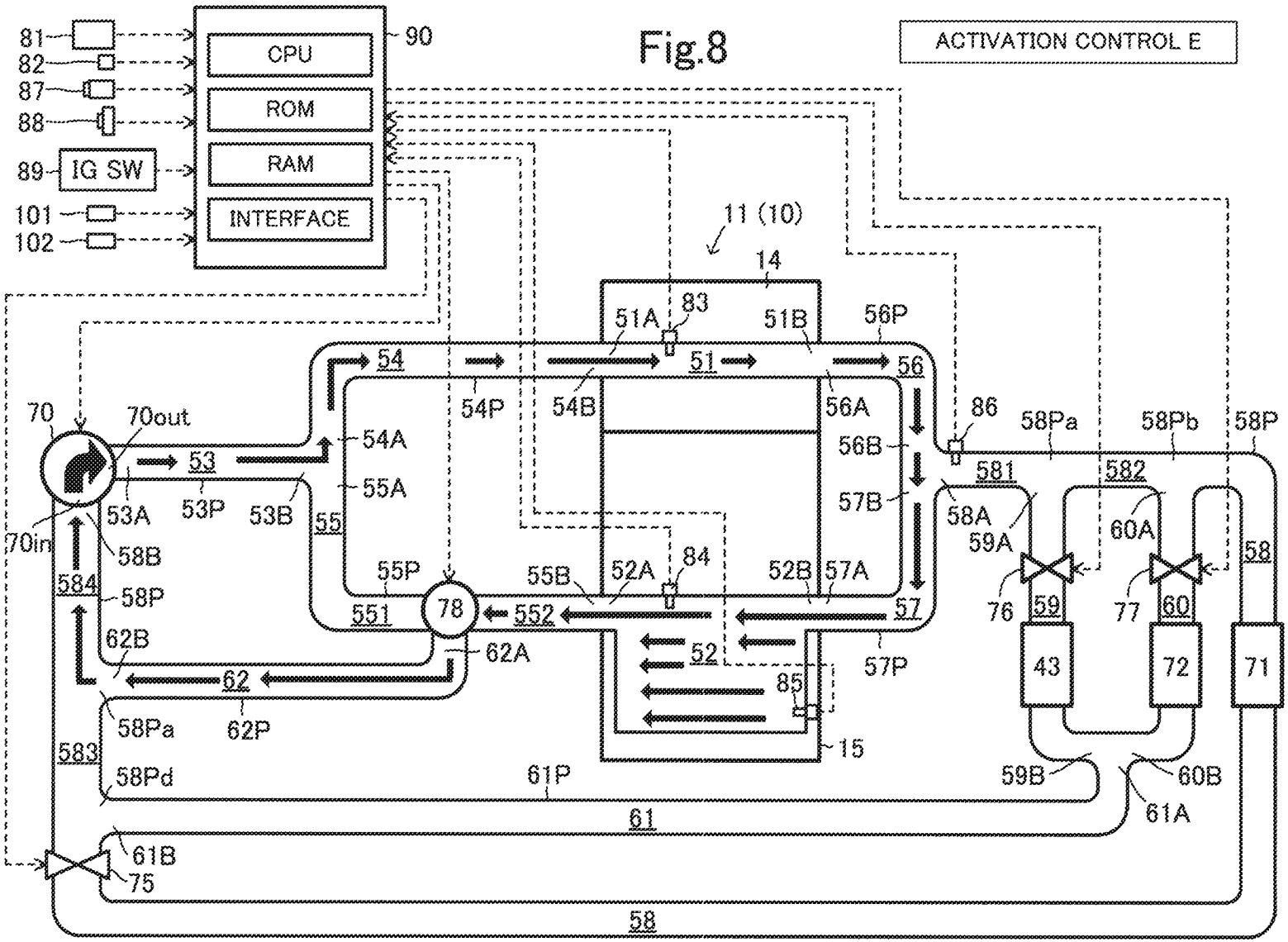
FIG. 8 is a view similar to FIG. 2 and which shows the flow of the cooling water when the cooling apparatus according to the embodiment executes an activation control E.

If the embodiment apparatus executes the activation control E to activate the pump 70, set the shut-off valves 75 to 77 to the closed position, respectively, and sets the switching valve 78 to the opposite flow position for the purpose of causing the cooling water to circulate as shown by arrows in FIG. 8 when the warmed state is the first-semi warmed state, and the EGR cooler water supply and the heater core water supply are not requested, the block temperature Tbr increases at a relatively large rate while the cooling water is prevented from boiling in the head and block water passages 51 and 52.

In particular, when the activation control E is executed, the cooling water is discharged to the water passage 53 via the pump discharging opening 70*out* and then, flows into the head water passage 51 via the water passage 54. The cooling water flows through the head water passage 51 and then, flows into the block water passage 52 through the water passages 56 and 57. The cooling water flows through the block water passage 52 and then, flows through the second portion 552 of the block water passage 52, the water passage 62, and the fourth portion 584 of the radiator water passage 58. Then, the cooling water is suctioned into the pump 70 via the pump suctioning opening 70*in*.

Thereby, the cooling water is supplied from the head water passage 51 directly to the block water passage 52 without flowing through any of the radiator 71, the EGR cooler 43, and the heater core 72. In this case, the temperature of the cooling water supplied to the block water passage 52, increases since the temperature of the cooling water increases while the cooling water flows through the head water passage 51. Thus, the increasing rate of the block temperature Tbr is large compared with when the cooling water is supplied to the block water passage 52 through any of the radiator 71, the EGR cooler 43, and the heater core 72. Hereinafter, the radiator 71, the EGR cooler 43, and the heater core 72 will be collectively referred to as "the radiator 71 and the like".

In addition, the cooling water flows through the head and block water passages 51 and 52. Thus, the temperature of the cooling water is prevented from increasing to the greatly high temperature in the head and block water passages 51 and 52. As a result, the cooling water is prevented from boiling in the head and block water passages 51 and 52.

In this regard, when the activation control E is executed, a head cooling water flow rate is equal to a block cooling water flow rate. The head cooling water flow rate is a flow rate of the cooling water supplied to the head water passage 51. The block cooling water flow rate is a flow rate of the cooling water supplied to the block water passage 52.

When the cooling water is supplied to the head and block water passages 51 and 52, the cylinder head 14 and the cylinder block 15 are cooled. In this regard, a head-received heat amount is larger than a block-received heat amount. The head-received heat amount is an amount of heat received by the cylinder head 14 from the cylinders 12*a* to 12*d*. The block-received heat amount is an amount of heat received by the cylinder block 15 from the cylinders 12*a* to 12*d*. In this case, the increasing rate of the head temperature Thd is larger than the increasing rate of the block temperature Tbr.

Therefore, if a pump discharging flow rate is decreased to decrease the block cooling water flow rate for the purpose of increasing the block temperature Tbr at the large rate with the head cooling water flow rate being equal to the block cooling water flow rate, the head cooling water flow rate also decreases. In this regard, the pump discharging flow rate is a flow rate of the cooling water discharged from the pump 70. In this case, the head temperature Thd increases at the further large rate to an excessively high temperature. As a result, the cooling water may boil in the head water passage 51.

On the other hand, if the pump discharging flow rate increases, thereby increasing the head cooling water flow rate for the purpose of preventing the cooling water from boiling in the head water passage 51, the block cooling water flow rate also increases. In this case, the increasing rate of the block temperature Tbr decreases.

Accordingly, the embodiment apparatus executes the activation control F when the warmed state is the first-semi warmed state, and the EGR cooler water supply and the heater core water supply are not requested. According to the activation control F, the embodiment apparatus activates the pump 70, sets the shut-off valves 75 and 77 to the closed positions, respectively, sets the shut-off valve 76 to the open position, and sets the switching valve 78 to the opposite flow position. In this case, the cooling water circulates as shown by arrows in FIG. 9. When the embodiment apparatus executes the activation control F, the embodiment apparatus sets the pump discharging flow rate to a flow rate capable of preventing the cooling water from boiling in the head water passage 51.

According to the activation control F, the cooling water is discharged to the water passage 53 via the pump discharging opening 70*out* and then, flows into the head water passage 51 via the water passage 54.

A part of the cooling water flowing into the head water passage 51, flows through the head water passage 51 and then, flows directly into the block water passage 52 via the water passages 56 and 57. The cooling water flows through the block water passage 52 and then, flows through the second portion 552 of the water passage 55, the water passage 62, and the fourth portion 584 of the radiator water passage 58. Then, the cooling water is suctioned into the pump 70 via the pump suctioning opening 70*in*.

On the other hand, the remaining of the cooling water flowing into the head water passage 51, flows through the EGR cooler water passage 59 via the water passage 56 and the radiator water passage 58. The cooling water flows through the EGR cooler 43 and then, flows through the water passage 61, the third portion 583 of the radiator water passage 58, and the fourth portion 584 of the radiator water passage 58. Then, the cooling water is suctioned into the pump 70 via the pump suctioning opening 70*in*.

Thereby, a part of the cooling water flowing through the head water passage 51, flows through the EGR cooler 43. The remaining of the cooling water flowing through the head water passage 51, flows into the block water passage 52. Therefore, the block cooling water flow rate is smaller than the head cooling water flow rate. Thus, even when the pump discharging flow rate is set to the flow rate capable of preventing the cooling water from boiling in the head water passage 51, the block temperature increases at a sufficiently large rate.

Further, the cooling water is supplied from the head water passage 51 directly to the block water passage 52 without flowing through the radiator 71. In this case, the temperature of the cooling water supplied to the block water passage 52, increases since the temperature of the cooling water increases while the cooling water flows through the head water passage 51. Thus, the increasing rate of the block temperature Tbr is large compared with when the cooling water is supplied to the block water passage 52 through the radiator 71.

Further, the cooling water is supplied to the head water passage 51 at the flow rate capable of preventing the cooling water from boiling in the head water passage 51. Thus, the cooling water is prevented from boiling in the head water passage 51.

<Activation Control F>

When the EGR cooler water supply is requested, and the heater core water supply is not requested while the warmed state is the first semi-warmed state, the embodiment apparatus executes the activation control F.

As described above, when the embodiment apparatus executes the activation control F, the block temperature Tbr increases at the large rate, compared with when the cooling water is supplied to the block water passage 52 through the radiator 71. In addition, the cooling water is prevented from boiling in the head water passage 51.

Furthermore, the cooing water is supplied to the EGR cooler water passage 59. Thus, the EGR cooler water supply is accomplished in response to the EGR cooler water supply request.

<Activation Control G>

When the heater core water supply is requested, and the EGR cooler water supply is not requested while the warmed state is the first semi-warmed state, the embodiment apparatus executes the activation control G as the first semi-warmed state control. According to the activation control G, the embodiment apparatus activates the pump 70, sets the shut-off valves 75 and 76 to the closed positions, respectively, sets the shut-off valve 77 to the open position, and sets the switching valve 78 to the opposite flow position. When the embodiment apparatus executes the activation control G, the cooling water circulates as shown by arrows in FIG. 10. When the embodiment apparatus executes the activation control G, the embodiment apparatus sets the pump discharging flow rate to the flow rate capable of preventing the cooling water from boiling in the head water passage 51.

According to the activation control G, the cooling water is discharged to the water passage 53 via the pump discharging opening 70*out* and then, flows into the head water passage 51 via the water passage 54.

A part of the cooling water flowing into the head water passage 51, flows through the head water passage 51 and then, flows into the block water passage 52 via the water passages 56 and 57. The cooling water flows through the block water passage 52 and then, flows through the second portion 552 of the water passage 55, the water passage 62, and the fourth portion 584 of the radiator water passage 58. Then, the cooling water is suctioned into the pump 70 via the pump suctioning opening 70*in*.

On the other hand, the remaining of the cooling water flowing into the head water passage 51, flows through the heater core water passage 60 via the water passage 56 and the radiator water passage 58. The cooling water flows through the heater core 72 and then, flows through the water passage 61, the third portion 583 of the radiator water passage 58, and the fourth portion 584 of the radiator water passage 58. Then, the cooling water is suctioned into the pump 70 via the pump suctioning opening 70*in*.

Thereby, a part of the cooling water flowing through the head water passage 51, flows through the heater core 72. The remaining of the cooling water flowing through the head water passage 51, flows into the block water passage 52. Therefore, the block cooling water flow rate is smaller than the head cooling water flow rate. Thus, the block temperature Tbr increases at a sufficiently large rate even when the pump discharging flow rate is set to the flow rate capable of preventing the cooling water from boiling in the head water passage 51.

Thereby, the cooling water is supplied from the head water passage 51 directly to the block water passage 52 without flowing through the radiator 71. In this case, the temperature of the cooling water supplied to the block water passage 52, increases since the temperature of the cooling water increases while the cooling water flows through the head water passage 51. Thus, similar to the activation control F, the block temperature Tbr increases at the large rate. Further, the cooling water is supplied to the head water passage 51 at the flow rate capable of preventing the cooling water from boiling in the head water passage 51. Thus, the cooling water is prevented from boiling in the head water passage 51. In addition, the cooling water is supplied to the heater core water passage 60. Thus, the heater core water supply is accomplished in response to the heater core water supply request.

<Activation Control H>

When the EGR cooler water supply and the heater core water supply are requested while the warmed state is the first semi-warmed state, the embodiment apparatus executes the activation control H. According to the activation control H, the embodiment apparatus activates the pump 70, sets the shut-off valve 75 to the closed position, sets the shut-off valves 76 and 77 to the open positions, respectively, and sets the switching valve 78 to the opposite flow position. When the embodiment apparatus executes the activation control H, the cooling water circulates as shown by arrows in FIG. 11. When the embodiment apparatus executes the activation control H, the embodiment apparatus sets the pump discharging flow rate to the flow rate capable of preventing the cooling water from boiling in the head water passage 51.

According to the activation control H, the cooling water is discharged to the water passage 53 via the pump discharging opening 70*out* and then, flows into the head water passage 51 via the water passage 54.

A part of the cooling water flowing into the head water passage 51, flows through the head water passage 51 and then, flows directly into the block water passage 52 via the water passages 56 and 57. The cooling water flows through the block water passage 52 and then, flows through the second portion 552 of the water passage 55, the water passage 62, and the fourth portion 584 of the radiator water passage 58. Then, the cooling water is suctioned into the pump 70 via the pump suctioning opening 70*in*.

On the other hand, the remaining of the cooling water flowing into the head water passage 51, flows through the EGR cooler water passage 59 and the heater core water passage 60 via the water passage 56 and the radiator water passage 58. The cooling water flowing into the EGR cooler water passage 59, flows through the EGR cooler 43 and then, flows through the water passage 61, the third portion 583 of the radiator water passage 58, and the fourth portion 584 of the radiator water passage 58. Then, the cooling water is suctioned into the pump 70 via the pump suctioning opening 70*in*. On the other hand, the cooling water flowing into the heater core water passage 60, flows through the heater core 72 and then, flows through the water passage 61, the third portion 583 of the radiator water passage 58, and the fourth portion 584 of the radiator water passage 58. Then, the cooling water is suctioned into the pump 70 via the pump suctioning opening 70*in*.

Thereby, effects similar to effects achieved by the activation controls F and G, are achieved.

<Second Semi-Warmed State Control>

Next, a second semi-warmed state control corresponding to the activation control of the pump 70 and the like will be described. The second semi-warmed state control is executed when the embodiment apparatus determines that the warmed state is the second semi-warmed state.

<Activation Control F>

When the warmed state is the second semi-warmed state, it is requested to cool the cylinder head 14, increase the block temperature Tbr, and prevent the cooling water from boiling in the head and block water passages 51 and 52, similar to when the warmed state is the first semi-warmed state.

Accordingly, the embodiment apparatus executes the activation control F (see FIG. 9) when the warmed state is the second semi-warmed state, and the EGR cooler water supply and the heater core water supply are not requested.

Therefore, effects similar to the effects achieved by the activation control F, is achieved.

<Activation Control I>

When the EGR cooler water supply is requested, and the heater core water supply is not requested while the warmed state is the second semi-warmed state, the embodiment apparatus executes the activation control I. According to the activation control I, the embodiment apparatus activates the pump 70, sets the shut-off valves 75 and 77 to the closed positions, respectively, sets the shut-off valve 76 to the open position, and sets the switching valve 78 to the normal flow position. When the embodiment apparatus executes the activation control I, the cooling water circulates as shown by arrows in FIG. 12. When the embodiment apparatus executes the activation control I, the embodiment apparatus sets the pump discharging flow rate to the flow rate capable of preventing the cooling water from boiling in the head and block water passages 51 and 52.

According to the activation control I, a part of the cooling water discharged to the water passage 53 via the pump discharging opening 70*out*, flows into the head water passage 51 via the water passage 54. The remaining of the cooling water discharged to the water passage 53 via the pump discharging opening 70*out*, flows into the block water passage 52 via the water passage 55.

The cooling water flowing into the head water passage 51, flows through the head water passage 51 and then, flows into the radiator water passage 58 via the water passage 56. The cooling water flowing into the block water passage 52, flows through the block water passage 52 and then, flows into the radiator water passage 58 via the water passage 57.

The cooling water flowing into the radiator water passage 58, flows into the EGR cooler water passage 59. The cooling water flowing into the EGR cooler water passage 59, flows through the EGR cooler 43 and then, flows through the water passage 61, the third portion 583 of the radiator water passage 58, and the fourth portion 584 of the radiator water passage 58. Then, the cooling water is suctioned into the pump 70 via the pump suctioning opening 70*in*.

Thereby, the cooling water is supplied to the block water passage 52 without flowing through the radiator 71. Therefore, the increasing rate of the block temperature Tbr is large compared with when the cooling water is supplied to the block water passage 52 through the radiator 71. In addition, the cooling water is supplied to the EGR cooler water passage 59. Thus, the EGR cooler water supply is accomplished in response to the EGR cooler water supply request.

In addition, when the warmed state is the second semi-warmed state, the block temperature Tbr is relatively high compared with when the warmed state is the first semi-warmed state. Therefore, for the purpose of preventing the cylinder block 15 from overheating, the increasing rate of the block temperature Tbr is preferably small compared with when the warmed state is the first semi-warmed state. In addition, the cooling water preferably flows through the block water passage 52 for the purpose of preventing the cooling water from boiling in the block water passage 52.

According to the activation control I, the cooling water flowing out from the head water passage 51, does not flows directly into the block water passage 52. The cooling water flowing through the EGR cooler 43, flows into the block water passage 52. Thus, the increasing rate of the block temperature Tbr is small compared with when the cooling water flowing out from the head water passage 51, flows directly into the block water passage 52, that is, when the warmed state is the first semi-warmed state. In addition, the cooling water flows through the block water passage 52. Thus, the cylinder block 15 is prevented from overheating, and the cooling water is prevented from boiling in the block water passage 52.

<Activation Control J>

When the heater core water supply is requested, and the EGR cooler water supply is not requested while the warmed state is the second semi-warmed state, the embodiment apparatus executes the activation control J. According to the activation control J, the embodiment apparatus activates the pump 70, sets the shut-off valves 75 and 77 to the closed positions, respectively, sets the shut-off valve 76 to the open position, and sets the switching valve 78 to the normal flow position. When the embodiment apparatus executes the activation control J, the cooling water circulates as shown by arrows in FIG. 13. When the embodiment apparatus executes the activation control J, the embodiment apparatus sets the pump discharging flow rate to the flow rate capable of preventing the cooling water from boiling in the head and block water passages 51 and 52.

According to the activation control J, a part of the cooling water discharged to the water passage 53 via the pump discharging opening 70*out*, flows into the head water passage 51 via the water passage 54. The remaining of the cooling water discharged to the water passage 53 via the pump discharging opening 70*out*, flows into the block water passage 52 via the water passage 55.

The cooling water flowing into the head water passage 51, flows through the head water passage 51 and then, flows into the heater core water passage 60 via the water passage 56 and the radiator water passage 58. The cooling water flowing into the block water passage 52, flows through the block water passage 52 and then, flows into the heater core water passage 60 via the water passage 57 and the radiator water passage 58.

The cooling water flowing into the heater core water passage 60, flows through the heater core 72 and then, flows through the water passage 61, the third portion 583 of the radiator water passage 58, and the fourth portion 584 of the radiator water passage 58. Then, the cooling water is suctioned into the pump 70 via the pump suctioning opening 70*in*.

Thereby, the cooling water is supplied to the block water passage 52 without flowing through the radiator 71. Therefore, similar to the activation control I, the block temperature Tbr increases at the large rate. In addition, the cooling water is supplied to the heater core water passage 60. Thus, the heater core water supply is accomplished in response to the heater core water supply request.

It should be noted that as described, regarding the activation control I, when the warmed state is the second semi-warmed state, the increasing rate of the block temperature Tbr is preferably small compared with when the warmed state is the first semi-warmed state, and the cooling water preferably flows through the block water passage 52.

According to the activation control J, similar to the activation control I, the cooling water flowing out from the head water passage 51, does not flows directly into the block water passage 52. The cooling water is supplied to the block water passage 52 through the EGR cooler 43. Thus, the increasing rate of the block temperature Tbr is small compared with when the cooling water flowing out from the head water passage 51, flows directly into the block water passage 52, that is, when the warmed state is the first semi-warmed state. In addition, the cooling water flows through the block water passage 52. Thus, the cylinder block 15 is prevented from overheating, and the cooling water is prevented from boiling in the block water passage 52.

<Activation Control K>

When the EGR cooler water supply and the heater core water supply are requested while the warmed state is the second semi-warmed state, the embodiment apparatus executes the activation control K as the second semi-warmed state control. According to the activation control K, the embodiment apparatus activates the pump 70, sets the shut-off valve 75 to the closed position, sets the shut-off valves 76 and 77 to the open positions, respectively, and sets the switching valve 78 to the normal flow position. When the embodiment apparatus executes the activation control K, the cooling water circulates as shown by arrows in FIG. 14. When the embodiment apparatus executes the activation control K, the embodiment apparatus sets the pump discharging flow rate to the flow rate capable of preventing the cooling water from boiling in the head and block water passages 51 and 52.

According to the activation control K, a part of the cooling water discharged to the water passage 53 via the pump discharging opening 70*out*, flows into the head water passage 51 via the water passage 54. The remaining of the cooling water discharged to the water passage 53 via the pump discharging opening 70*out*, flows into the block water passage 52 via the water passage 55.

The cooling water flowing into the head water passage 51, flows through the head water passage 51 and then, flows into the radiator water passage 58 via the water passage 56. The cooling water flowing into the block water passage 52, flows through the block water passage 52 and then, flows into the radiator water passage 58 via the water passage 57.

The cooling water flowing into the radiator water passage 58, flows into the EGR cooler water passage 59 and the heater core water passage 60.

The cooling water flowing into the EGR cooler water passage 59, flows through the EGR cooler 43 and then, flows through the water passage 61, the third portion 583 of the radiator water passage 58, and the fourth portion 584 of the radiator water passage 58. Then, the cooling water is suctioned into the pump 70 via the pump suctioning opening 70*in*. The cooling water flowing into the heater core water passage 60, flows through the heater core 72 and then, flows through the water passage 61, the third portion 583 of the radiator water passage 58, and the fourth portion 584 of the radiator water passage 58. Then, the cooling water is suctioned into the pump 70 via the pump suctioning opening 70*in*.

Thereby, effects similar to effects achieved by the activation controls I and J, are achieved.

<Complete Warmed State Control>

Next, a completely-warmed state control corresponding to the activation control of the pump 70 and the like will be described. The completely-warmed state control is executed when the embodiment apparatus determines that the warmed state is the completely-warmed state.

When the warmed state is the completely-warmed state, the cylinder head 14 and the cylinder block 15 should be cooled. Accordingly, the embodiment apparatus cools the cylinder head 14 and the cylinder block 15 by the cooling water cooled by the radiator 71 when the warmed state is the completely-warmed state.

<Activation Control L>

In particular, when the EGR cooler water supply and the heater core water supply are not requested while the warmed state is the completely-warmed state, the embodiment apparatus executes the activation control L as the completely-warmed state control. According to the activation control L, the embodiment apparatus activates the pump 70, sets the shut-off valves 76 and 77 to the closed positions, respectively, sets the shut-off valve 75 to the open position, and sets the switching valve 78 to the normal flow position. When the embodiment apparatus executes the activation control L, the cooling water circulates as shown by arrows in FIG. 15. When the embodiment apparatus executes the activation control L, the embodiment apparatus sets the pump discharging flow rate to the flow rate capable of cooling the cylinder head 14 and the cylinder block 15 sufficiently.

According to the activation control L, a part of the cooling water discharged to the water passage 53 via the pump discharging opening 70*out*, flows into the head water passage 51 via the water passage 54. The remaining of the cooling water discharged to the water passage 53 via the pump discharging opening 70*out*, flows into the block water passage 52 via the water passage 55.

The cooling water flowing into the head water passage 51, flows through the head water passage 51 and then, flows into the radiator water passage 58 via the water passage 56. The cooling water flowing into the block water passage 52, flows through the block water passage 52 and then, flows into the radiator water passage 58 via the water passage 57. The cooling water flowing into the radiator water passage 58, flows through the radiator 71 and then, is suctioned into the pump 70 via the pump suctioning opening 70*in*.

Thereby, the cooling water is supplied to the head and block water passages 51 and 52 through the radiator 71. Thus, the cylinder head 14 and the cylinder block 15 are cooled by the cooling water having the low temperature.

<Activation Control M>

When the EGR cooler water supply is requested, and the heater core water supply is not requested while the warmed state is the completely-warmed state, the embodiment apparatus executes the activation control M. According to the activation control M, the embodiment apparatus activates the pump 70, sets the shut-off valve 77 to the closed position, sets the shut-off valves 75 and 76 to the open positions, respectively, and sets the switching valve 78 to the normal flow position. When the embodiment apparatus executes the activation control M, the cooling water circulates as shown by arrows in FIG. 16. When the embodiment apparatus executes the activation control M, the embodiment apparatus sets the pump discharging flow rate to the flow rate capable of cooling the cylinder head 14 and the cylinder block 15 sufficiently.

According to the activation control M, a part of the cooling water discharged to the water passage 53 via the pump discharging opening 70*out*, flows into the head water passage 51 via the water passage 54. The remaining of the cooling water discharged to the water passage 53 via the pump discharging opening 70*out*, flows into the block water passage 52 via the water passage 55.

The cooling water flowing into the head water passage 51, flows through the head water passage 51 and then, flows into the radiator water passage 58 via the water passage 56. The cooling water flowing into the block water passage 52, flows through the block water passage 52 and then, flows into the radiator water passage 58 via the water passage 57.

A part of the cooling water flowing into the radiator water passage 58, flows through the radiator 71 and then, is suctioned into the pump 70 via the pump suctioning opening 70*in*.

The remaining of the cooling water flowing into the radiator water passage 58, flows into the EGR cooler water passage 59. The cooling water flowing into the EGR cooler water passage 59, flows through the EGR cooler 43 and then, flows through the water passage 61, the third portion 583 of the radiator water passage 58, and the fourth portion 584 of the radiator water passage 58. Then, the cooling water is suctioned into the pump 70 via the pump suctioning opening 70*in*.

Thereby, the cooling water is supplied to the EGR cooler water passage 59. In addition, the cooling water is supplied to the head and block water passages 51 and 52 through the radiator 71. Therefore, the cylinder head 14 and the cylinder block 15 are cooled by the cooling water having the low temperature. In addition, the EGR cooler water supply is accomplished in response to the EGR cooler water supply request.

<Activation Control N>

When the heater core water supply is requested, and the EGR cooler water supply is not requested while the warmed state is the completely-warmed state, the embodiment apparatus executes the activation control N. According to the activation control N, the embodiment apparatus activates the pump 70, sets the shut-off valve 76 to the closed position, sets the shut-off valves 75 and 76 to the open positions, respectively, and sets the switching valve 78 to the normal flow position. When the embodiment apparatus executes the activation control N, the cooling water circulates as shown by arrows in FIG. 17. When the embodiment apparatus executes the activation control N, the embodiment apparatus sets the pump discharging flow rate to the flow rate capable of cooling the cylinder head 14 and the cylinder block 15 sufficiently.

According to the activation control N, a part of the cooling water discharged to the water passage 53 via the pump discharging opening 70*out*, flows into the head water passage 51 via the water passage 54. The remaining of the cooling water discharged to the water passage 53 via the pump discharging opening 70*out*, flows into the block water passage 52 via the water passage 55.

The cooling water flowing into the head water passage 51, flows through the head water passage 51 and then, flows into the radiator water passage 58 via the water passage 56 and the radiator water passage 58. The cooling water flowing into the block water passage 52, flows through the block water passage 52 and then, flows into the radiator water passage 58 via the water passage 57.

A part of the cooling water flowing into the radiator water passage 58, flows through the radiator 71 and then, is suctioned into the pump 70 via the pump suctioning opening 70*in*.

The remaining of the cooling water flowing into the radiator water passage 58, flows into the heater core water passage 60. The cooling water flowing into the heater core water passage 60, flows through the heater core 72 and then, flows through the water passage 61, the third portion 583 of the radiator water passage 58, and the fourth portion 584 of the radiator water passage 58. Then, the cooling water is suctioned into the pump 70 via the pump suctioning opening 70*in*.

Thereby, the cooling water is supplied to the heater core water passage 60. In addition, the cooling water is supplied to the head and block water passages 51 and 52 through the radiator 71. Therefore, the cylinder head 14 and the cylinder block 15 are cooled by the cooling water having the low temperature. In addition, the heater core water supply is accomplished in response to the heater core water supply request.

<Activation Control O>

When the EGR cooler water supply and the heater core water supply are requested while the warmed state is the completely-warmed state, the embodiment apparatus executes the activation control O. According to the activation control O, the embodiment apparatus activates the pump 70, sets the shut-off valve 75 to 77 to the open positions, respectively, and sets the switching valve 78 to the normal flow position. When the embodiment apparatus executes the activation control O, the cooling water circulates as shown by arrows in FIG. 18. When the embodiment apparatus executes the activation control O, the embodiment apparatus sets the pump discharging flow rate to the flow rate capable of cooling the cylinder head 14 and the cylinder block 15 sufficiently.

According to the activation control O, a part of the cooling water discharged to the water passage 53 via the pump discharging opening 70*out*, flows into the head water passage 51 via the water passage 54. The remaining of the cooling water discharged to the water passage 53 via the pump discharging opening 70*out*, flows into the block water passage 52 via the water passage 55. The cooling water flowing into the head water passage 51, flows through the head water passage 51 and then, flows into the radiator water passage 58 via the water passage 56. The cooling water flowing into the block water passage 52, flows through the block water passage 52 and then, flows into the radiator water passage 58 via the water passage 57.

A part of the cooling water flowing into the radiator water passage 58, flows through the radiator 71 and then, is suctioned into the pump 70 via the pump suctioning opening 70*in*.

The remaining of the cooling water flowing into the radiator water passage 58, flows into the EGR cooler water passage 59 and the heater core water passage 60. The cooling water flowing into the EGR cooler water passage 59, flows through the EGR cooler 43 and then, flows through the water passage 61, the third portion 583 of the radiator water passage 58, and the fourth portion 584 of the radiator water passage 58. Then, the cooling water is suctioned into the pump 70 via the pump suctioning opening 70*in*. The cooling water flowing into the heater core water passage 60, flows through the heater core 72 and then, flows through the water passage 61, the third portion 583 of the radiator water passage 58, and the fourth portion 584 of the radiator water passage 58. Then, the cooling water is suctioned into the pump 70 via the pump suctioning opening 70*in*.

Thereby, effects similar to effects achieved by the activation controls L to N, are achieved.

As described above, according to the embodiment apparatus, the prompt increase of the head and block temperatures Thd and Tbr and the prevention of the boil of the cooling water in the head and block water passages 51 and 52 are accomplished by adding the water passage 62, the switching valve 78, and the shut-off valve 75 to the known cooling apparatus at a low manufacturing cost when the engine temperature Teng is low, in particular, when the warmed state is the first or second semi-warmed state.

<Change of Activation Control>

The embodiment apparatus needs to change the position of at least one of the shut-off valve 75 to 77 from the closed position to the open position and the position of the switching valve 78 from the opposite flow position to the normal flow position for changing the activation control from any of the activation controls F to H to any of the activation controls I to O. Hereinafter, the shut-off valve 75 to 77 will be collectively referred to as "the shut-off valve 75 and the like".

If the position of the switching valve 78 is changed from the opposite flow position to the normal flow position before the positions of the shut-off valve 75 and the like are changed from the closed position to the open position, the water passage has been shut off until the positions of the shut-off valve 75 and the like are changed after the position of the switching valve 78 is changed. Also, if the positions of the shut-off valve 75 and the like are changed from the closed positions to the open positions and simultaneously, the position of the switching valve 78 is changed from the opposite flow position to the normal flow position, the water passage is shut off instantly.

When the water passage is shut off, the pump 70 is activated even though the cooling water cannot circulate the water passages.

Accordingly, the embodiment apparatus first changes the positions of the shut-off valve 75 and the like from the closed positions to the open positions and then, changes the position of the switching valve 78 from the opposite flow position to the normal flow position for changing the activation control from any of the activation controls F to H to any of the activation controls I to O.

Thereby, a state that the pump 70 is activated even though the water passages are shut off and thus, the cooling water cannot circulate through the water passages, is prevented from occurring when the activation control is changed from any of the activation controls F to H to the activation controls I to O.

<Activation Control at Engine Operation Stop>

Next, the activation control of the pump 70 and the like when the ignition OFF operation is performed, will be described. As described above, when the ignition OFF operation is performed, the embodiment apparatus stops the engine operation. Thereafter, when the ignition on operation is performed, the embodiment apparatus causes the engine operation to start. In this regard, when the shut-off valve 75 is immobilized at the closed position, and the switching valve 78 is immobilized at the opposite flow position, that is, when the shut-off valve 75 and the switching valve 78 become immobilized during the stop of the engine operation, the cooling water cooled by the radiator 71 cannot be supplied to the head and block water passages 51 and 52 after the engine operation starts. In this case, the engine 10 may overheat after the warming of the engine 10 is completed.

Accordingly, the embodiment apparatus executes an engine operation stop timing control. According to the engine operation stop timing control, the embodiment apparatus stops the activation of the pump 70 when the ignition OFF operation is performed. If the switching valve 78 is set to the opposite flow position when the embodiment apparatus stops the activation of the pump 70, the embodiment apparatus sets the switching valve 78 to the normal flow position. In addition, if the shut-off valve 75 is set to the closed position when the embodiment apparatus stops the activation of the pump 70, the embodiment apparatus sets the shut-off valve 75 to the normal flow position. Thereby, the shut-off valve 75 and 78 is set to the open and normal flow positions, respectively during the stop of the engine operation. Therefore, even when the shut-off valve 75 and 78 become immobilized during the stop of the engine operation, the cooling water cooled by the radiator 71 is supplied to the head and block water passages 51 and 52 after the engine operation starts. Thus, the engine 10 is prevented from overheating after the warming of the engine 10 is completed.

<Concrete Operation of Embodiment Apparatus>

Next, a concrete operation of the embodiment apparatus will be described. The CPU of the ECU 90 of the embodiment apparatus is configured or programmed to execute a routine shown by a flowchart in FIG. 20 each time a predetermined time elapses.

Figure 19:
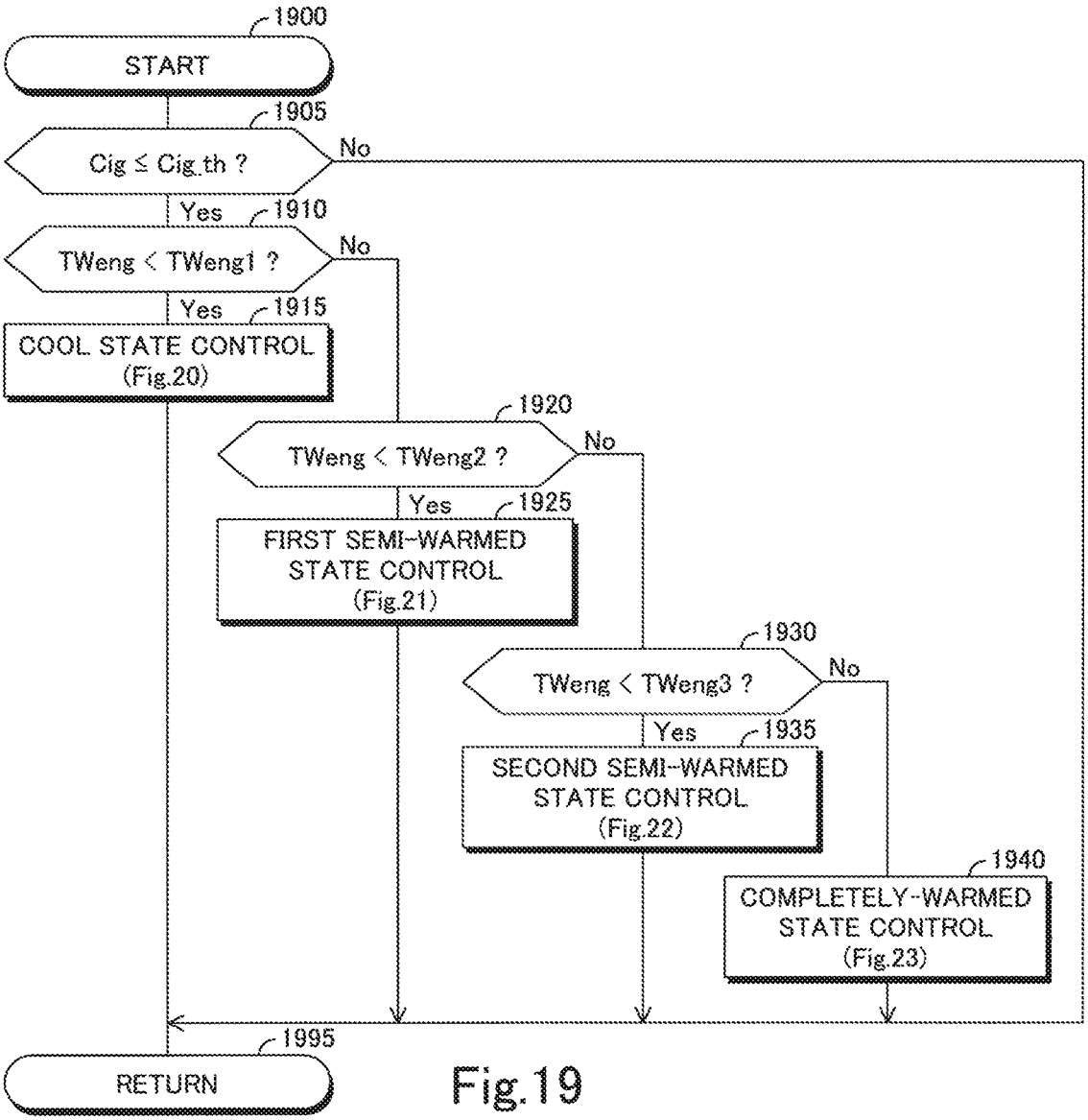
FIG. 19 is a flowchart for showing a routine executed by a CPU of an ECU shown in FIGS. 1 and 2.

Therefore, at a predetermined timing, the CPU starts a process from a step 1900 of FIG. 19 and then, proceeds with the process to a step 1905 to determine whether the after-engine-start cycle number Cig is equal to or smaller than the predetermined after-engine-start cycle number Cig_th. When the after-engine-start cycle number Cig is larger than the predetermined after-engine-start cycle number Cig_th, the CPU determines "No" at the step 1905 and then, proceeds with the process to a step 1995 to terminate this routine once.

On the other hand, when the after-engine-start cycle number Cig is equal to or smaller than the predetermined after-engine-start cycle number Cig_th, the CPU determines "Yes" at the step 1905 and then, proceeds with the process to a step 1910 to determine whether the engine water temperature TWeng is lower than the first engine water temperature TWeng1.

Figure 20:
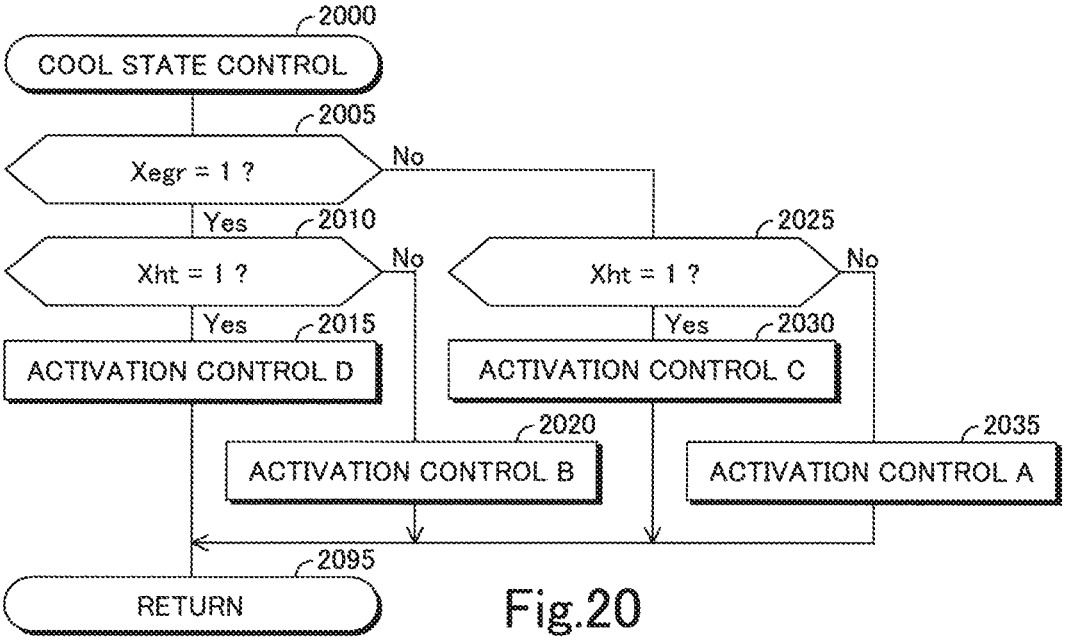
FIG. 20 is a flowchart for showing a routine executed by the CPU.

When the engine water temperature TWeng is lower than the first engine water temperature TWeng1, the CPU determines "Yes" at the step 1910 and then, proceeds with the process to the step 1915 to execute a cool state control routine shown by a flowchart in FIG. 20.

Therefore, when the CPU proceeds with the process to the step 1915, the CPU starts a process from a step 2000 of FIG. 20 and then, proceeds with the process to a step 2005 to determine whether a value of an EGR cooler water supply request flag Xegr is "1", that is, the EGR cooler water supply is requested. The value of the flag Xegr is set by a routine shown in FIG. 25 described later.

When the value of the EGR cooler water supply request flag Xegr is "1", the CPU determines "Yes" at the step 2005 and then, proceeds with the process to a step 2010 to determine whether a value of a heater core water supply request flag Xht is "1", that is, the heater core water supply is requested. The value of the flag Xht is set by a routine shown in FIG. 26 described later.

Figure 7:
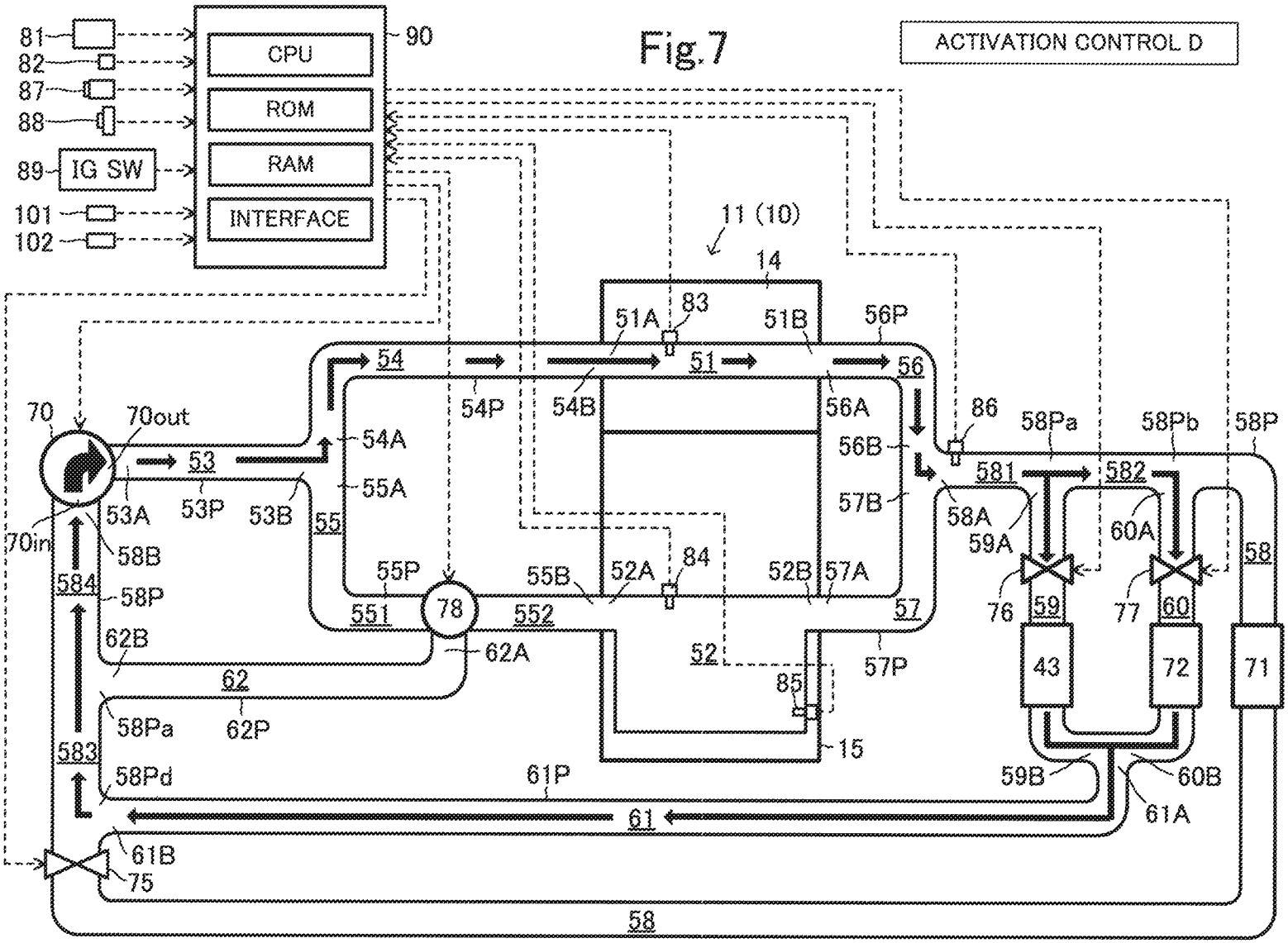
FIG. 7 is a view similar to FIG. 2 and which shows the flow of the cooling water when the cooling apparatus according to the embodiment executes an activation control D.

When the value of the heater core water supply request flag Xht is "1", the CPU determines "Yes" at the step 2010 and then, proceeds with the process to a step 2015 to execute the activation control D to control the activation of the pump 70 and the like (see FIG. 7). Then, the CPU proceeds with the process to the step 1995 of FIG. 19 via a step 2095 to terminate this routine once.

Figure 5:
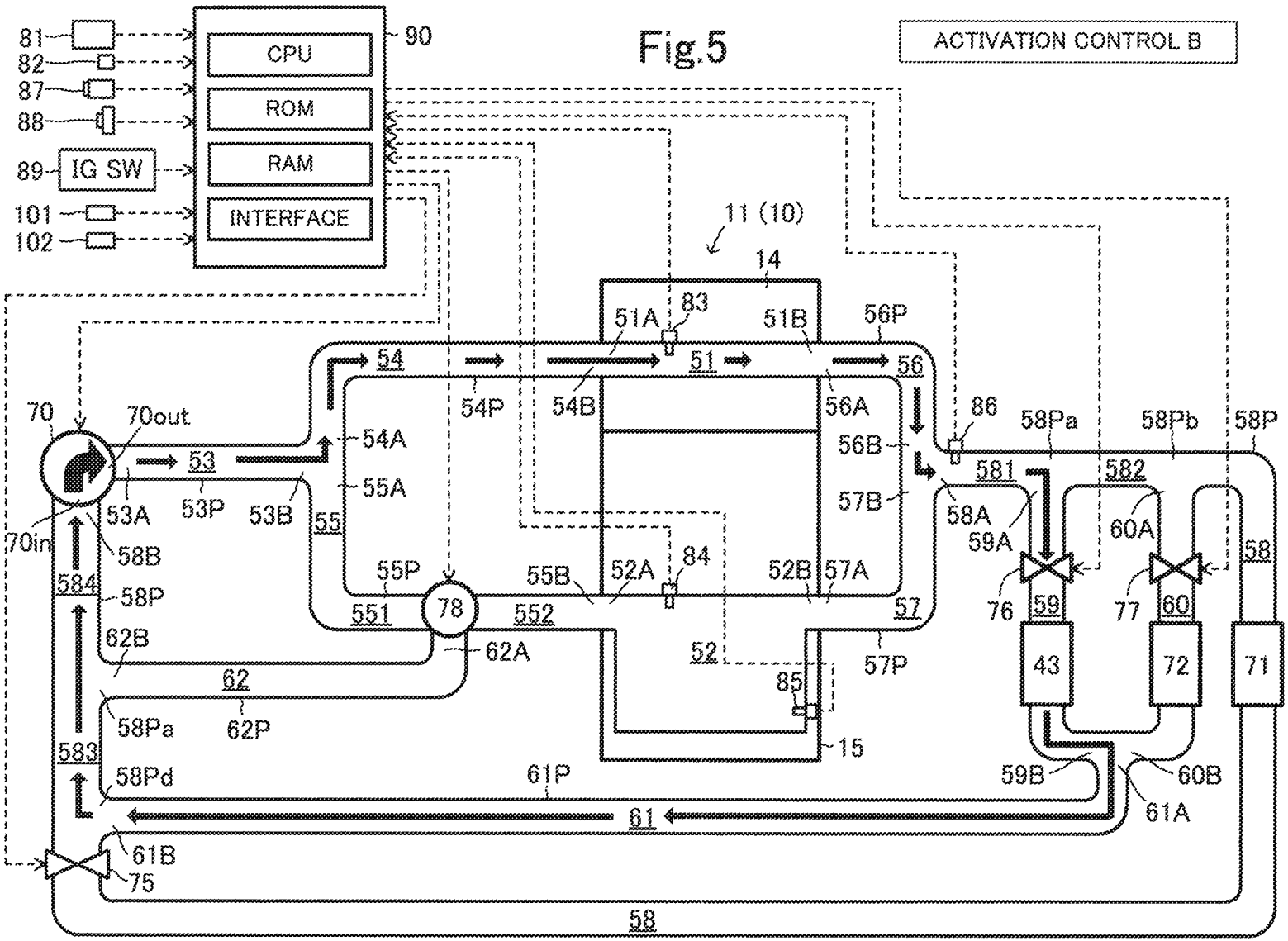
FIG. 5 is a view similar to FIG. 2 and which shows flow of cooling water when the cooling apparatus according to the embodiment executes an activation control B.

On the other hand, when the value of the heater core water supply request flag Xht is "0" at a time of the CPU executing the process of the step 2010, the CPU determines "No" at the step 2010 and then, proceeds with the process to a step 2020 to execute the activation control B to control the activation of the pump 70 and the like (see FIG. 5). Then, the CPU proceeds with the process to the step 1995 of FIG. 19 via the step 2095 to terminate this routine once.

When the value of the EGR cooler water supply request flag Xegr is "0" at a time of the CPU executing the process of the step 2005, the CPU determines "No" at the step 2005 and then, proceeds with the process to a step 2025 to determine whether the value of the heater core water supply request flag Xht is "1".

Figure 6:
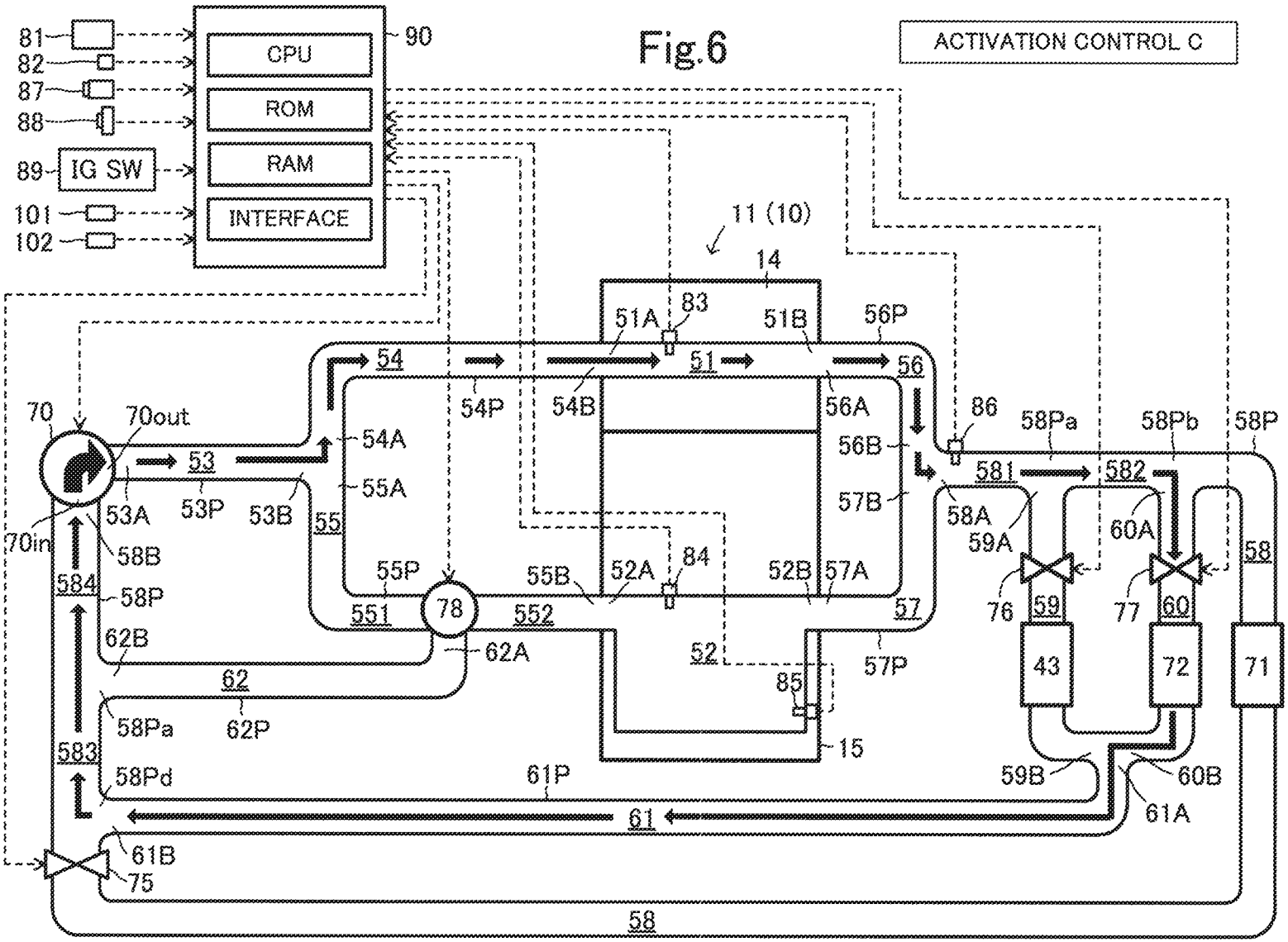
FIG. 6 is a view similar to FIG. 2 and which shows the flow of the cooling water when the cooling apparatus according to the embodiment executes an activation control C.

When the value of the heater core water supply request flag Xht is "1", the CPU determine "Yes" at the step 2025 and then, proceeds with the process to a step 2030 to execute the activation control C to control the activation of the pump 70 and the like (see FIG. 6). Then, the CPU proceeds with the process to the step 1995 of FIG. 19 via the step 2095 to terminate this routine once.

On the other hand, when the value of the heater core water supply request flag Xht is "0" at a time of the CPU executing the process of the step 2025, the CPU determines "No" at the step 2025 and then, proceeds with the process to a step 2035 to execute the activation control A to control the activation of the pump 70 and the like. Then, the CPU proceeds with the process to the step 1995 of FIG. 19 via the step 2095 to terminate this routine once.

When the engine temperature TWeng is equal to or higher than the first engine water temperature TWeng1 at a time of the CPU executing the process of the step 1910 of FIG. 19, the CPU determines "No" at the step 1910 and then, proceeds with the process to a step 1920 to determine whether the engine water temperature TWeng is lower than the second engine water temperature TWeng2.

Figure 21:
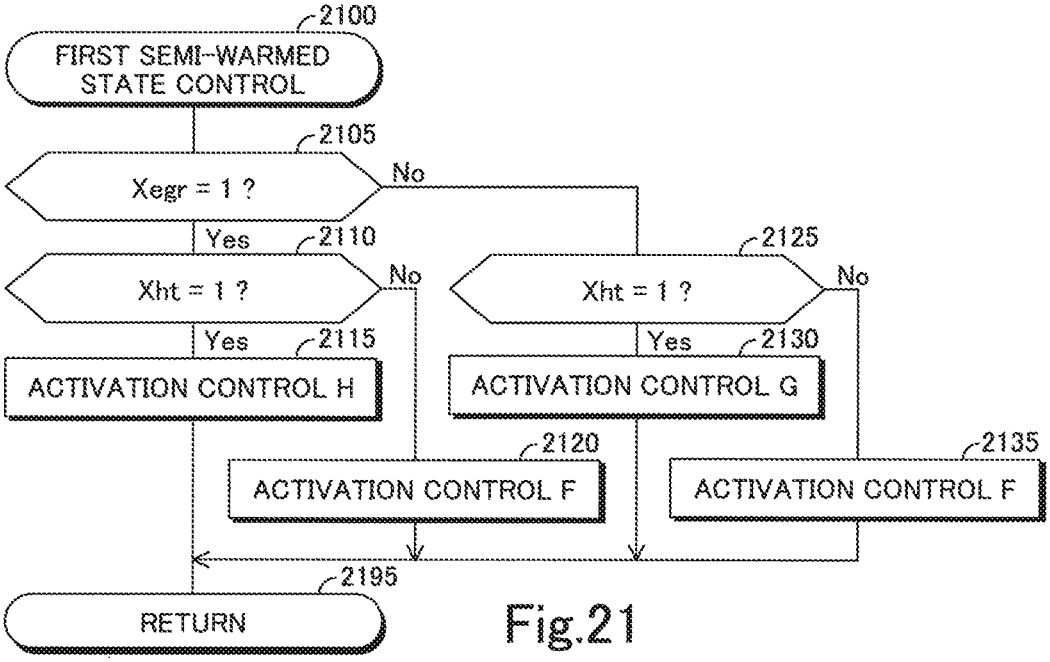
FIG. 21 is a flowchart for showing a routine executed by the CPU.

When the engine water temperature TWeng is lower than the second engine water temperature TWeng2, the CPU determines "Yes" at the step 1920 and then, proceeds with the process to a step 1925 to execute a first semi-warmed state control routine shown by a flowchart in FIG. 21.

Therefore, when the CPU proceeds with the process to the step 1925, the CPU starts a process from a step 2100 of FIG. 21 and then, proceeds with the process to a step 2105 to determine whether the value of the EGR cooler water supply request flag Xegr is "1", that is, the EGR cooler water supply is requested.

When the value of the EGR cooler water supply request flag Xegr is "1", the CPU determines "Yes" at the step 2105 and then, proceeds with the process to a step 2110 to determine whether the value of the heater core water supply request flag Xht is "1", that is, the heater core water supply is requested.

Figure 11:
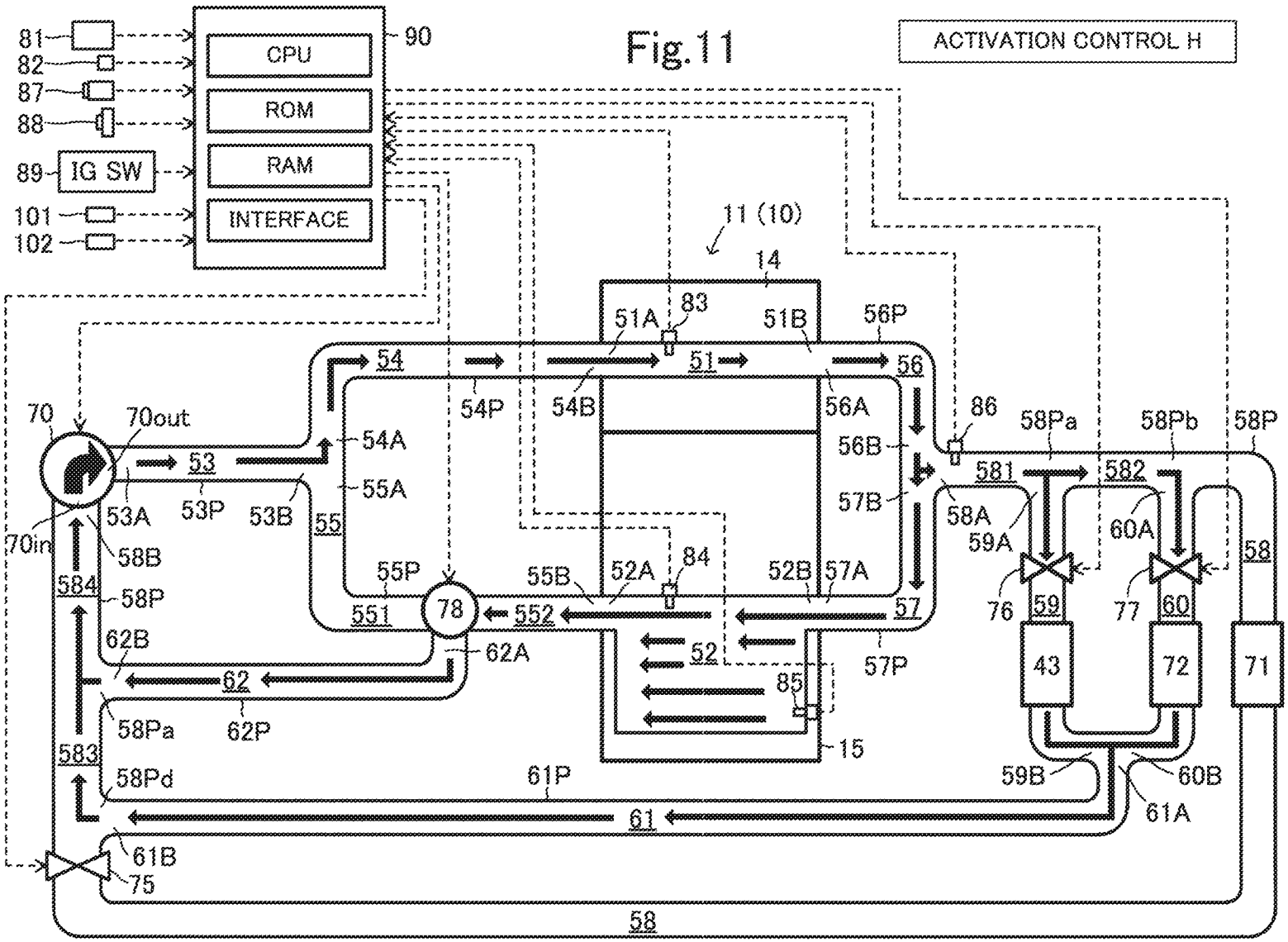
FIG. 11 is a view similar to FIG. 2 and which shows the flow of the cooling water when the cooling apparatus according to the embodiment executes an activation control H.

When the value of the heater core water supply request flag Xht is "1", the CPU determines "Yes" at the step 2110 and then, proceeds with the process to a step 2115 to execute the activation control H to control the activation of the pump 70 and the like (see FIG. 11). Then, the CPU proceeds with the process to the step 1995 of FIG. 19 via a step 2195 to terminate this routine once.

Figure 9:
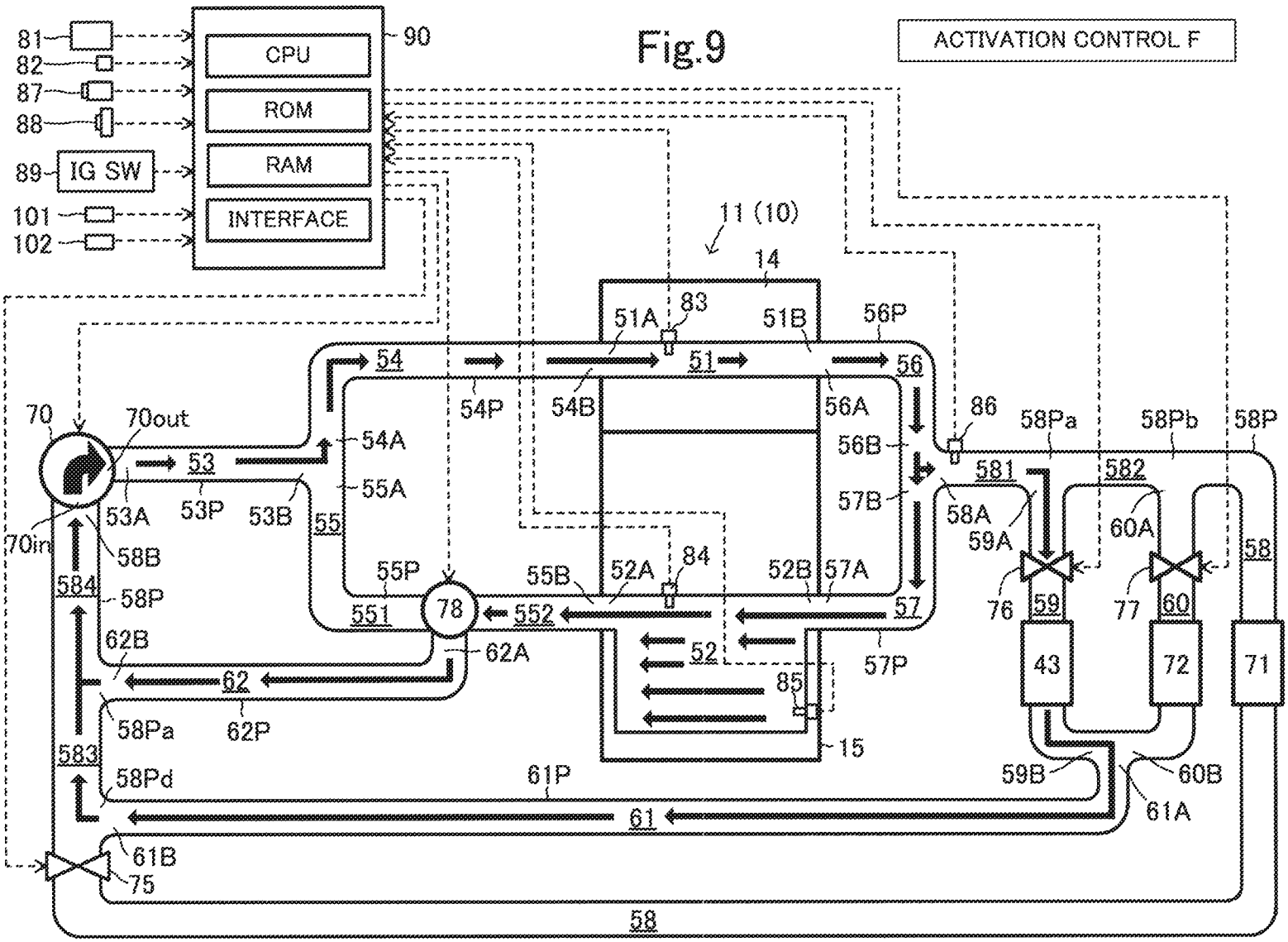
FIG. 9 is a view similar to FIG. 2 and which shows the flow of the cooling water when the cooling apparatus according to the embodiment executes an activation control F.

On the other hand, when the value of the heater core water supply request flag Xht is "0" at a time of the CPU executing the process of the step 2110, the CPU determines "No" at the step 2110 and then, proceeds with the process to a step 2120 to execute the activation control F to control the activation of the pump 70 and the like (see FIG. 9). Then, the CPU proceeds with the process to the step 1995 of FIG. 19 via the step 2195 to terminate this routine once.

When the value of the EGR cooler water supply request flag Xegr is "0" at a time of the CPU executing the process of the step 2105, the CPU determines "No" at the step 2105 and then, proceeds with the process to a step 2125 to determine whether the value of the heater core water supply request flag Xht is "1".

Figure 10:
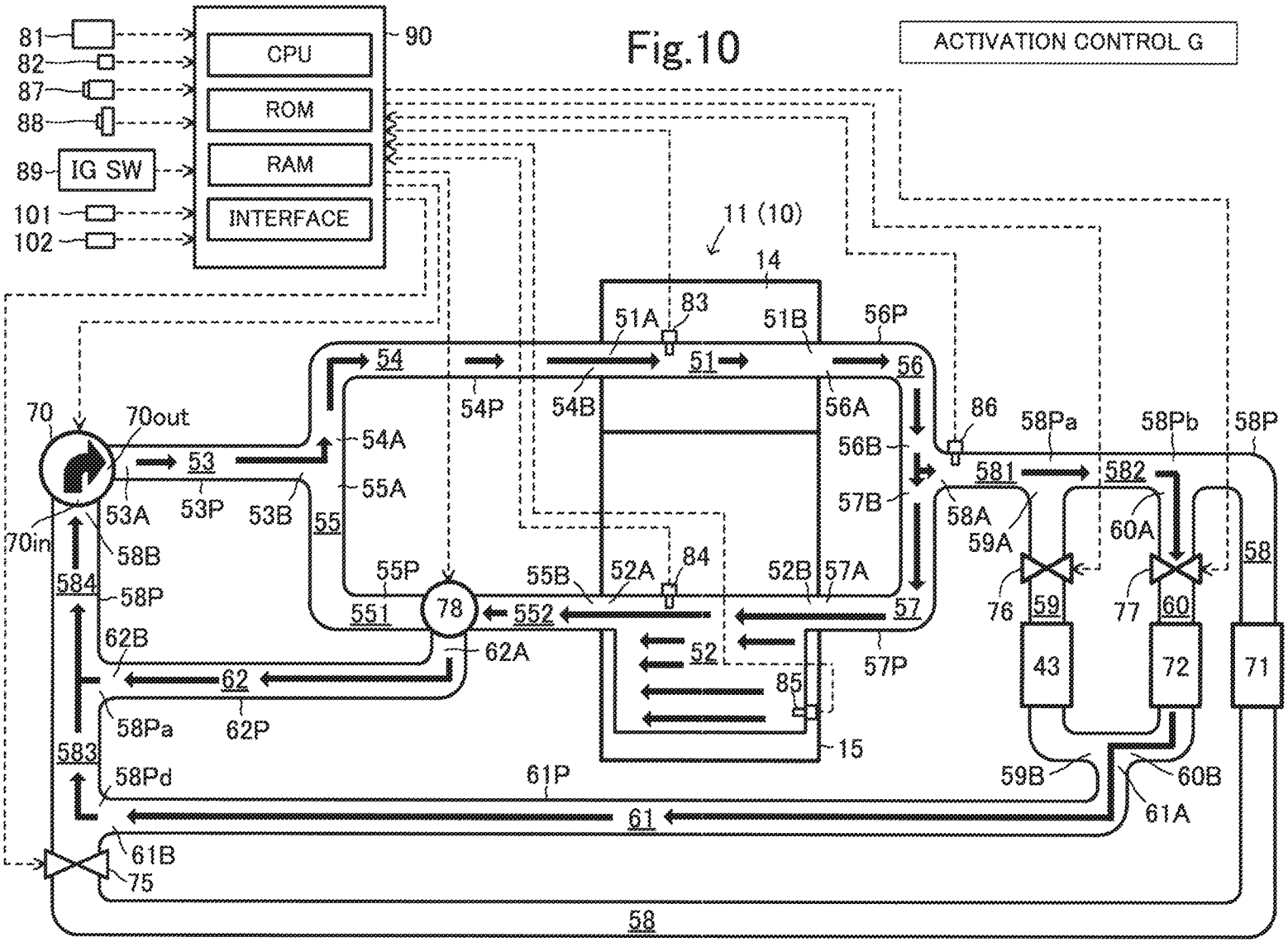
FIG. 10 is a view similar to FIG. 2 and which shows the flow of the cooling water when the cooling apparatus according to the embodiment executes an activation control G.

When the value of the heater core water supply request flag Xht is "1", the CPU determines "Yes" at the step 2125 and then, proceeds with the process to a step 2130 to execute the activation control G to control the activation of the pump 70 and the like (see FIG. 10). Then, the CPU proceeds with the process to the step 1995 of FIG. 19 via the step 2195 to terminate this routine once.

On the other hand, when the value of the heater core water supply request flag Xht is "0" at a time of the CPU executing the process of the step 2125, the CPU determines "No" at the step 2125 and then, proceeds with the process to a step 2135 to execute the activation control F to control the activation of the pump 70 and the like (see FIG. 9). Then, the CPU proceeds with the process to the step 1995 of FIG. 19 via the step 2195 to terminate this routine once.

When the engine water temperature TWeng is equal to or higher than the second engine water temperature TWeng2 at a time of the CPU executing the process of the step 1920 of FIG. 19, the CPU determines "No" at the step 1920 and then, proceeds with the process to a step 1930 to determine whether the engine water temperature TWeng is lower than the third engine water temperature TWeng3.

Figure 22:
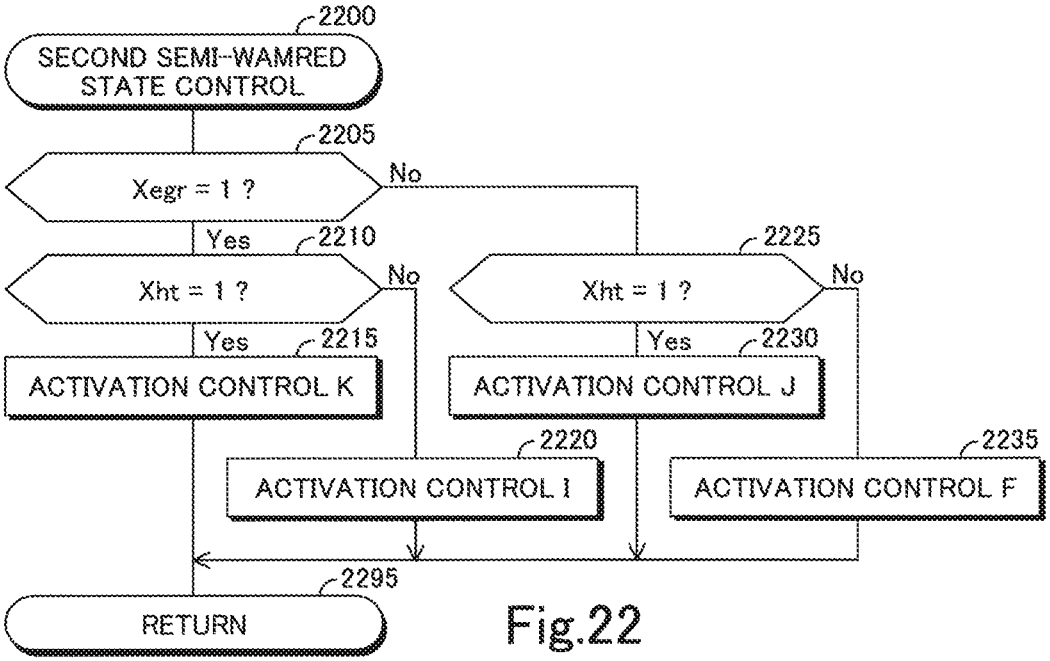
FIG. 22 is a flowchart for showing a routine executed by the CPU.

When the engine water temperature TWeng is lower than the third engine water temperature TWeng3, the CPU determines "Yes" at the step 1930 and then, proceeds with the process to a step 1935 to execute a second semi-warmed state control routine shown by a flowchart in FIG. 22.

Therefore, when the CPU proceeds with the process to the step 1935, the CPU starts a process from a step 2200 of FIG. 22 and then, proceeds with the process to a step 2205 to determine whether the value of the EGR cooler water supply request flag Xegr is "1", that is, the EGR cooler water supply is requested.

When the value of the EGR cooler water supply request flag Xegr is "1", the CPU determines "Yes" at the step 2205 and then, proceeds with the process to a step 2210 to determine whether the value of the heater core water supply request flag Xht is "1", that is, the heater core water supply is requested.

Figure 14:
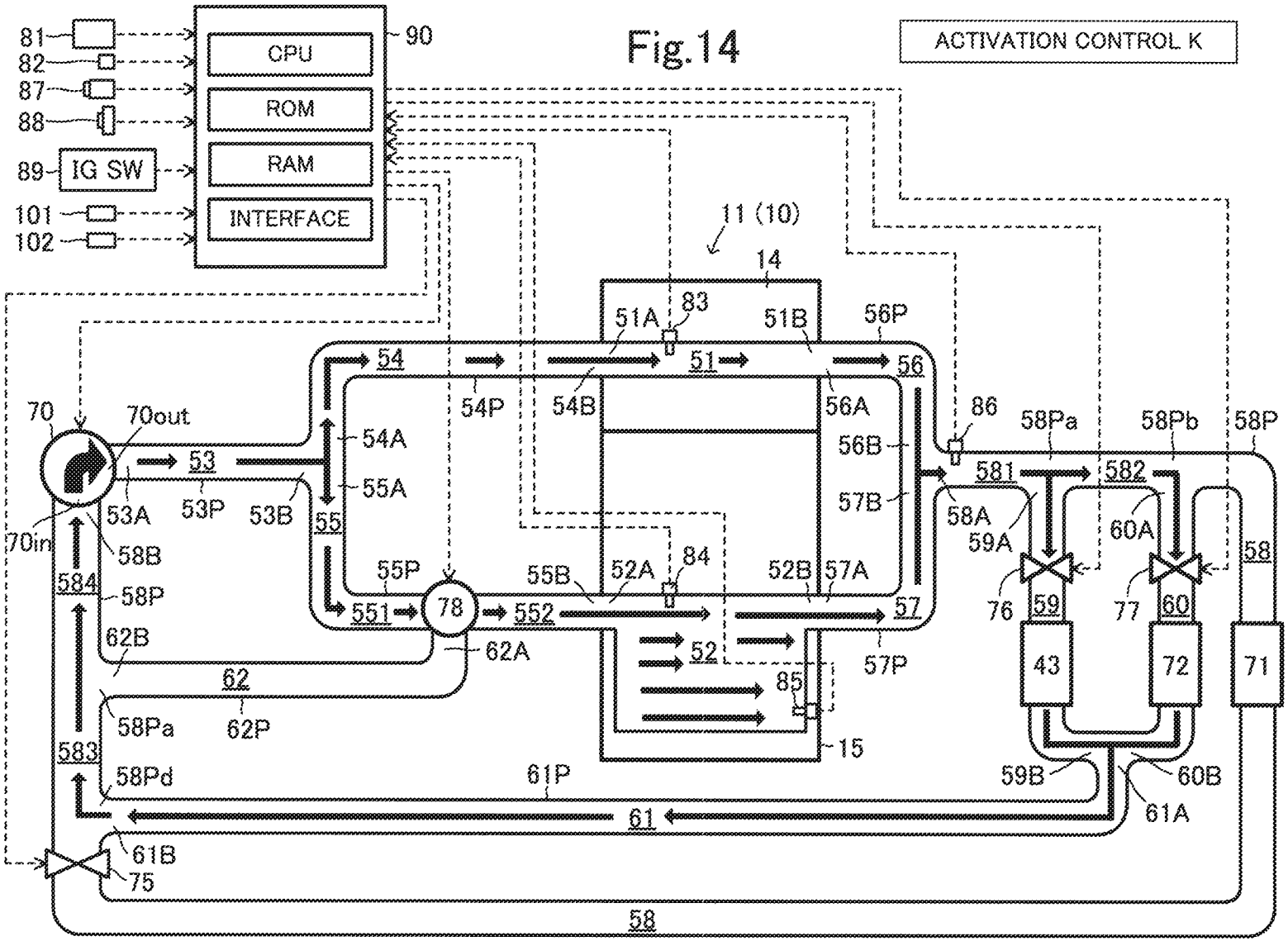
FIG. 14 is a view similar to FIG. 2 and which shows the flow of the cooling water when the cooling apparatus according to the embodiment executes an activation control K.

When the value of the heater core water supply request flag Xht is "1", the CPU determines "Yes" at the step 2210 and then, proceeds with the process to a step 2215 to execute the activation control K to control the activation of the pump 70 and the like (see FIG. 14). Then, the CPU proceeds with the process to the step 1995 of FIG. 19 via a step 2295 to terminate this routine once.

Figure 12:
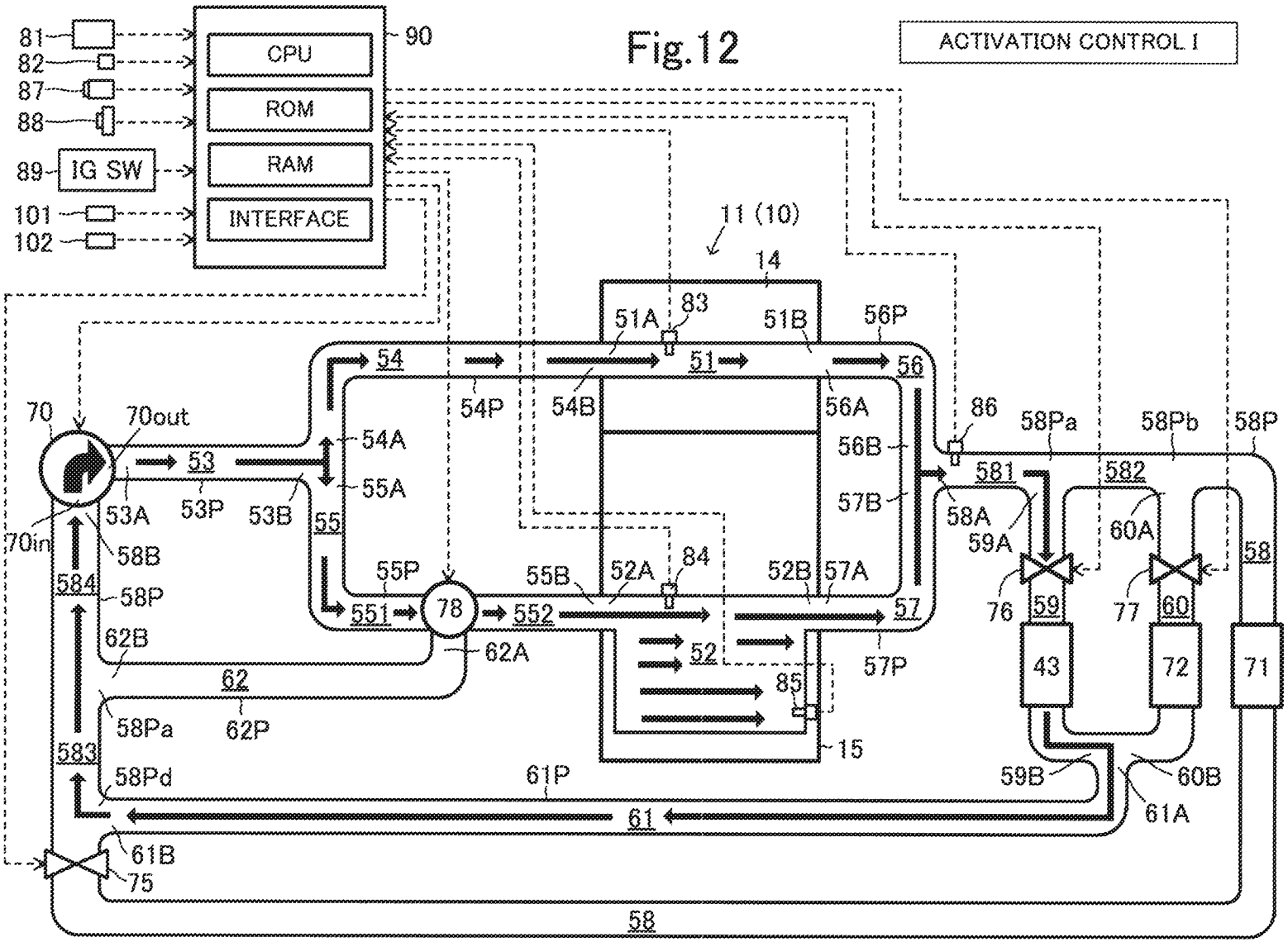
FIG. 12 is a view similar to FIG. 2 and which shows the flow of the cooling water when the cooling apparatus according to the embodiment executes an activation control I.

On the other hand, when the value of the heater core water supply request flag Xht is "0" at a time of the CPU executing the process of the step 2210, the CPU determines "No" at the step 2210 and then, proceeds with the process to a step 2220 to execute the activation control I to control the activation of the pump 70 and the like (see FIG. 12). Then, the CPU proceeds with the process to the step 1995 of FIG. 19 via the step 2295 to terminate this routine once.

When the value of the EGR cooler water supply request flag Xegr is "0" at a time of the CPU executing the process of the step 2205, the CPU determines "No" at the step 2205 and then, proceeds with the process to a step 2225 to determine whether the value of the heater core water supply request flag Xht is "1".

Figure 13:
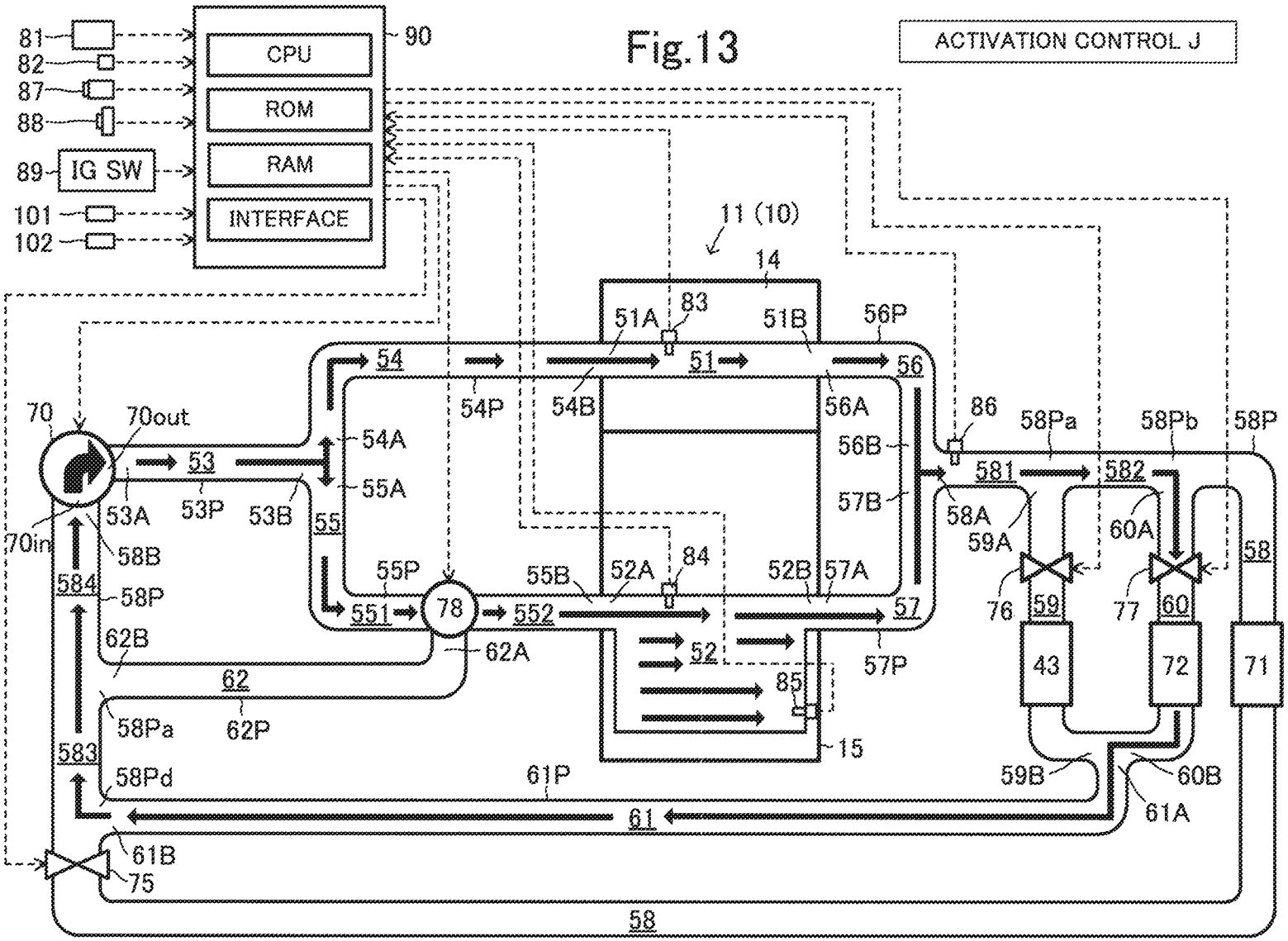
FIG. 13 is a view similar to FIG. 2 and which shows the flow of the cooling water when the cooling apparatus according to the embodiment executes an activation control J.

When the value of the heater core water supply request flag Xht is "1", the CPU determines "Yes" at the step 2225 and then, proceeds with the process to a step 2230 to execute the activation control J to control the activation of the pump 70 and the like (see FIG. 13). Then, the CPU proceeds with the process to the step 1995 of FIG. 19 via the step 2295 to terminate this routine once.

On the other hand, when the value of the heater core water supply request flag Xht is "0" at a time of the CPU executing the process of the step 2225, the CPU determines "No" at the step 2225 and then, proceeds with the process to a step 2235 to execute the activation control F to control the activation of the pump 70 and the like (see FIG. 9). Then, the CPU proceeds with the process to the step 1995 of FIG. 19 via the step 2295 to terminate this routine once.

Figure 23:
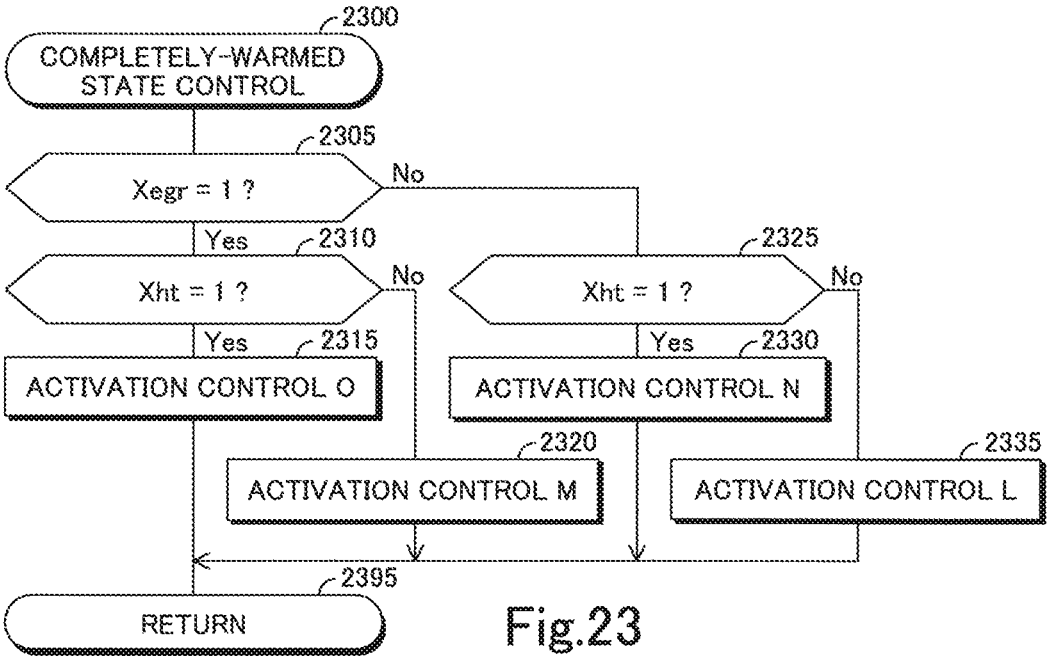
FIG. 23 is a flowchart for showing a routine executed by the CPU.

When the engine water temperature TWeng is equal to or higher than the third engine water temperature TWeng3 at a time of the CPU executing the process of the step 1930 of FIG. 19, the CPU determines "No" at the step 1930 and then, proceeds with the process to a step 1940 to execute a completely-warmed state control routine shown by a flowchart in FIG. 23.

Therefore, when the CPU proceeds with the process to the step 1940, the CPU starts a process from a step 2300 of FIG. 23 and then, proceeds with the process to a step 2305 to determine whether the value of the EGR cooler water supply request flag Xegr is "1", that is, the EGR cooler water supply is requested.

When the value of the EGR cooler water supply request flag Xegr is "1", the CPU determines "Yes" at the step 2305 and then, proceeds with the process to a step 2310 to determine whether the value of the heater core water supply request flag Xht is "1", that is, the heater core water supply is requested.

Figure 18:
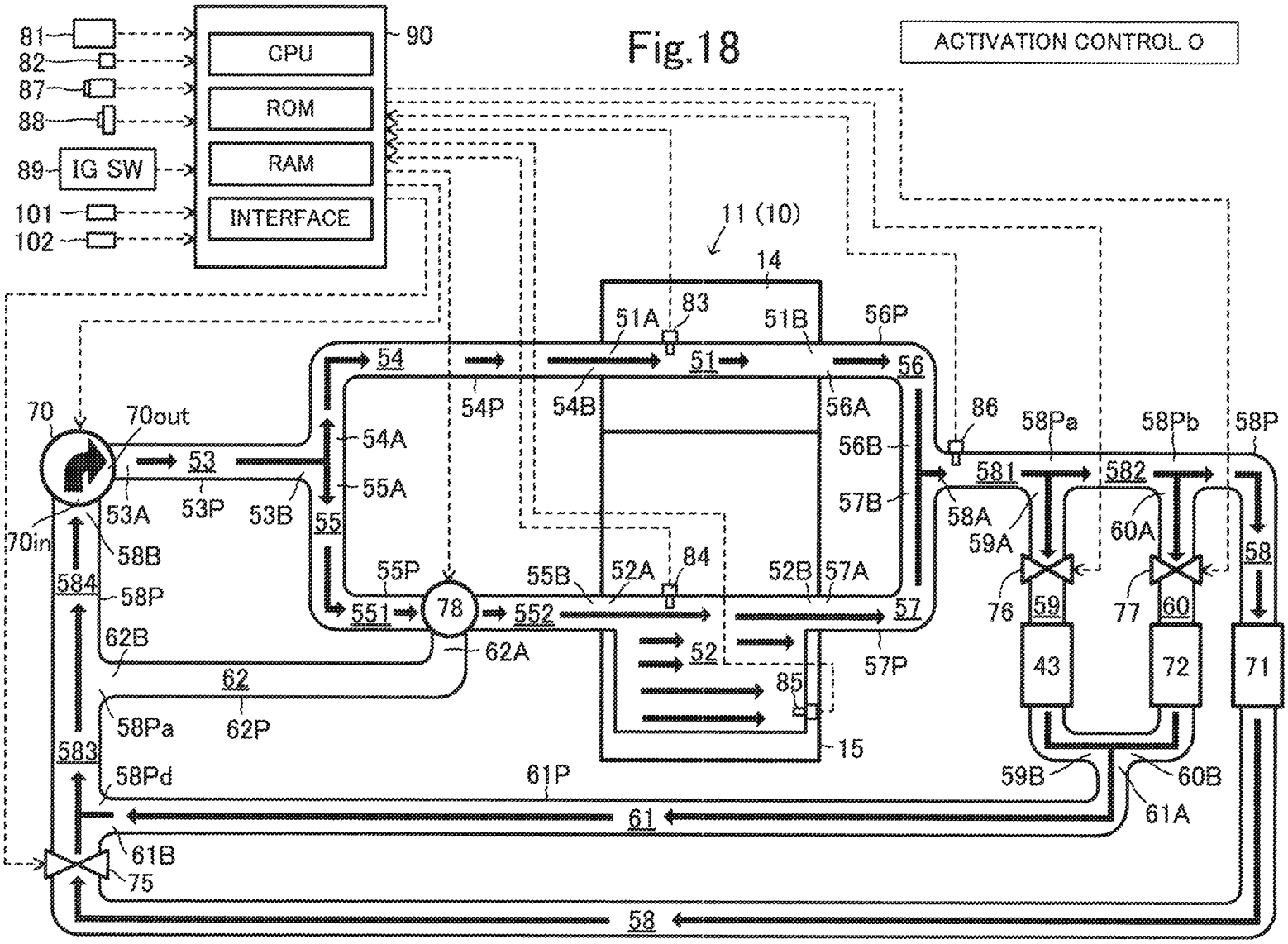
FIG. 18 is a view similar to FIG. 2 and which shows the flow of the cooling water when the cooling apparatus according to the embodiment executes an activation control O.

When the value of the heater core water supply request flag Xht is "1", the CPU determines "Yes" at the step 2310 and then, proceeds with the process to a step 2315 to execute the activation control O to control the activation of the pump 70 and the like (see FIG. 18). Then, the CPU proceeds with the process to the step 1995 of FIG. 19 via a step 2395 to terminate this routine once.

Figure 16:
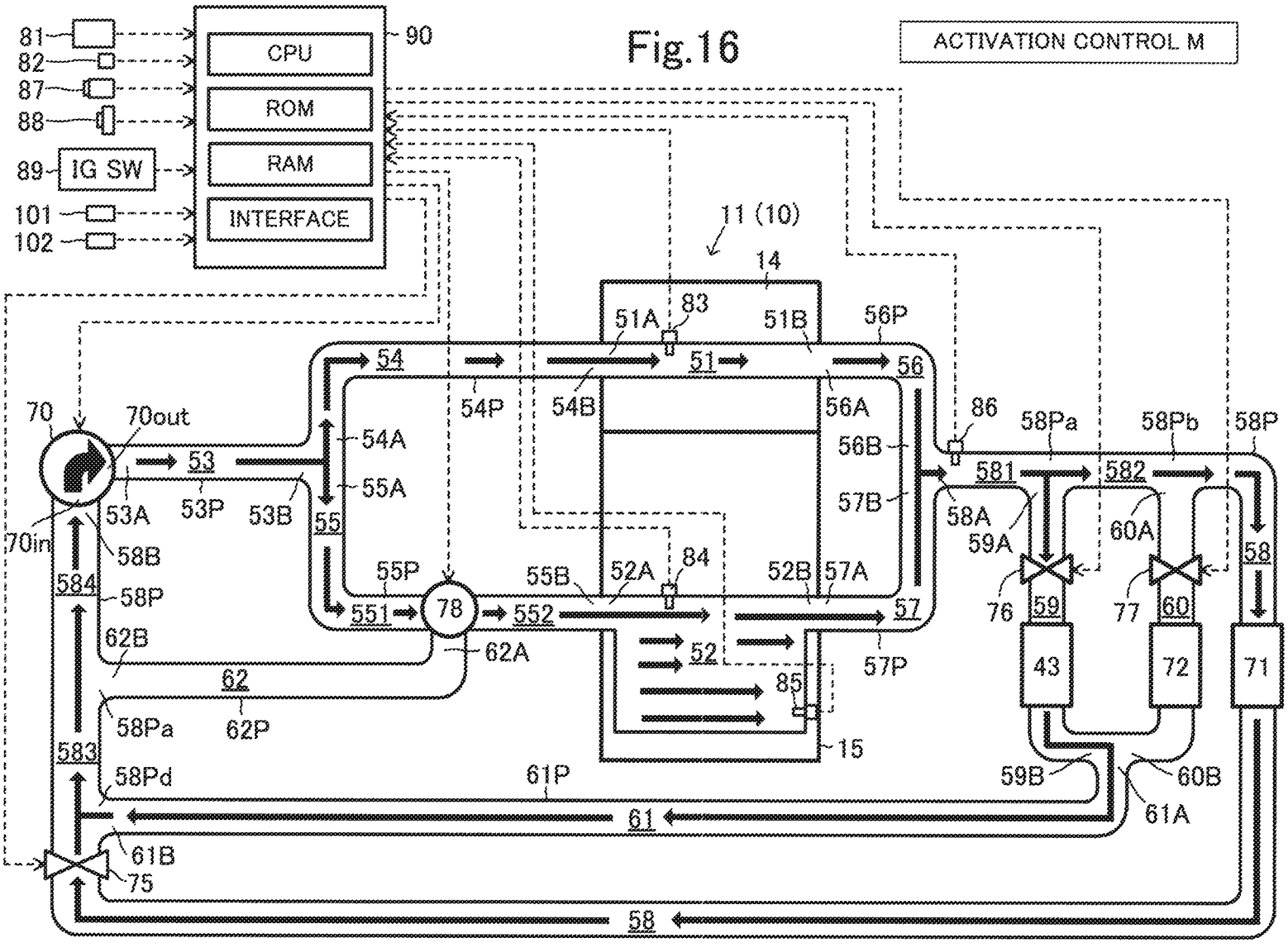
FIG. 16 is a view similar to FIG. 2 and which shows the flow of the cooling water when the cooling apparatus according to the embodiment executes an activation control M.

On the other hand, when the value of the heater core water supply request flag Xht is "0" at a time of the CPU executing the process of the step 2310 of FIG. 23, the CPU determines "No" at the step 2310 and then, proceeds with the process to a step 2320 to execute the activation control M to control the activation of the pump 70 and the like (see FIG. 16). Then, the CPU proceeds with the process to the step 1995 of FIG. 19 via the step 2395 to terminate this routine once.

When the value of the EGR cooler water supply request flag Xegr is "0" at a time of the CPU executing the process of the step 2305, the CPU determines "No" at the step 2305 and then, proceeds with the process to a step 2325 to determine whether the value of the heater core water supply request flag Xht is "1".

Figure 17:
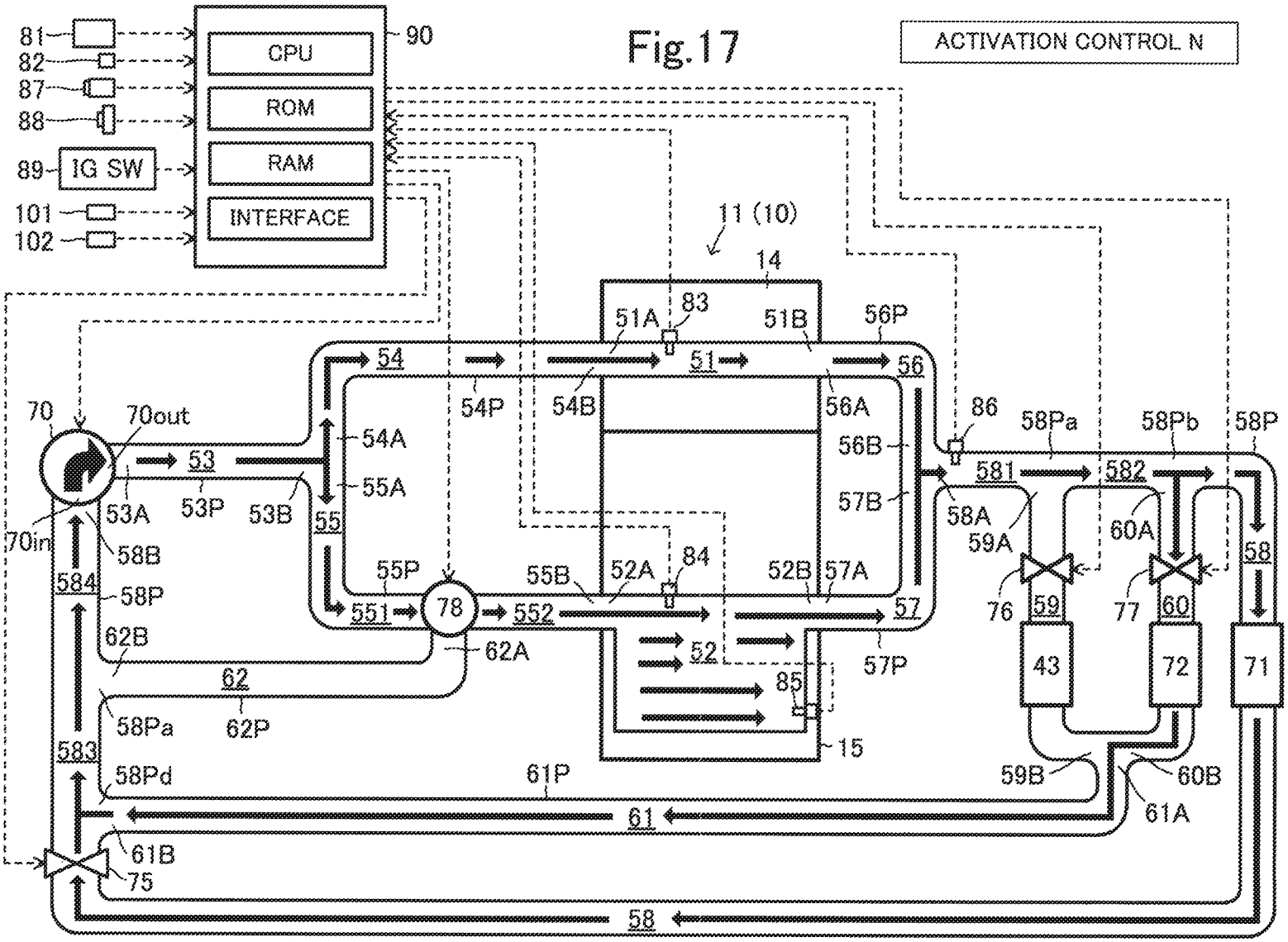
FIG. 17 is a view similar to FIG. 2 and which shows the flow of the cooling water when the cooling apparatus according to the embodiment executes an activation control N.

When the value of the heater core water supply request flag Xht is "1", the CPU determines "Yes" at the step 2325 and then, proceeds with the process to a step 2330 to execute the activation control N to control the activation of the pump 70 and the like (see FIG. 17). Then, the CPU proceeds with the process to the step 1995 of FIG. 19 via the step 2395 to terminate this routine once.

Figure 15:
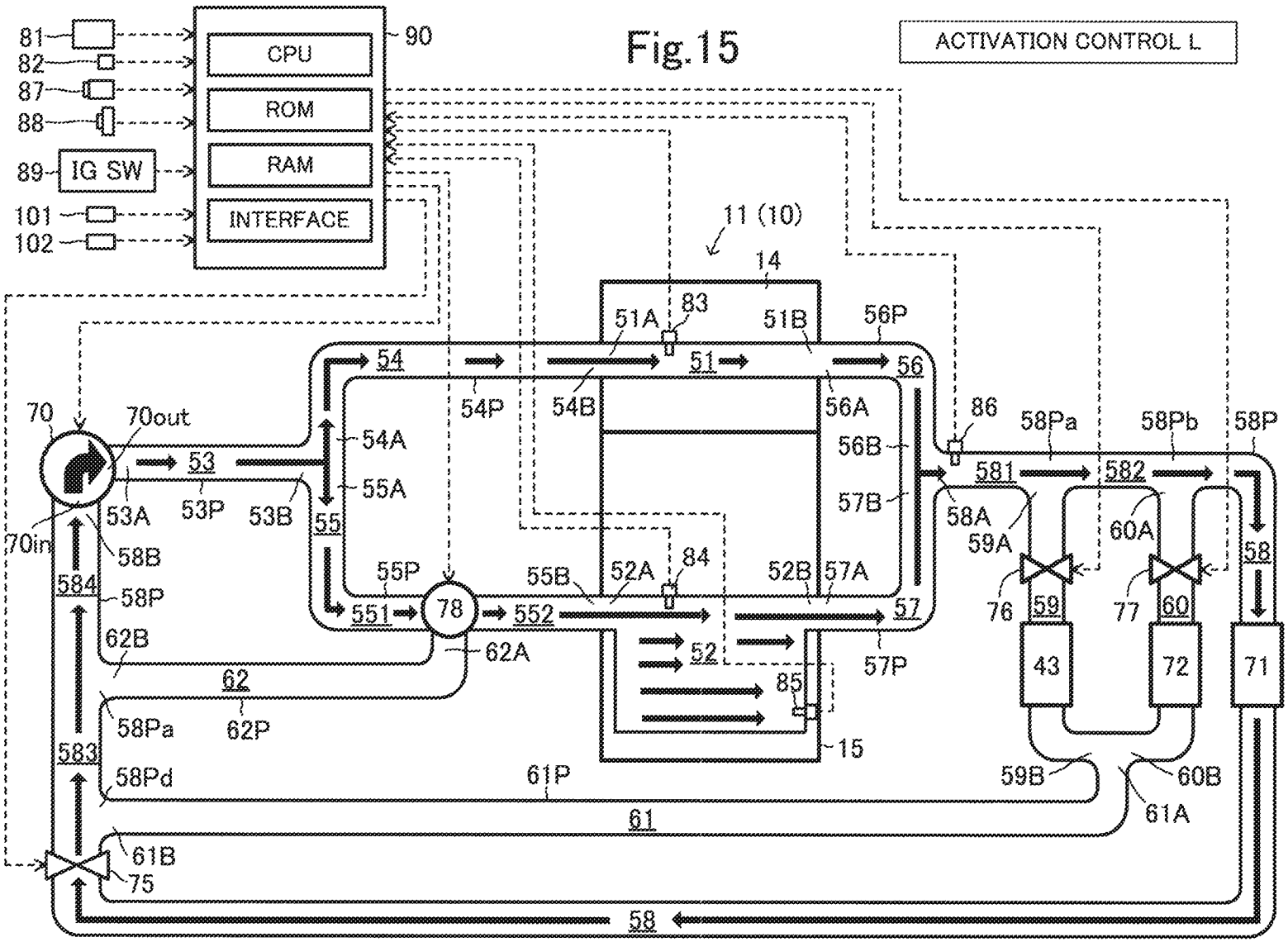
FIG. 15 is a view similar to FIG. 2 and which shows the flow of the cooling water when the cooling apparatus according to the embodiment executes an activation control L.

On the other hand, when the value of the heater core water supply request flag Xht is "0" at a time of the CPU executing the process of the step 2325, the CPU determines "No" at the step 2325 and then, proceeds with the process to a step 2335 to execute the activation control L to control the activation of the pump 70 and the like (see FIG. 15). Then, the CPU proceeds with the process to the step 1995 of FIG. 19 via the step 2395 to terminate this routine once.

Figure 24:
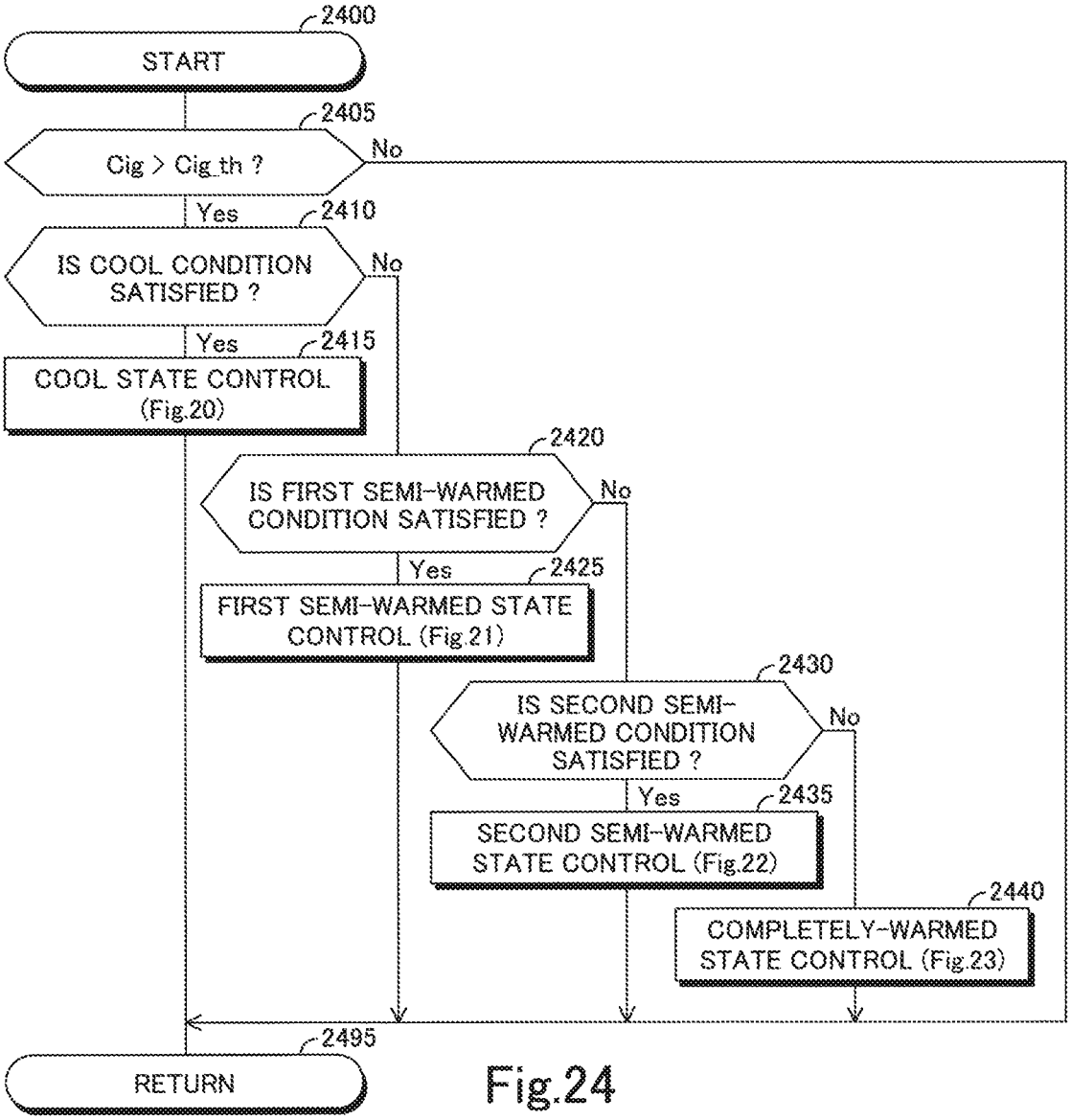
FIG. 24 is a flowchart for showing a routine executed by the CPU.

Further, the CPU is configured or programmed to execute a routine shown by a flowchart in FIG. 24 each time a predetermined time elapses. Therefore, at a predetermined timing, the CPU starts a process from a step 2400 of FIG. 24 and then, proceeds with the process to a step 2405 to determine whether the after-engine-start cycle number Cig is larger than the predetermined after-engine-start cycle number Cig_th.

When the after-engine-start cycle number Cig is equal to or smaller than the predetermined after-engine-start cycle number Cig_th, the CPU determines "No" at the step 2405 and then, proceeds with the process to a step 2495 to terminate this routine once.

On the other hand, when the after-engine-start cycle number Cig is larger than the predetermined after-engine-start cycle number Cig_th, the CPU determines "Yes" at the step 2405 and then, proceeds with the process to a step 2410 to determine whether the cool condition is satisfied. When the cool condition is satisfied, the CPU determines "Yes" at the step 2410 and then, proceeds with the process to a step 2415 to execute the aforementioned cool state control routine shown in FIG. 20. Then, the CPU proceeds with the process to the step 2495 to terminate this routine once.

On the other hand, when the cool condition is not satisfied at a time of the CPU executing the process of the step 2410, the CPU determines "No" at the step 2410 and then, proceeds with the process to a step 2420 to determine whether the first semi-warmed condition is satisfied. When the first semi-warmed condition is satisfied, the CPU determines "Yes" at the step 2420 and then, proceeds with the process to a step 2425 to execute the aforementioned first semi-warmed state control routine shown in FIG. 21. Then, the CPU proceeds with the process to the step 2495 to terminate this routine once.

When the first semi-warmed condition is not satisfied at a time of the CPU executing the process of the step 2420, the CPU determines "No" at the step 2420 and then, proceeds with the process to a step 2430 to determine whether the second semi-warmed condition is satisfied. When the second semi-warmed condition is satisfied, the CPU determines "Yes" at the step 2430 and then, proceeds with the process to a step 2435 to execute the aforementioned second semi-warmed state control routine shown in FIG. 22. Then, the CPU proceeds with the process to the step 2495 to terminate this routine once.

When the second semi-warmed condition is not satisfied at a time of the CPU executing the process of the step 2430, the CPU determines "No" at the step 2430 and then, proceeds with the process to a step 2440 to execute the aforementioned completely-warmed state control routine shown in FIG. 23. Then, the CPU proceeds with the process to the step 2495 to terminate this routine once.

Figure 25:
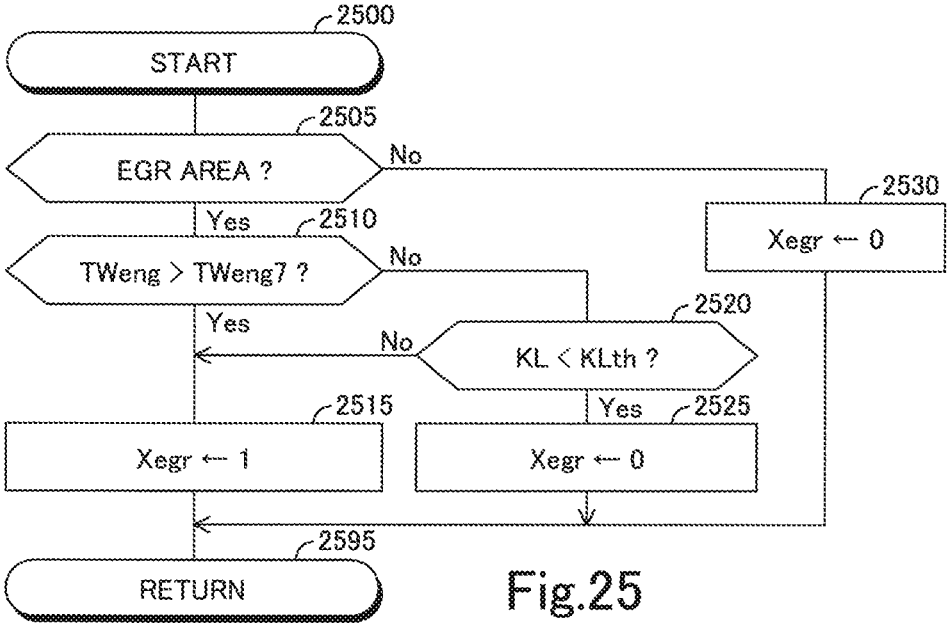
FIG. 25 is a flowchart for showing a routine executed by the CPU.

Further, the CPU is configured or programmed to execute a routine shown by a flowchart in FIG. 25 each time a predetermined time elapses. Therefore, at a predetermined timing, the CPU starts a process from a step 2500 of FIG. 25 and then, proceeds with the process to a step 2505 to determine whether the engine operation state is in the EGR area Rb.

When the engine operation state is in the EGR area Rb, the CPU determines "Yes" at the step 2505 and then, proceeds with the process to a step 2510 to determine whether the engine water temperature TWeng is higher than the seventh engine water temperature TWeng7.

When the engine water temperature TWeng is higher than the seventh engine water temperature TWeng7, the CPU determines "Yes" at the step 2510 and then, proceeds with the process to a step 2515 to set the value of the EGR cooler water supply request flag Xegr to "1". Then, the CPU proceeds with the process to a step 2595 to terminate this routine once.

On the other hand, when the engine water temperature TWeng is equal to or lower than the seventh engine water temperature TWeng7, the CPU determines "No" at the step 2510 and then, proceeds with the process to a step 2520 to determine whether the engine load KL is smaller than the threshold engine load KLth.

When the engine load KL is smaller than the threshold engine load KLth, the CPU determines "Yes" at the step 2520 and then, proceeds with the process to a step 2525 to set the value of the EGR cooler water supply request flag Xegr to "0". Then, the CPU proceeds with the process to the step 2595 to terminate this routine once.

On the other hand, when the engine load KL is equal to or larger than the threshold engine load KLth, the CPU determines "No" at the step 2520 and then, proceeds with the process to the step 2515 to set the value of the EGR cooler water supply request flag Xegr to "1". Then, the CPU proceeds with the process to the step 2595 to terminate this routine once.

When the engine operation state is not in the EGR area Rb at a time of the CPU executing a process of the step 2505, the CPU determines "No" at the step 2505 and then, proceeds with the process to a step 2530 to set the value of the EGR cooler water supply request flag Xegr to "0". Then, the CPU proceeds with the process to the step 2595 to terminate this routine once.

Figure 26:
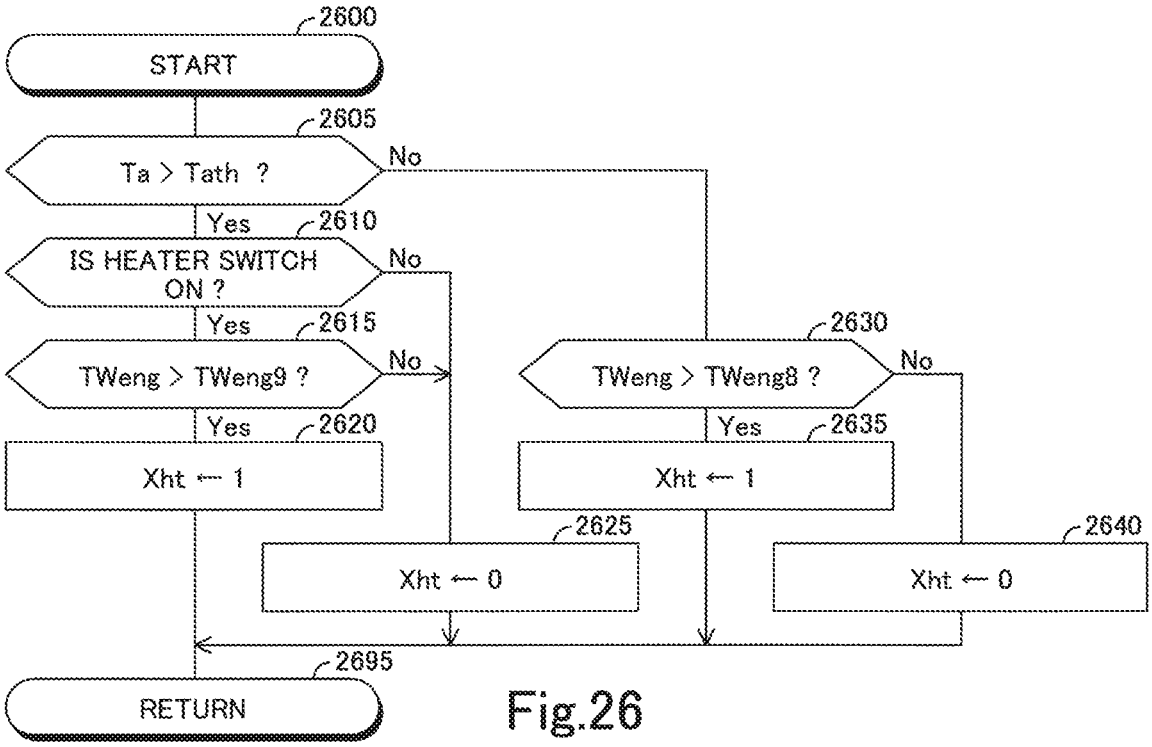
FIG. 26 is a flowchart for showing a routine executed by the CPU.

Further, the CPU is configured or programmed to execute a routine shown by a flowchart in FIG. 26 each time a predetermined time elapses. Therefore, at a predetermined timing, the CPU starts a process from a step 2600 of FIG. 26 and then, proceeds with the process to a step 2605 to determine whether the outside air temperature Ta is higher than the threshold temperature Tath.

When the outside air temperature Ta is higher than the threshold temperature Tath, the CPU determines "Yes" at the step 2605 and then, proceeds with the process to a step 2610 to determine whether the heater switch 88 is set to the ON position.

When the heater switch 88 is set to the ON position, the CPU determines "Yes" at the step 2610 and then, proceeds with the process to a step 2615 to determine whether the engine water temperature TWeng is higher than the ninth engine water temperature TWeng9.

When the engine water temperature TWeng is higher than the ninth engine water temperature TWeng9, the CPU determines "Yes" at the step 2615 and then, proceeds with the process to a step 2620 to set the value of the heater core water supply request flag Xht to "1". Then, the CPU proceeds with the process to a step 2695 to terminate this routine once.

On the other hand, when the engine water temperature TWeng is equal to or lower than the ninth engine water temperature TWeng9, the CPU determines "No" at the step 2615 and then, proceeds with the process to a step 2625 to set the value of the heater core water supply request flag Xht to "0". Then, the CPU proceeds with the process to the step 2695 to terminate this routine once.

When the heater switch 88 is set to the OFF position at a time of the CPU executing a process of the step 2610, the CPU determines "No" at the step 2610 and then, proceeds with the process to the step 2625 to set the value of the heater core water supply request flag Xht to "0". Then, the CPU proceeds with the process to the step 2695 to terminate this routine once.

When the outside air temperature Ta is equal to or lower than the threshold temperature Tath at a time of the CPU executing a process of the step 2605, the CPU determines "No" at the step 2605 and then, proceeds with the process to a step 2630 to determine whether the engine water temperature TWeng is higher than the eighth engine water temperature TWeng8.

When the engine water temperature TWeng is higher than the eighth engine water temperature TWeng8, the CPU determines "Yes" at the step 2630 and then, proceeds with the process to a step 2635 to set the value of the heater core water supply request flag Xht to "1". Then, the CPU proceeds with the process to the step 2695 to terminate this routine once.

On the other hand, when the engine water temperature TWeng is equal to or lower than the eighth engine water temperature TWeng8, the CPU determines "No" at the step 2630 and then, proceeds with the process to a step 2640 to set the value of the heater core water supply request flag Xht to "0". Then, the CPU proceeds with the process to the step 2695 to terminate this routine once.

Figure 27:
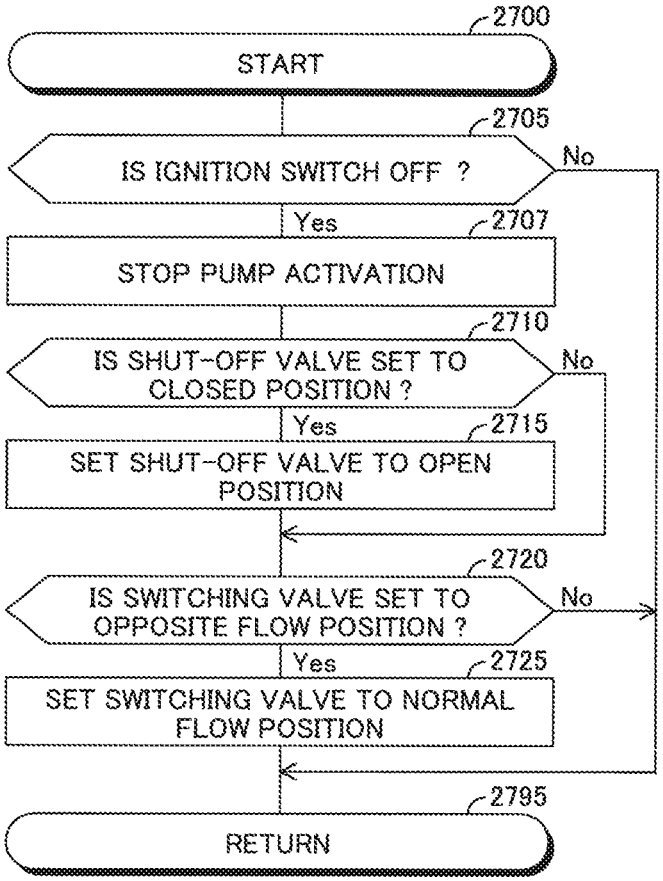
FIG. 27 is a flowchart for showing a routine executed by the CPU.

Further, the CPU is configured or programmed to execute a routine shown by a flowchart in FIG. 27 each time a predetermined time elapses. Therefore, at a predetermined timing, the CPU starts a process from a step 2700 of FIG. 27 and then, proceeds with the process to a step 2705 to determine whether the ignition OFF operation is performed.

When the ignition OFF operation is performed, the CPU determines "Yes" at the step 2705 and then, proceeds with the process to a step 2707 to stop the activation of the pump 70. Then, the CPU proceeds with the process to a step 2710 to determine whether the shut-off valve 75 is set to the closed position.

When the shut-off valve 75 is set to the closed position, the CPU determines "Yes" at the step 2710 and then, proceeds with the process to a step 2715 to set the shut-off valve 75 to the closed position. Then, the CPU proceeds with the process to a step 2720.

On the other hand, when the shut-off valve 75 is set to the open position, the CPU determines "No" at the step 2710 and then, proceeds with the process directly to the step 2720.

When the CPU proceeds with the process to the step 2720, the CPU determines whether the switching valve 78 is set to the opposite flow position. When the switching valve 78 is set to the opposite flow position, the CPU determines "Yes" at the step 2720 and then, proceeds with the process to a step 2725 to set the switching valve 78 to the normal flow position. Then, the CPU proceeds with the process to a step 2795 to terminate this routine once.

On the other hand, when the switching valve 78 is set to the normal flow position at a time of the CPU executing a process of the step 2720, the CPU determines "No" at the step 2720 and then, proceeds with the process directly to the step 2795 to terminate this routine once.

When the ignition OFF operation is not performed at a time of the CPU executing a process of the step 2705, the CPU determines "No" at the step 2705 and then, proceeds with the process directly to the step 2795 to terminate this routine once.

The concrete operation of the embodiment apparatus has been described. Thereby, the engine temperature Teng increases at the large rate, and the EGR cooler water supply and the heater core water supply are accomplished in response to the EGR cooler water supply request and the heater core water supply request until the warming of the engine 10 is completed.

It should be noted that the present invention is not limited to the aforementioned embodiment, and various modifications can be employed within the scope of the present invention.

First Modified Example

Figure 28:
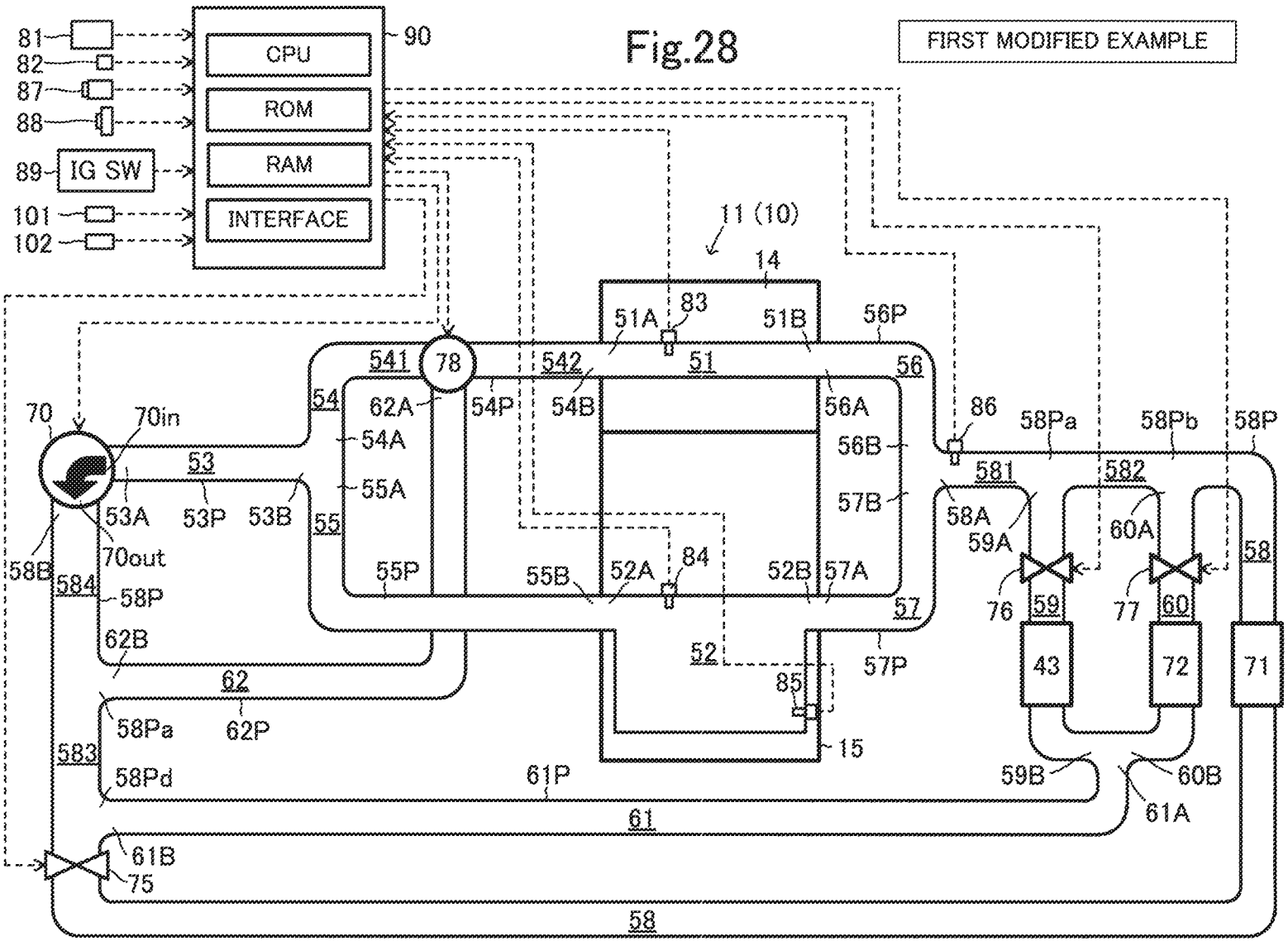
FIG. 28 is a view for showing a cooling apparatus according to a first modified example of the embodiment of the invention.
Figure 29:
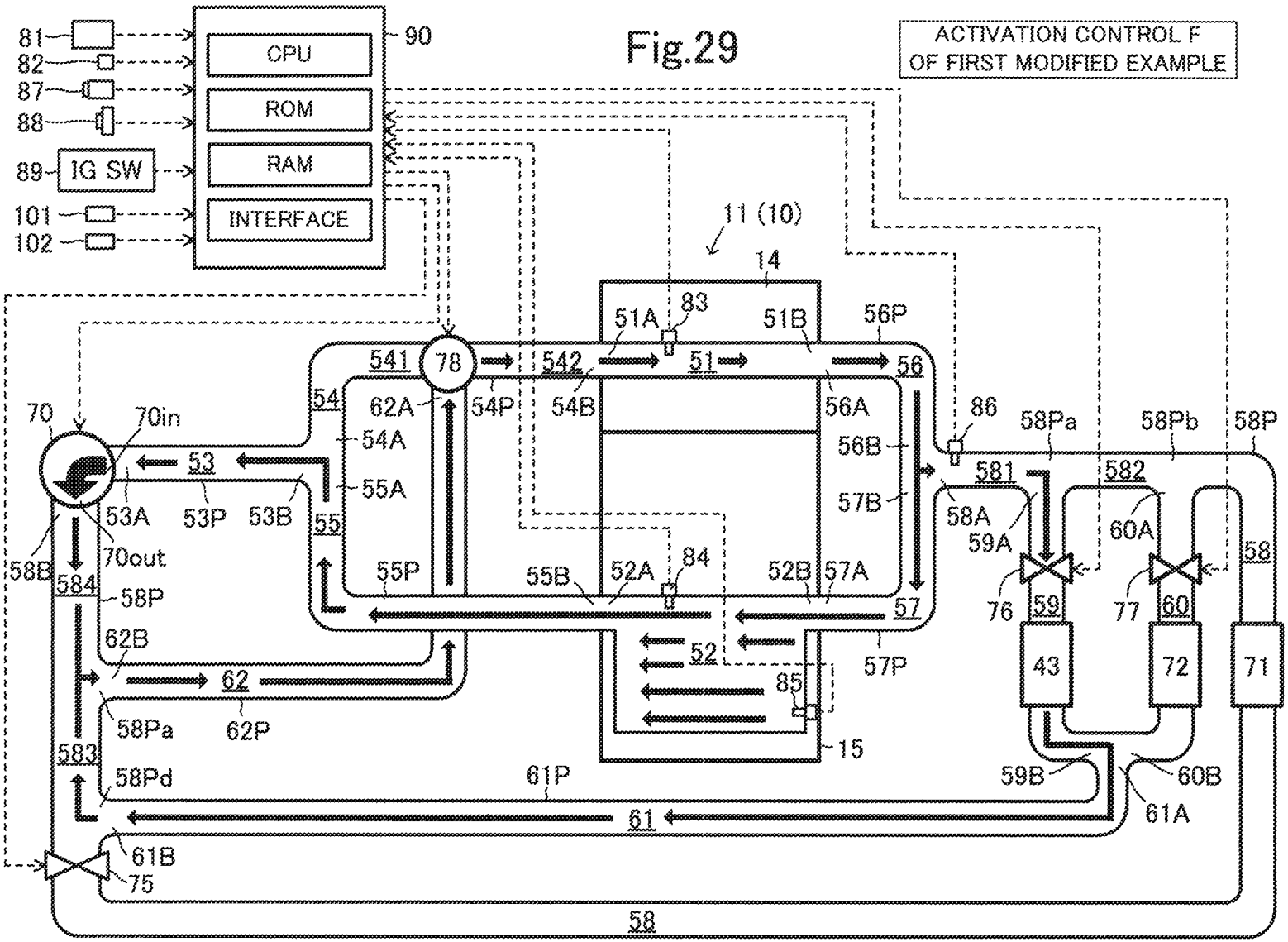
FIG. 29 is a view similar to FIG. 28 and which shows the flow of the cooling water when the cooling apparatus according to the first modified example executes the activation control E.

For example, the embodiment apparatus may be modified to be a cooling apparatus shown in FIG. 28. In the cooling apparatus shown in FIG. 29 according to a first modified example of the embodiment (hereinafter, will be referred to as "the first modified apparatus"), the switching valve 78 is provided in the cooling water pipe 54P, not in the cooling water pipe 55P. The first end 61A of the cooling water pipe 62P is connected to the switching valve 78.

Further, according to the first modified apparatus, the pump 70 is provided such that the pump suctioning opening 70*in* is connected to the water passage 53, and the pump discharging opening 70*out* is connected to the radiator water passage 58.

When the switching valve 78 is set to the normal flow position, the switching valve 78 permits the flow of the cooling water between a first portion 541 of the water passage 54 and a second portion 542 of the water passage 54 and shuts off the flow of the cooling water between the first portion 541 of the water passage 54 and the water passage 62 and the flow of the cooling water between the second portion 542 of the water passage 54 and the water passage 62. The first portion 541 is a portion of the water passage 54 between the switching valve 78 and the first end 54A of the cooling water pipe 54P. The second portion 542 is a portion of the water passage 54 between the switching valve 78 and the second end 54B of the cooling water pipe 54P.

When the switching valve 78 is set to the opposite flow position, the switching valve 78 permits the flow of the cooling water between the second portion 542 of the water passage 54 and the water passage 62 and shuts off the flow of the cooling water between the first portion 541 of the water passage 54 and the second portion 542 of the water passage 54.

When the switching valve 78 is set to the shut-off position, the switching valve 78 shuts off the flow of the cooling water between the first portion 541 of the water passage 54 and the second portion 542 of the water passage 54, the flow of the cooling water between the first portion 541 of the water passage 54 and the water passage 62 and the flow of the cooling water between the second portion 542 of the water passage 54 and the water passage 62.

<Operation of First Modified Apparatus>

The first modified apparatus executes the activation controls A to D, and F to O, similar to the embodiment apparatus. Conditions for executing the activation controls A to D, and F to O in the first modified apparatus are the same as the conditions of executing the activation controls A to D, and F to O, respectively. Below, the activation controls F and L among the activation controls A to O executed by the first modified apparatus will be described.

<Activation Control F>

The first modified apparatus executes the activation control F when a condition of executing the activation control F is satisfied. According to the activation control F, the embodiment apparatus activates the pump 70, sets the shut-off valves 75 and 77 to the closed positions, respectively, sets the shut-off valve 76 to the open position, and sets the switching valve 78 to the opposite flow position. When the first modified apparatus executes the activation control F, the cooing water circulates as shown by arrows in FIG. 29. When the embodiment apparatus executes the activation control F, the embodiment apparatus sets the pump discharging flow rate to the flow rate capable of preventing the cooling water from boiling in the head water passage 51.

According to the activation control F, the cooling water is discharged to the radiator water passage 58 via the pump discharging opening 70*out*. Then, the cooling water flows into the head water passage 51 through the water passage 62 and the second portion 542 of the water passage 54.

A part of the cooling water flowing into the head water passage 51, flows through the head water passage 51 and then, flows into the block water passage 52 through the water passages 56 and 57. Then, the cooling water flows through the block water passage 52. Then, the cooling water flows through the water passages 55 and 53. Then, the cooling water is suctioned into the pump 70 via the pump suctioning opening 70*in*.

On the other hand, the remaining of the cooling water flowing into the head water passage 51, flows into the EGR cooler water passage 59 through the water passage 56 and the radiator water passage 58. Then, the cooling water flows through the EGR cooler 43. Then, the cooling water flows through the water passage 61 and the third portion 583 of the radiator water passage 58. Then, the cooling water flows into the water passage 62.

Thereby, a part of the cooling water flowing through the head water passage 51, flows through the EGR cooler 43, and the remaining of the cooling water flowing through the head water passage 51, flows into the block water passage 52. In this case, the flow rate of the cooling water flowing through the block water passage 52 is smaller than the flow rate of the cooling water flowing through the head water passage 51. Thus, the block temperature Tbr increases at the sufficiently large rate even when the pump discharging flow rate is set to the flow rate capable of preventing the cooling water from boiling in the head water passage 51.

Further, the temperature of the cooling water increases while the cooling water flows through the head water passage 51. Therefore, the cooling water having an increased temperature, is supplied directly to the block water passage 52 without flowing through the radiator 71. Thus, the block temperature Tbr increases at the large rate, compared with when the cooling water is supplied to the block water passage 52 through the radiator 71.

Furthermore, the cooling water is supplied to the head water passage 51 at the flow rate capable of preventing the cooling water from boiling in the head water passage 51. Thus, the cooling water is prevented from boiling in the head water passage 51.

<Activation Control L>

Figure 30:
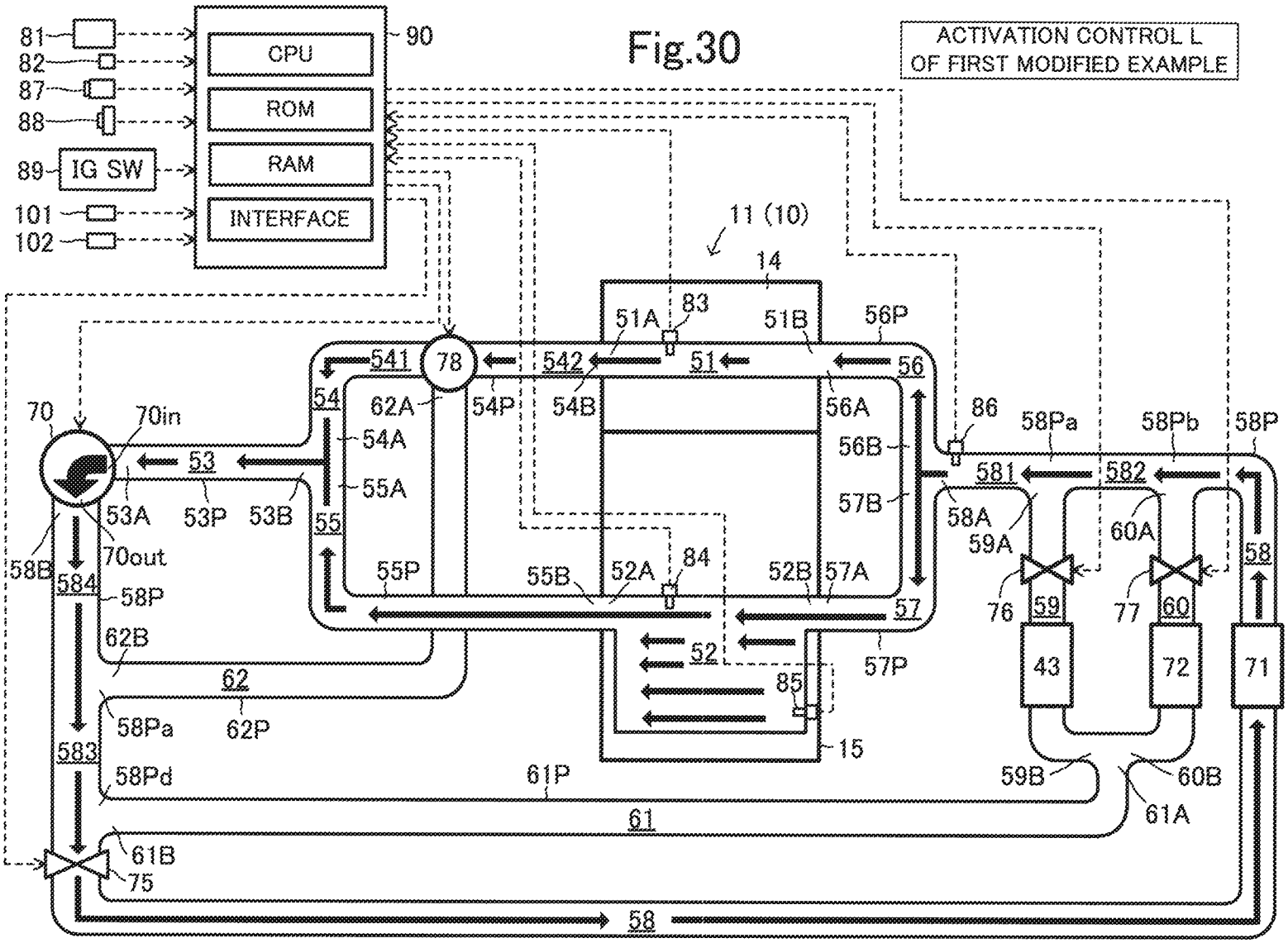
FIG. 30 is a view similar to FIG. 28 and which shows the flow of the cooling water when the cooling apparatus according to the first modified example executes the activation control L.

According to the activation control L, the first modified apparatus activates the pump 70, sets the shut-off valves 76 and 77 to the closed positions, respectively, sets the shut-off valve 75 to the open position, and sets the switching valve 78 to the normal flow position. When the first modified apparatus executes the activation control L, the cooling water circulates as shown by arrows in FIG. 30.

According to the activation control L, a part of the cooling water discharged to the radiator water passage 58 via the pump discharging opening 70*out*, flows into the head water passage 51 through the water passage 56. The remaining of the cooling water discharged to the radiator water passage 58, flows into the block water passage 52 through the water passage 57.

The cooling water flowing into the head water passage 51, flows through the head water passage 51. Then, the cooling water flows through the water passages 54 and 53. Then, the cooling water is suctioned into the pump 70 via the pump suctioning opening 70*in*. The cooling water flowing into the block water passage 52, flows through the block water passage 52. Then, the cooling water flows through the water passages 55 and 53. Then, the cooling water is suctioned into the pump 70 via the pump suctioning opening 70*in*.

Thereby, the cooling water having a temperature decreased by the radiator 71, is supplied to the head and block water passages 51 and 52. Thus, the cylinder head 14 and the cylinder block 15 are cooled sufficiently.

Second Modified Example

The embodiment apparatus may be configured to execute any of the activation controls A to O as shown in FIG. 31, depending on the warmed state, the presence or absence of the EGR cooler water supply request, and the presence or absence of the heater core water supply request. The embodiment apparatus configured as such is a cooling apparatus of the engine according to a second modified example of the embodiment, and hereinafter, will be referred to as "the second modified apparatus".

In FIG. 31, the cool state is the same as the cool state shown in FIG. 4. The completely-warmed state is the same as the completely-warmed state shown in FIG. 4. Further, an initial semi-warmed state, a middle semi-warmed state, and a final semi-warmed state are states between the cool state and the completely-warmed state. The engine temperature Teng estimated in the initial semi-warmed state is lower than the engine temperature Teng estimated in the middle-warmed state. The engine temperature Teng estimated in the middle-warmed state is lower than the engine temperature Teng estimated in the final warmed state.

A threshold for determining that the warmed state changes from the initial semi-warmed state to the middle semi-warmed state, is set in a proper manner. For example, the threshold may be the same as or smaller than or larger than the threshold used by the embodiment apparatus for determining that the warmed state changes from the first semi-warmed state to the second semi-warmed state.

Further, a threshold for determining that the warmed state changes from the middle semi-warmed state to the final semi-warmed state, is set in a proper manner. For example, the threshold may be the same as or smaller than or larger than the threshold used by the embodiment apparatus for determining that the warmed state changes from the first semi-warmed state to the second semi-warmed state.

When the second modified apparatus determines that the warmed state is the cool state, the second modified apparatus executes any of the activation controls A to D, depending on the presence or absence of the EGR cooler water supply request and the presence or absence of the heater core water supply request, similar to the embodiment apparatus determining that the warmed state is the cool state.

Further, when the second modified apparatus determines that the warmed state is the initial semi-warmed state and the EGR cooler water supply and the heater core water supply are not requested, the second modified apparatus executes the activation control E. When the second modified apparatus determines that the warmed state is the initial semi-warmed state, the EGR cooler water supply is requested, and the heater core water supply is not requested, the second modified apparatus executes the activation control F. When the second modified apparatus determines that the warmed state is the initial semi-warmed state, the EGR cooler water supply is not requested, and the heater core water supply is requested, the second modified apparatus executes the activation control G. When the second modified apparatus determines that the warmed state is the initial semi-warmed state, and the EGR cooler water supply and the heater core water supply are requested, the second modified apparatus executes the activation control H.

Furthermore, when the second modified apparatus determines that the warmed state is the middle semi-warmed state, the second modified apparatus executes any of the activation controls F to H, depending on the presence or absence of the EGR cooler water supply request and the presence or absence of the heater core water supply request, similar to the embodiment apparatus determining that the warmed state is the first semi-warmed state.

Furthermore, when the second modified apparatus determines that the warmed state is the final semi-warmed state, the second modified apparatus executes any of the activation controls F, and I to K, depending on the presence or absence of the EGR cooler water supply request and the presence or absence of the heater core water supply request, similar to the embodiment apparatus determining that the warmed state is the second semi-warmed state.

Furthermore, when the second modified apparatus determines that the warmed state is the completely-warmed state, the second modified apparatus executes any of the activation controls L to O, depending on the presence or absence of the EGR cooler water supply request and the presence or absence of the heater core water supply request, similar to the embodiment apparatus determining that the warmed state is the completely-warmed state.

It should be noted that the EGR system 40 of each of the embodiment apparatus and the modified apparatuses may include a bypass pipe which connects a portion of the exhaust gas recirculation pipe 41 upstream of the EGR cooler 43 and a portion of the exhaust gas recirculation pipe 41 downstream of the EGR cooler 43 to each other for allowing the EGR gas to bypass the EGR cooler 43.

In this case, the embodiment apparatus and the modified apparatuses may be configured to supply the EGR gas to the cylinders 12 through the bypass pipe without stopping a supply of the EGR gas to the cylinders 12. In this case, the EGR gas bypasses the EGR cooler 43. Thus, the EGR gas having a relatively high temperature, is supplied to the cylinders 12.

Alternatively, the embodiment apparatus and the modified apparatuses may be configured to perform any of a process for stopping the supply of the EGR gas to the cylinders 12 and a process for supplying the EGR gas to the cylinders 12 through the bypass pipe, depending on a condition relating to parameters such as the engine operation state when the engine operation state is in the EGR stop area Ra.

Further, the embodiment apparatus and the modified apparatuses may be configured to use the temperature of the cylinder block 15 in place of the upper block water temperature TWbr_up when a temperature sensor for detecting the temperature of the cylinder block 15, in particular, the temperature of a portion of the cylinder block 15 near cylinder bores defining the combustion chambers, is provided in the cylinder block 15. Further, the embodiment apparatus and the modified apparatuses may be configured to use the temperature of the cylinder head 14 in place of the head water temperature TWhd when a temperature sensor for detecting the temperature of the cylinder head 14, in particular, the temperature of a portion of the cylinder head 14 near a surface of the cylinder head 14 defining the combustion chambers, is provided in the cylinder head 14.

Further, the embodiment apparatus and the modified apparatuses may be configured to use an after-engine-start integration fuel amount ΣQ in place of or in addition to the after-engine-start integration air amount ΣGa. The after-engine-start integration fuel amount ΣQ is a total amount of the fuel supplied from the fuel injectors 13 to the cylinders 12*a* to 12*d* since the ignition switch 89 is set to the ON position.

The embodiment apparatus and the modified apparatuses configured as such, determine that the warmed state is the cool state when the after-engine-start integration fuel amount ΣQ is equal to or smaller than a first threshold fuel amount ΣQ1. When the after-engine-start integration fuel amount ΣQ is larger than the first threshold fuel amount ΣQ1 and equal to or smaller than a second threshold fuel amount ΣQ2, the embodiment apparatus and the modified apparatuses determine that the warmed state is the first semi-warmed state. Further, the embodiment apparatus and the modified apparatuses determine that the warmed state is the second semi-warmed state when the after-engine-start integration fuel amount ΣQ is larger than the second threshold fuel amount ΣQ2 and equal to or smaller than a third threshold fuel amount ΣQ3. embodiment apparatus and the modified apparatuses determine that the warmed state is the completely-warmed state when the after-engine-start integration fuel amount ΣQ is larger than the third threshold fuel amount ΣQ3.

Further, the embodiment apparatus and the modified apparatuses may be configured to determine that the EGR cooler water supply is requested when the engine water temperature TWeng is equal to or higher than the seventh engine water temperature TWeng7, and the engine operation state is in the EGR stop area Ra or Rc shown in FIG. 3. In this case, the processes of the steps 2505 and 2530 of FIG. 25 are omitted. Thereby, the cooling water is already supplied to the EGR cooler water passage 59 when the engine operation state changes from the EGR stop area Ra or Rc to the EGR area Rb. Thus, the EGR gas is cooled at the same time as the start of the supply of the EGR gas to the cylinders 12.

Further, the embodiment apparatus and the modified apparatuses may be configured to determine that the heater core water supply is requested, independently of the set state of the heater switch 88 when the outside air temperature Ta is higher than the threshold temperature Tath, and the engine water temperature TWeng is higher than the ninth engine water temperature TWeng9. In this case, the process of the step 2610 of FIG. 26 is omitted.

Further, the invention can be applied to a cooling apparatus which does not include the EGR cooler water passage 59 and the shut-off valve 76, and a cooling apparatus which does not include the heater core water passage 60 and the shut-off valve 77.

What is claimed is:

1. A cooling apparatus for cooling a cylinder head and a cylinder block of an internal combustion engine by cooling water, the cooling apparatus comprising:

a pump for circulating the cooling water;

a first water passage formed in the cylinder head;

a second water passage formed in the cylinder block;

a third water passage for connecting a first end of the first water passage to a pump discharging opening of the pump, the cooling water being discharged from the pump via the pump discharging opening;

a normal flow connection water passage for connecting a first end of the second water passage to the pump discharging opening;

an opposite flow connection water passage for connecting the first end of the second water passage to a pump suctioning opening of the pump, the cooling water being suctioned into the pump via the pump suctioning opening;

a switching part for switching a cooling water flow between a flow of the cooling water through the normal flow connection water passage and a flow of the cooling water through the opposite flow connection water passage;

a fourth water passage for connecting a second end of the first water passage to a second end of the second water passage;

fifth and sixth water passages for connecting the fourth water passage to the pump suctioning opening, respectively;

a radiator provided at the fifth water passage for cooling the cooling water;

a heat exchanger provided in the sixth water passage for exchanging heat with the cooling water;

a first shut-off valve for shutting off and opening the fifth water passage, the first shut-off valve shutting off the fifth water passage when the first shut-off valve is set to a closed position, the first shut-off valve opening the fifth water passage when the first shut-off valve is set to an open position;

a second shut-off valve for shutting off and opening the sixth water passage, the second shut-off valve shutting off the sixth water passage when the second shut-off valve is set to a closed position, the second shut-off valve opening the sixth water passage when the second shut-off valve is set to an open position; and an electronic control unit for controlling activations of the pump, the switching part, the first shut-off valve, and the second shut-off valve, the cooling water flowing through the normal flow connection water passage when the switching part performs a normal flow connection operation while the pump is activated, the cooling water flowing through the opposite flow connection water passage when the switching part performs an opposite flow connection operation while the pump is activated, the electronic control unit being configured to:

activate the pump, set the first shut-off valve to the open position, and perform the normal flow connection operation when an engine temperature is equal to or higher than a completely-warmed temperature at which a warming of the internal combustion engine is estimated to be completed; and activate the pump and set the second shut-off valve to the open position when a supply of the cooling water to the heat exchanger is requested, wherein the electronic control unit is configured to activate the pump, set the first shut-off valve to the closed position, set the second shut-off valve to the open position, and perform the opposite flow connection operation when the engine temperature is in a predetermined temperature range defined by upper and lower limit temperatures lower than the completely-warmed temperature, and the supply of the cooling water to the heat exchanger is requested.

2. The cooling apparatus according to claim 1, wherein the electronic control unit is configured to activate the pump, set the first shut-off valve to the closed position, set the second shut-off valve to the open position, and perform the normal flow connection operation when the engine temperature is higher than the upper limit temperature of the predetermined temperature range and lower than the completely-warmed temperature, and the supply of the cooling water to the heat exchanger is requested.

3. The cooling apparatus according to claim 1, wherein the electronic control unit is configured to activate the pump, set the first shut-off valve to the closed position, set the second shut-off valve to the open position, and perform the opposite flow connection operation when the engine temperature is higher than the upper limit temperature of the predetermined temperature range and lower than the completely-warmed temperature, and the supply of the cooling water to the heat exchanger is not requested.

4. The cooling apparatus according to claim 1, wherein the electronic control unit is configured to activate the pump, set the first shut-off valve and the second shut-off valve to the closed positions, respectively, and perform the opposite flow connection operation when the engine temperature is lower than the lower limit temperature of the predetermined temperature range, and the supply of the cooling water to the heat exchanger is not requested.

5. The cooling apparatus according to claim 1, wherein the switching part is configured to shut off the normal and opposite flow connection passages, and the electronic control unit is configured to activate the pump, set the first shut-off valve to the closed position, set the second shut-off valve to the open position, and shut-off the flow of the cooling water into the second water passage by the switching part when the engine temperature is lower than the lower limit temperature of the predetermined temperature range, and the supply of the cooling water to the heat exchanger is requested.

6. The cooling apparatus according to claim 1, wherein the electronic control unit is configured to stop the activation of the pump when the engine temperature is lower than the lower limit temperature of the predetermined temperature range, and the supply of the cooling water to the heat exchanger is not requested.

7. A cooling apparatus for cooling a cylinder head and a cylinder block of an internal combustion engine by cooling water, the cooling apparatus comprising:

a pump for circulating the cooling water;

a first water passage formed in the cylinder head;

a second water passage formed in the cylinder block;

a third water passage for connecting a first end of the second water passage to a pump suctioning opening of the pump, the cooling water being suctioned into the pump via the pump suctioning opening;

a normal flow connection water passage for connecting a first end of the first water passage to the pump suctioning opening;

an opposite flow connection water passage for connecting the first end of the first water passage to a pump discharging opening of the pump, the cooling water being discharged from the pump via the pump discharging opening;

a switching part for switching a cooling water flow between a flow of the cooling water through the normal flow connection water passage and a flow of the cooling water through the opposite flow connection water passage;

a fourth water passage for connecting a second end of the first water passage to a second end of the second water passage;

fifth and sixth water passages for connecting the fourth water passage to the pump discharging opening, respectively;

a radiator provided at the fifth water passage for cooling the cooling water;

a heat exchanger provided in the sixth water passage for exchanging heat with the cooling water;

a first shut-off valve for shutting off and opening the fifth water passage, the first shut-off valve shutting off the fifth water passage when the first shut-off valve is set to a closed position, the first shut-off valve opening the fifth water passage when the first shut-off valve is set to an open position;

a second shut-off valve for shutting off and opening the sixth water passage, the second shut-off valve shutting off the sixth water passage when the second shut-off valve is set to a closed position, the second shut-off valve opening the sixth water passage when the second shut-off valve is set to an open position; and an electronic control unit for controlling activations of the pump, the switching part, the first shut-off valve, and the second shut-off valve, the cooling water flowing through the normal flow connection water passage when the switching part performs a normal flow connection operation while the pump is activated, the cooling water flowing through the opposite flow connection water passage when the switching part performs an opposite flow connection operation while the pump is activated, the electronic control unit being configured to:

activate the pump, set the first shut-off valve to the open position, and perform the normal flow connection operation when an engine temperature is equal to or higher than a completely-warmed temperature at which a warming of the internal combustion engine is estimated to be completed; and activate the pump and set the second shut-off valve to the open position when a supply of the cooling water to the heat exchanger is requested, wherein the electronic control unit is configured to activate the pump, set the first shut-off valve to the closed position, set the second shut-off valve to the open position, and perform the opposite flow connection operation when the engine temperature is in a predetermined temperature range defined by upper and lower limit temperatures lower than the completely-warmed temperature, and the supply of the cooling water to the heat exchanger is requested.

8. The cooling apparatus according to claim 7, wherein the electronic control unit is configured to activate the pump, set the first shut-off valve to the closed position, set the second shut-off valve to the open position, and perform the normal flow connection operation when the engine temperature is higher than the upper limit temperature of the predetermined temperature range and lower than the completely-warmed temperature, and the supply of the cooling water to the heat exchanger is requested.

9. The cooling apparatus according to claim 7, wherein the electronic control unit is configured to activate the pump, set the first shut-off valve to the closed position, set the second shut-off valve to the open position, and perform the opposite flow connection operation when the engine temperature is higher than the upper limit temperature of the predetermined temperature range, and the supply of the cooling water to the heat exchanger is not requested.

10. The cooling apparatus according to claim 7, wherein the electronic control unit is configured to activate the pump, set the first shut-off valve and the second shut-off valve to the closed positions, respectively, and perform the opposite flow connection operation when the engine temperature is lower than the lower limit temperature of the predetermined temperature range, and the supply of the cooling water to the heat exchanger is not requested.

11. The cooling apparatus according to claim 7, wherein the electronic control unit is configured to stop the activation of the pump when the engine temperature is lower than the lower limit temperature of the predetermined temperature range, and the supply of the cooling water to the heat exchanger is not requested.

* * * * *